US006341844B1

(12) United States Patent
Uchikata et al.

(10) Patent No.: US 6,341,844 B1
(45) **Date of Patent: *Jan. 29, 2002**

(54) APPARATUS USING OVERLAID FLEXIBLE CABLE FOR ELECTRICALLY CONNECTING RELATIVELY MOVEABLE PARTS

(75) Inventors: Yoshio Uchikata; Kou Hasegawa; Toshihide Wada; Tadashi Hanabusa; Tetsuyo Ohashi, all of Yokohama; Toshihiko Bekki, Kawasaki; Masaharu Ikado, Yokahama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/306,016

(22) Filed: May 6, 1999

Related U.S. Application Data

(62) Division of application No. 08/478,998, filed on Jun. 7, 1995, now Pat. No. 6,022,091, which is a continuation of application No. 07/994,916, filed on Dec. 22, 1992, now abandoned.

(30) Foreign Application Priority Data

Dec. 25, 1991 (JP) ..... 3-343286

(51) Int. Cl.[7] ..... B41J 2/14

(52) U.S. Cl. ..... 347/50

(58) Field of Search ..... 347/50, 86; 346/139 R, 346/139 D; 400/59, 328, 305; 439/43, 44, 47, 67, 74, 77, 254, 260, 445, 456, 493, 494, 498, 531

(56) References Cited

U.S. PATENT DOCUMENTS

| | | |
|---|---|---|
| 3,432,422 A | 3/1969 | Currey |
| 3,565,783 A | 2/1971 | Emery et al. |

(List continued on next page.)

FOREIGN PATENT DOCUMENTS

| | | |
|---|---|---|
| DE | 586 001 | 10/1933 |
| EP | 0 083 419 | 7/1983 |
| EP | 0 418 820 | 3/1991 |
| FR | 856 982 | 3/1939 |
| JP | 55-048139 | 4/1981 |
| JP | 60-204342 | 10/1985 |
| JP | 61-130136 | 6/1986 |
| JP | 63-212628 | 9/1988 |
| JP | 1-184175 | 7/1989 |
| JP | 4-347678 | 12/1992 |
| JP | 5-043071 | 2/1993 |

OTHER PUBLICATIONS

"Permanent Printhead Assembly for a Resistive Ribbon Typewriter or Printer", IBM Technical Disclosure Bulletin, vol. 30, No. 9, Feb. 1988, pp. 73–76.

*Primary Examiner*—Raquel Yvette Gordon
(74) *Attorney, Agent, or Firm*—Fitzpatrick, Cella, Harper & Scinto

(57) ABSTRACT

A carriage mechanism for carrying a recording head includes a carriage for carrying the recording head; a flexible cable for supplying a recording signal to the recording head; a head contact for establishing electric connection between the recording head and the carriage; a flexible cable pad on the flexible cable for contact with the head contact; and a common positioning portion engageable with the recording head, the flexible cable, the head contact and the flexible cable pad to simultaneously positioning them.

19 Claims, 41 Drawing Sheets

U.S. PATENT DOCUMENTS 4,675,696 A * 6/1987 Suzuki
4,987,442 A 1/1991 Uemori
5,018,884 A * 5/1991 Hirano et al.
5,054,944 A 10/1991 Matsuyama
5,170,184 A 12/1992 Hanabusa et al.
5,187,497 A 2/1993 Hirano et al.
5,481,290 A 1/1996 Watanabe et al.
5,512,926 A 4/1996 Uchikata et al.
5,610,636 A 3/1997 Hanabusa et al.

* cited by examiner (1)
(2)
(3)
(4)
(5)
326
321
321a
306b
306
302
322
304
315
306a
318a
314
302
316
317
305
8
4
3
313
318d
310a
309
310
320a
319
318b

APPARATUS USING OVERLAID FLEXIBLE CABLE FOR ELECTRICALLY CONNECTING RELATIVELY MOVEABLE PARTS

This application is a divisional of application Ser. No. 08/478,998, filed Jun. 7, 1995, now U.S. Pat. No. 6,022,091, which is a continuation of application Ser. No. 07/994,916, filed Dec. 22, 1992, now abandoned.

FIELD OF THE INVENTION AND RELATED ART

The present invention relates to an ink recording apparatus having a recording head which has an integral ink container for supplying ink to the recording head, and more particularly to reduction of the size of the entire apparatus or parts thereof. The present invention is directed to an ink recording apparatus usable for a printer, copying machine, wordprocessor, personal computer, facsimile or a combination of two or more of them.

Conventional ink supply mechanisms for an ink recording apparatus are classified into the following three groups. In the first type, the recording head is used for a long term (permanent type recording head), and the ink is supplied to an ink supply passage of the recording head from a large size ink cartridge. In the second type, the recording head has an integral ink container, and the integral recording head and the container are mountable as a whole. In the third type, the recording head has an integral ink container, and the ink can be replenished at a predetermined position, or the ink can be manually replenished by the operator.

In one of practical driving means for an ink jet recording head, an electrothermal transducer or a photo-thermal transducer applies thermal energy to the ink so as to cause film boiling of the ink to create a bubble, thus ejecting a droplet of the ink by the volume expansion of the bubble. In another practical ink jet recording head driving means, an electromechanical transducer is used to eject the ink.

In such an apparatus, the size of the printer is reduced, but the reduction is not enough to permit a built-in printer to be incorporated in a compound apparatus.

The reasons for this inability are as follows. When the printer is built in a compound or complex apparatus, the position of the printer is limited. In order to reduce the size of apparatus, size reduction and compound mechanism are further required to accommodate the printer in a limited space. The problems are analyzed by the inventors as follows.

(1) In a conventional recording apparatus in which a head cartridge is detachably mountable, the positioning between the recording head and the carriage, the positioning among the carriage, the flexible cable pads and the flexible cable, and the positioning between the head contact portion and the recording head, are independently set. In other words, the positioning actions are carried out at plural positions, so that the positioning between the elements which are not directly indexed is inaccurate. For example, even if the recording head is correctly positioned, the electric contacts are not accurately positioned. The positioning portions at different locations produce a complicated mechanism, and therefore, the size and the cost of the apparatus increase.

(2) In many machines such as a printer, scanner or the like, a flexible cable is widely used for transmission of signals and/or electric power between a movable side such as a recording head, sensor or the like and a fixed side such as the main assembly. The reduction of the size of these machines is highly desirable. On the basis of the number of cable patterns and current capacity required by the apparatus, the thickness and width of the pattern of the flexible cable, that is, the thickness and the width of the flexible cable, are determined. On the basis of the material and thickness of the flexible cable, the height required for folding the flexible cable so as to assure the durability of the machine, is determined, and therefore, the space required by the flexible cable is large. Heretofore, as shown in FIGS. 45A and 45B the flexible cable is divided into plural parts which are overlaid, by which the width required by the flexible cable arrangement is reduced.

However, with this method, the rigidity of the overall flexible cable increases because of the influence of the flexible cables at the bent portion, with the result of reduction of the durability of the flexible cables, and therefore, the bending height "h" is required to be larger than when the overlaying structure is not used. Therefore, the space required by the flexible cable is not reduced. As shown in FIG. 45B, the inside flexible cable is locally bent at 1100'*v*, with the result of the reduction of the durability of the flexible cable against the bending.

In a conventional friction separation type sheet feeding apparatus, as used in an original feeding device of a facsimile machine, a separating roller exerts a constant pressure. Therefore, after the sheet is discharged to the main apparatus, the main apparatus is required to pull the recording sheet out of the sheet feeding device with very strong force.

This requires the entire apparatus to be rigid, and prevents the reduction of the size and the power consumption. In addition, the large load required for sheet feeding results in inaccurate sheet feeding.

(4) In a conventional friction separation sheet feeding machine, as used in the recording sheet feeding mechanism of a copying machine, the sheet is fed to the friction separation portion by inclining the recording sheet toward the friction separation portion to permit feeding by the weight of the recording sheet.

(5) In a conventional friction separation type sheet feeding device, as used in an original feeding mechanism in a facsimile machine, a separation roller is located at a center of the sheet, and guiding members are provided at both sides to align the center of the recording sheet in the center of the separation roller based on the width of the sheet. In the conventional device, the guides are required at both sides, which prevents the reduction of the size. When the recording sheet is aligned at one lateral side not at the center, the center of the separation roller is required to move in alignment with the center of the sheet width.

(6) In a conventional ink jet recording apparatus, movement of a wiping blade is accomplished only by a cam and a gear provided in a recovery device.

However, the demand for the reduction of the size requires reduction of the number of parts and simplification thereof. However, for the purpose of improving print quality, the wiping means itself becomes complicated, and therefore, the number of parts tends to increase.

(7) In a conventional apparatus, an adjusting member for the lead screw and a spring are separate members. Therefore, if the lead screw is adjusted, the spring member is also required to be adjusted. Accordingly, the number of parts increases.

(8) In a conventional apparatus, projection members of a slide gear are symmetrically arranged, and therefore, there are plural engageable positions, and therefore, the assembling operation must be carried out with great care.

(9) In the head cartridge in which the ink ejection outlets are spaced apart from electric contacts, the size of the head cartridge is relatively large in order to provide the sufficient distance. In a head cartridge in which a cover is provided in the vicinity of electric contacts, the size of the head cartridge increases by the provision of the cover. In addition, since there is a limit to the arrangements of the ink ejection outlets and the electric contacts, design freedom decreases. In addition, the ink may enter the electric contact portion causing an unintentional short circuit with the possible result of damage of the recording head or the main assembly of the recording apparatus.

(10) In a wiping mechanism of a recovery device in a conventional ink jet recording apparatus, as shown in FIG. 46, a blade arm 161 supporting a blade 162 rotates about a pivot 161*a* to wipe the ejection side surface 160*b* of the recording head portion 160*a* of a cartridge 160. In order to completely remove the ink from the ejection side surface 160*b*, an entering amount a of the blade 162 relative to the ejection side surface 160*b* is within a certain range. However, in the conventional arrangement, the blade 162 moves arcuately and therefore, the entering amount a of the blade 162 to the ejection side surface 160*b* of the head is not constant. In order to completely remove the ink from the ejection side surface 160*b*, the positional relation between the ejection side surface 160*b* and the blade 162 has to be accurately controlled. This means that the required tolerance of the parts and the accuracy of assembling, is very high.

(11) In the conventional apparatus, the ink on the blade is removed by contacting an absorbing material to the blade with light pressure, and the blade is placed at the position. However, if the blade is kept contacted by the absorbing material for a long time in the conventional apparatus, the blade becomes deformed, so that the blade no longer functions to wipe out the ink.

SUMMARY OF THE INVENTION

Accordingly, it is a principal object of the present invention to provide an ink jet recording apparatus having a small size.

It is another object of the present invention to provide a small printer built in an information processing apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Figure 1:
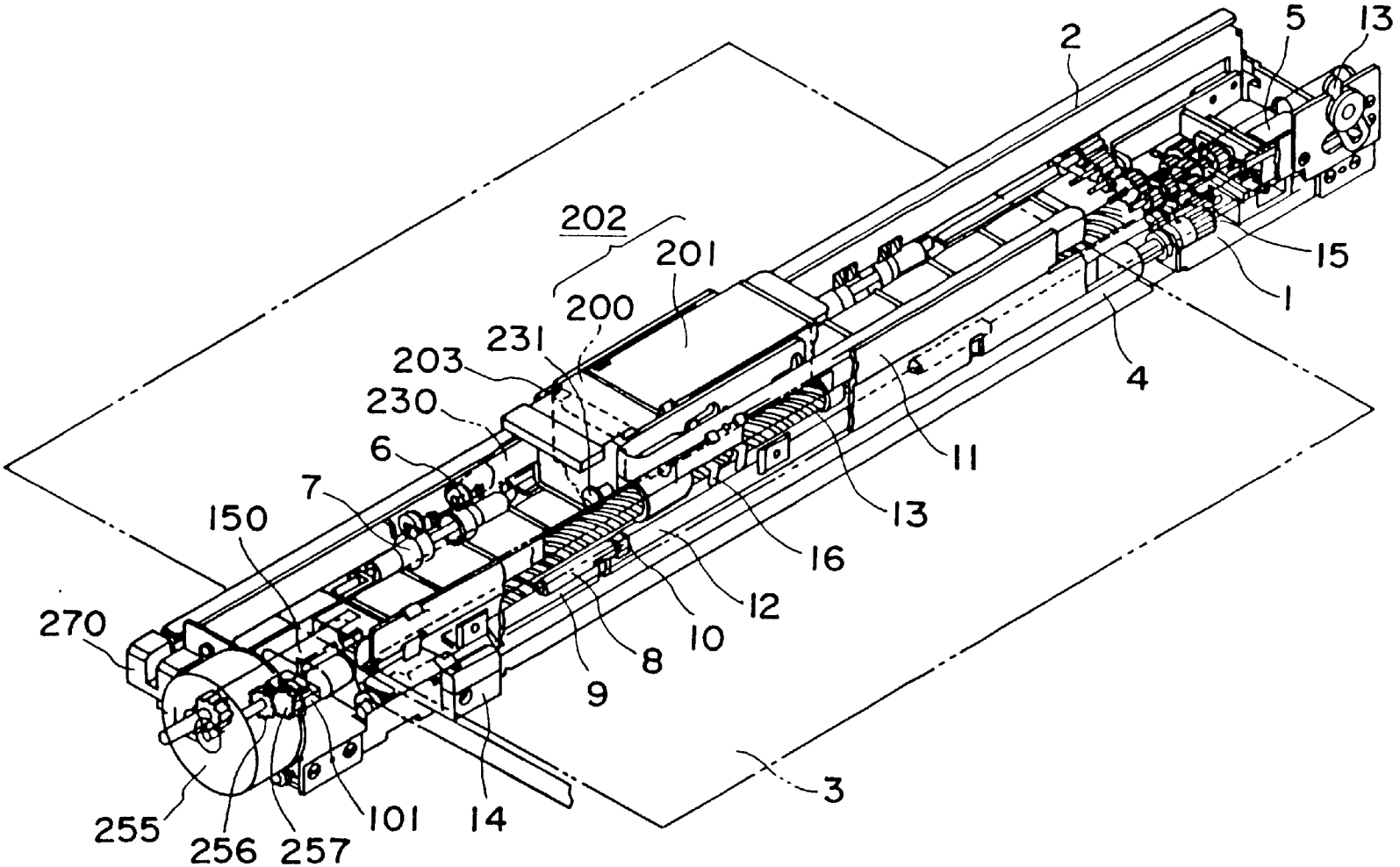
FIG. 1 is a perspective view of a recording apparatus according to a first embodiment of the present invention.

Referring to FIG. 1, there is shown a recording apparatus according to an embodiment of the present invention, in the perspective view. In the Figure, reference numeral 203 designates a carriage for carrying thereon a recording head cartridge 202 having a recording head 200 constituting the recording means and an ink container 201 integral with the recording head 200. An end of the carriage 203 adjacent the recording head 200 is engaged with a lead screw 213 for sliding movement in the axial direction, the lead screw 213 being rotatably mounted in a frame 1. The carriage 203 is provided with a guide at another end, and the guide is engaged with a guide rail 2 in the frame 1 for sliding movement in the direction parallel to the axis of the lead screw 213. The carriage 203 is reciprocable in the axial direction with rotation of the lead screw 213, while the pose thereof is maintained constant.

As shown in the Figure, a lead screw gear 257 fixed to the left end of the screw and a pinion gear 256 fixed to an output shaft of the carriage motor 255, are in meshing engagement, and a lead pin 209 (FIG. 5) mounted to the carriage 203 is engaged in a guiding groove 268 (FIG. 4) helically formed at a predetermined pitch on the lead screw 213. Therefore, when the lead screw 213 rotates by the forward or backward rotation of the carriage motor 255, the carriage 203 reciprocates. The detail of the scanning operation of the carriage 203 will be described in detail hereinafter.

A flexible cable 211 transmits the printing signal to the recording head 200 from an electric circuit which will be described hereinafter. It is supported on a pinch roller frame 11 at a correct position by a flexible cable holder 16.

The recording head 200 is moved in synchronism with the reciprocal movement of the carriage 203, and the ink is ejected in accordance with the recording signal, thus effecting recording on the recording material 3 in one line. The recording head 200 comprises fine liquid ejection outlets (orifices), liquid passages, energy application portions in the parts of the liquid passages, and energy generating means for generating energy for formation of liquid droplets.

The energy generating means includes an electromechanical transducer element such as a piezoelectric element, an electromagnetic wave source such as a laser to produce heat to eject the liquid, and an electrothermal transducer element in the form of a head generating resistor or the like to heat the liquid to eject it. Among them, in a recording head of an ink jet recording type in which the liquid is ejected using thermal energy, the liquid ejection outlets for formation of the droplets of the liquid can be arranged at high density, and therefore, a high resolution recording is possible. Particularly, the recording head using the electrothermal transducer element as the energy generating means, can be easily reduced in size. In addition, the advantages of IC manufacturing techniques and micro-machining techniques, which have recently been significantly improved and made more reliable, can be used, and therefore, high density arrangement is possible with the advantage of low manufacturing cost.

When one line of recording is completed by the scan of the carriage 203, the recording material 3 is fed by one line by feeding means, and the next line recording operation is carried out. The feeding of the recording material 3 is accomplished by a feeding roller 4 and a pinch roller 8 press-contacted thereto, and a discharging roller 7 and spurs 6 contacted thereto.

More particularly, the recording material 3 having a recording surface facing the ejection side surface of the recording head 200 is press-contacted to the feeding roller 4 by the pinch roller 8, and the feeding roller 4 is rotated by a sheet feed motor 5, by which the recording material 3 is fed a proper distance. After the recording operation, the recording material is press-contacted to the discharging roller 7 by the spurs 6, and the recording material is discharged to the outside of the apparatus by the rotation of the discharging roller 7.

The feeding roller 4 and the discharging roller 7 are driven by the feeding motor 5 through a reduction gear train 15.

The position of a rotational shaft of the spurs 6 contactable to the recording side surface of the recording material 3, are fixed, and therefore, the contact positions between the recording material 3 and the spurs 6 do not change irrespective of the thickness of the recording material 3. However, the discharging roller 7 contactable to the non-recording side of the recording material 3 deforms depending on the thickness of the recording material 3 to accommodate the variations of the thickness of the recording materials. More particularly, the discharging roller 7 is made of thin rubber and is formed into a conical shape, so that it elastically deforms in the radial direction. Thus, it deforms in accordance with the pressure-contact force relative to the spurs 6 and the thickness of the recording material 3.

The same advantageous effects can be provided if the discharging roller 7 is made of a material exhibiting large elastic deformation, such as porous sponge, low hardness resin, rubber or the like.

The entirety of the discharging roller 7 may be press-contacted to the spurs 6 by a spring or the like. Thus, the space between the recording head 200 and the recording material 3 can be maintained at a predetermined level irrespective of the thickness of the recording material 3, so that the recording material 3 can be stably fed.

A paper sensor 14 functions to detect presence or absence of the recording material 3.

The description will be made as to a pressing mechanism for a pinch roller 8 which is a follower rotatable member functioning to press the recording material 3 to the discharging roller 4 in the form of a driving rotatable member.

Figure 2:
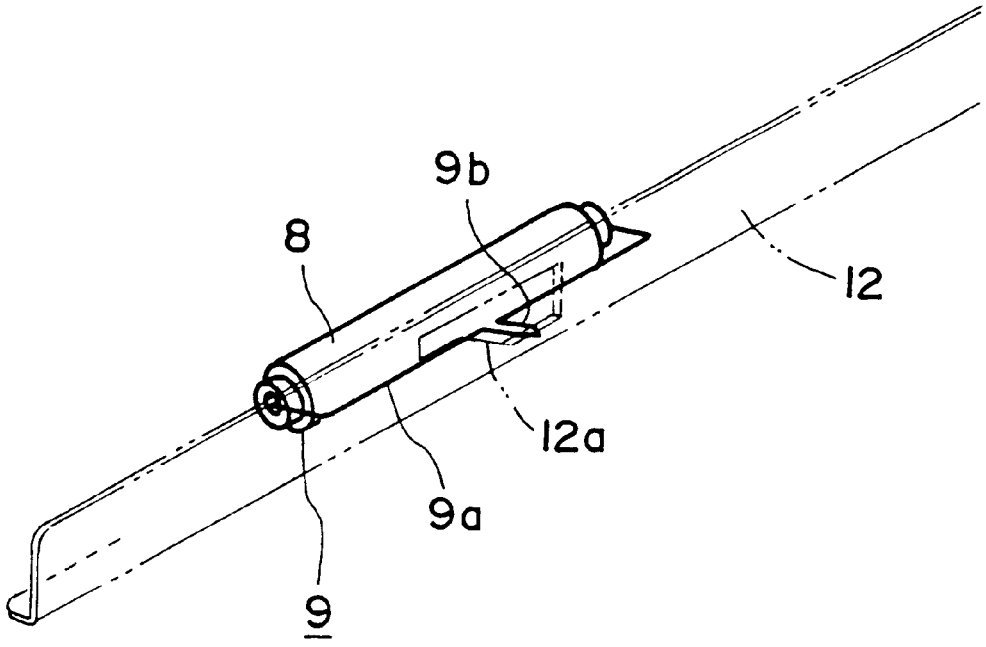
FIG. 2 is a perspective view illustrating a released pinch roller in an apparatus according to the first embodiment.

In FIG. 2, the pinch roller 3 is provided at the opposite ends molded bearings. It is supported by pinch roller springs 9 having ends bent into the bearings. The pinch roller spring 9 is supported so as to be rotatable about a shown shaft 9*a* using a pinch roller holder 10, to the pinch roller frame 11. The central portion of the shaft 9*a* of the pinch roller spring 9 is folded back in "U" shape to constitute a lever 9*b*.

The structure of operating means for changing the pressure of the pinch roller 8 by the pinch roller spring 9 is such that a slidable release angle 12 is overlaid on the pinch roller frame 11, the pinch roller spring 9 is raised by operating the angle to produce twist in the shaft 9*a*. The pinch roller 8 is pushed to the feeding roller 3 by the repelling force. By removing the twist, the pressing force is released.

Figure 3:
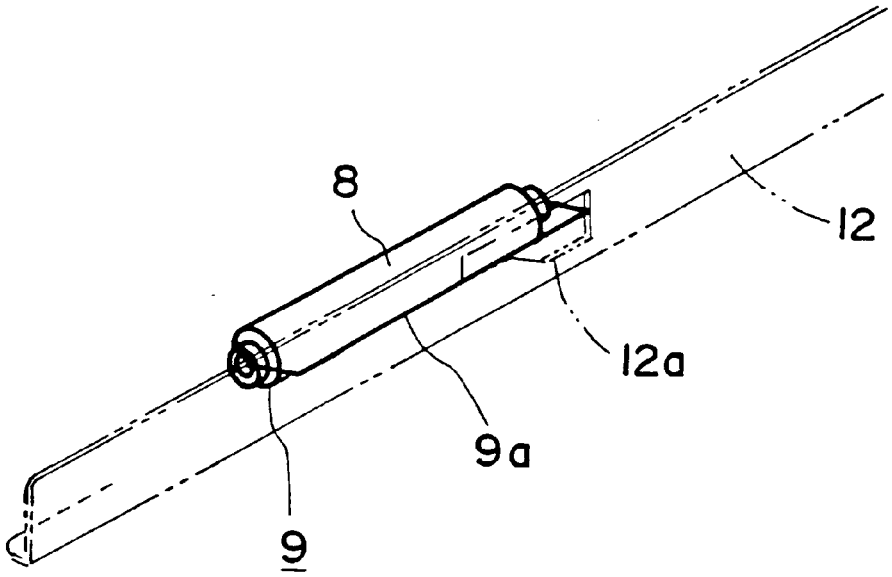
FIG. 3 is a perspective view illustrating a pinch roller in a pressing state in the apparatus of the first embodiment.

In the state of FIG. 3, the shaft is twisted (elastic deformation) by the lever 9*b* being urged by the cam 12*a* of the release angle 12, in the state of FIG. 3. When the release angle 12 is slid in the direction of an arrow in FIG. 3, the state of FIG. 2 is established, so that the cam 12*a* lowers to lower the lever of the pinch roller 8. Then, the shaft 9*a* restores to remove the twist, and therefore, the pressing force of the pinch roller 8 to the conveying roller 4 decreases.

Therefore, even if the pinch roller 8 is not completely spaced away from the conveying roller 4, the jammed recording material 3 can be easily pulled out. The release angle 12 can be slid toward left or right by rotating the release lever 13. The release lever 13 is rotatably supported on the pinch roller frame, and has an elongated slot at side opposite from the lever with respect to the rotational shaft, and a grip of the release angle 12 is engaged in the elongated slot. By rotating the release lever 13, the release angle 12 moves in parallel.

Figure 4:
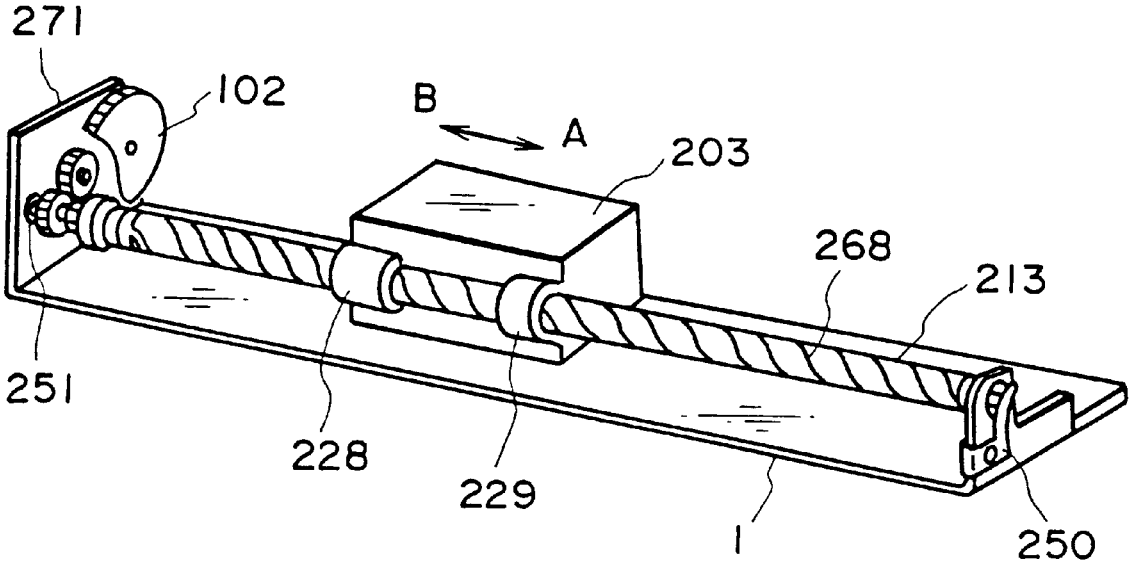
FIG. 4 shows a lead screw mechanism in the apparatus of the first embodiment.

FIG. 4 is a lead screw mechanism for moving the carriage 203 relative to the recording material. Only the members required for its function are shown.

In a lead screw 213 slidably engaged with the carriage bearings A228 and B229 mounted on the carriage 203, the right end of the lead screw 213 is rotatably engaged with the frame 1 by way of adjusting spring 250.

The left end is rotatably engaged with a recovery system plate 271 by way of a bearing 251. A guiding portion (not shown) of the carriage 203 is slidably engaged with a guide rail 2 to guide the carriage 203 without rotation.

The lead screw 213 has plural grooves 268, and one of them slidably receives a lead pin 209 so as to drive the carriage 203 in directions A and B parallel with the axis of the lead screw 213.

Figure 5:
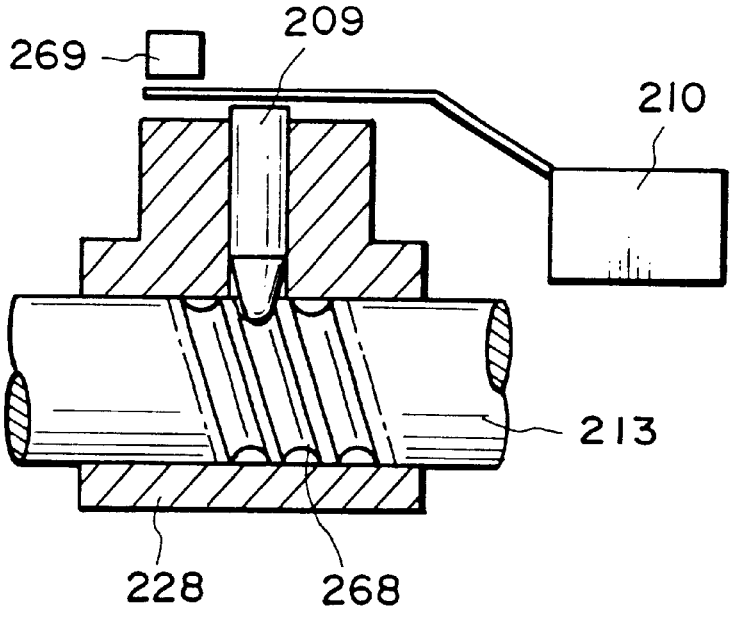
FIG. 5 is an enlarged view of a carriage bearing A229 in the first embodiment apparatus.

FIG. 5 is an enlarged sectional view of the carriage bearing A228 in FIG. 4. The lead pin 209 has a spherical end, which is slidably engaged with a hole formed in the main body of the carriage 203 tending in a direction perpendicular to the axis of the lead screw 213 between the carriage bearing A228 and the carriage bearing B229. The spherical portion is in slidable engagement with the lead screw 213 and is urged to the lead screw 213 by a lead pin spring 210 detachably mounted on the main assembly of the carriage 203 at the other end.

Above the lead pin spring 210 in the lead pin 209 sliding direction, a stopper 269 is provided to limit the movable range of the lead pin 209 to prevent the lead pin 209 from disengaging from the guiding groove 268.

Figure 6:
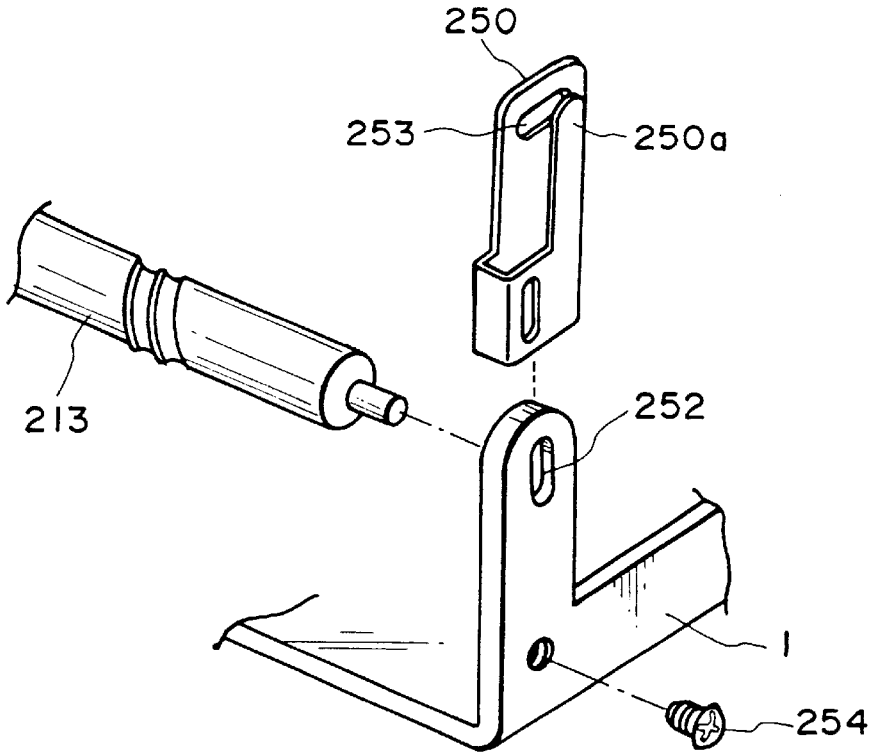
FIG. 6 is an enlarged view of an end of the lead screw in the first embodiment apparatus.
Figure 6:
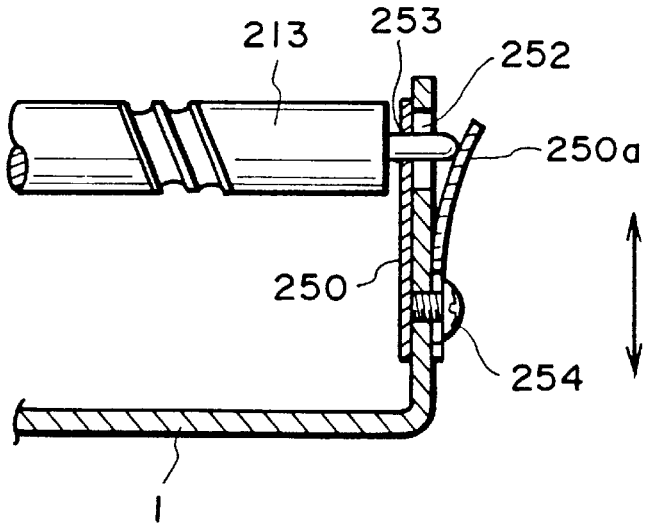

FIG. 6 is an enlarged view of one end portion of the lead screw. The distance between the recording head 200 on the carriage 203 and the recording material 3 is determined on the basis of the distance of the lead screw 213 supporting the carriage 203 from the recording material 3. However, the left end of the lead screw 213 is determined by the plate 271 of the recovery system, and at the right end, a first elongated slot 252 is formed in the frame 1 extending in a direction perpendicular to the recording material 3 so that the lead screw 213 is adjusted to be parallel with the recording material 3 with the reference of the left end.

The adjusting spring 250 is provided with a second elongated slot 253 which extends parallel to the recording material 3 when the adjusting spring 250 is mounted on the frame 1 and which limits the movement in the perpendicular direction relative to the recording material 3 at the right end of the lead screw 213.

The right end of the lead screw 213 is supported by the first elongated slot 252 and the second elongated slot 253, and the lead screw 213 can be adjusted to be parallel to the recording material 3 by a movement of the adjusting spring 250 in a direction perpendicular to the recording material 3 (the direction of the arrow in the Figure) having the same elongated slot 253.

The adjusting spring 250 has an integral spring 250a for urging the right end of the lead screw 213 to the left end. The adjusting spring 250 is fixed on the frame 1 by screws 254.

Figure 7:
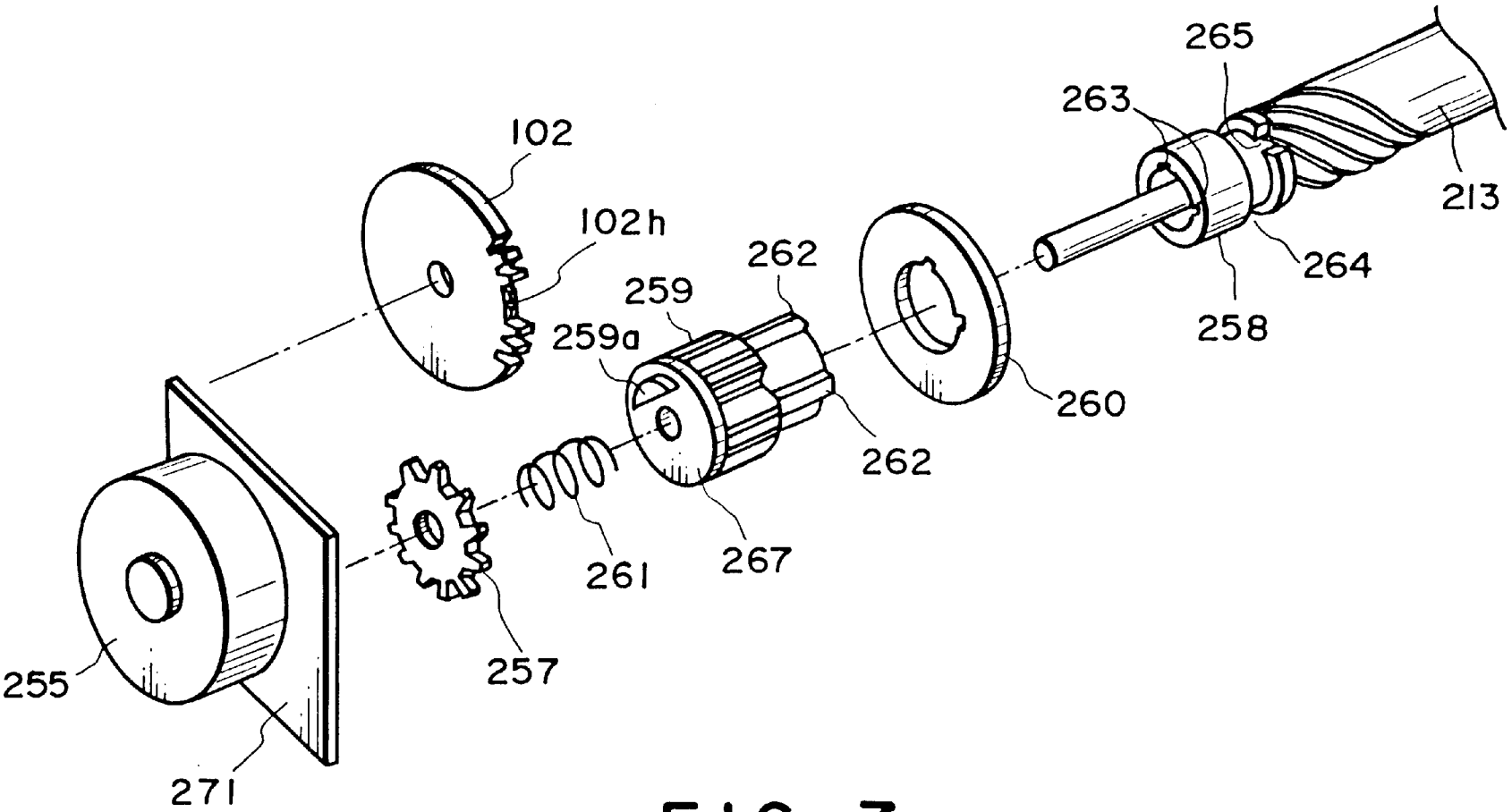
FIG. 7 shows a left end of a lead screw 223 having a clutch mechanism in the first embodiment apparatus.

FIG. 7 shows the left end portion of the lead screw 213 having a clutch mechanism for transmitting to the recovery system the driving force of the carriage motor 255 through the lead screw 213.

To the recovery system plate 271, the carriage motor 255 is mounted. To the shaft of the carriage motor 255, a pinion gear 256 (FIG. 1) is fixed. The pinion gear 256 is in meshing engagement with the lead screw gear 257 fixed to the lead screw 213. Therefore, the forward rotation of the carriage motor 255 rotates the lead screw 213 in the forward direction, thus moving the carriage 203 along the guiding groove 263 through the lead pin 209 slidably engaged with the guiding groove 268 of the lead screw 213. A control gear 102 is provided on the recovery system plate 271.

Adjacent the left end of the lead screw 213, there are an initial locking mechanism 258, a clutch plate 260, a clutch gear 259 and a spring 261.

The initial locking mechanism 258 is fixed on the lead screw 213. The clutch gear 259 is engaged with the lead screw 213 for slidable engagement in the direction of the axis thereof. A part thereof is extended into the inside of the initial locking mechanism 258.

The clutch gear 259 is provided with two projections 262 at non-symmetrical positions on the circumference thereof. The projections 262 are engaged, for movement only in the axial direction, with recesses 263 formed in the initial locking mechanism 258 in the same phase as the projections 262.

The lead screw gear 257 side end surface of the clutch gear 259 is provided with a flange 267. On the flange 267, trigger teeth 259*a* are formed to supply the control gear 102 with a rotation trigger.

The control gear 102 has a gear at the outer periphery thereof at such a position for engagement with the clutch gear 259 of the lead screw 213 when the lead screw 213 is assembled into the recovery system plate 271. However, during the recording operation, a cutaway portion of the control gear 102 is faced to the clutch gear 259, and therefore, the control gear 102 is not engaged with the clutch gear 259.

On a side of the portion where the gear is cut-away, a side gear 102*h* is formed. The side gear 102*h* is engaged with the trigger tooth 259*a* of the clutch gear 259 through operation which will be described hereinafter so as to give a rotational trigger to the control gear 102.

Between the initial locking mechanism 258 and the clutch gear 259, a clutch plate 260 is inserted. A lead screw gear 257 is fixed to the lead screw 213. Spring 261 is disposed between the clutch gear 259 and the lead screw gear 257 to normally urge the clutch gear 259 to the initial locking mechanism 258.

In the peripheral surface of the initial locking mechanism or member 258, an idle groove 264 having a similar configuration as the groove of the lead screw 213 is formed, and is connected only with the groove for guiding the lead pin 209 by way of a connecting groove 265.

When the carriage motor 255 rotates in the forward direction, the carriage 203 moves in a direction A indicated by an arrow in FIG. 4. When it rotates in the backward direction, the carriage 203 moves in a direction B.

A home position sensor 270 (FIG. 1) is mounted to the recovery system plate 271, and the carriage 203 is scanned by rotation of the carriage motor 255. The detection of a light blocking plate 230 (FIG. 1) of the carriage 203 passing through the home position sensor, may be used as a reference for the recording operation and a recovery operation which will be described hereinafter.

FIG. 8 illustrates an operation of a clutch mechanism for transmitting the driving force from the carriage motor 255 to the recovery system.

Figure 8A:
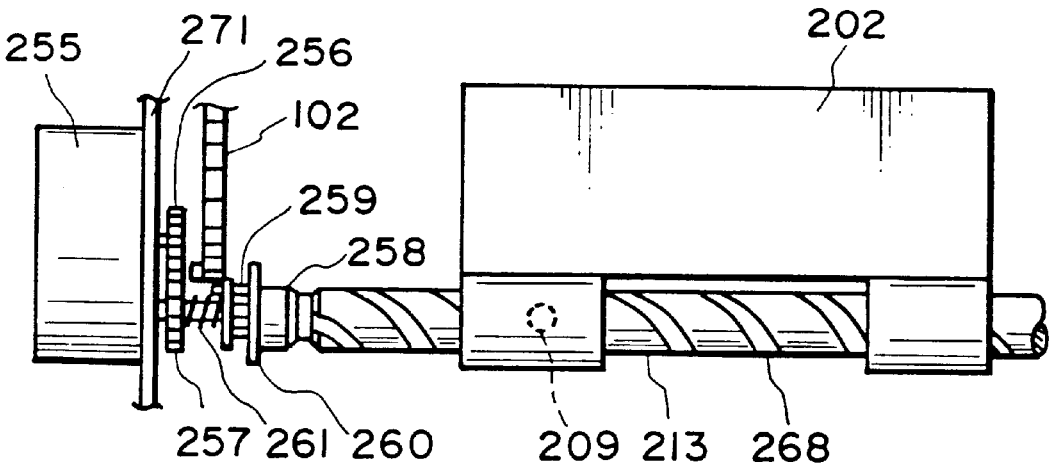
FIGS. 8A and 8B illustrate operation of a clutch mechanism in the first embodiment apparatus.

When the carriage motor 255 is rotated in the backward direction from the state of FIG. 8A, the lead pin 209, effective to move the carriage 203, is guided into the idle groove 264 of the initial locking member 258 through the connecting groove 265 from the guiding groove 268 of the lead screw 213.

Figure 8B:
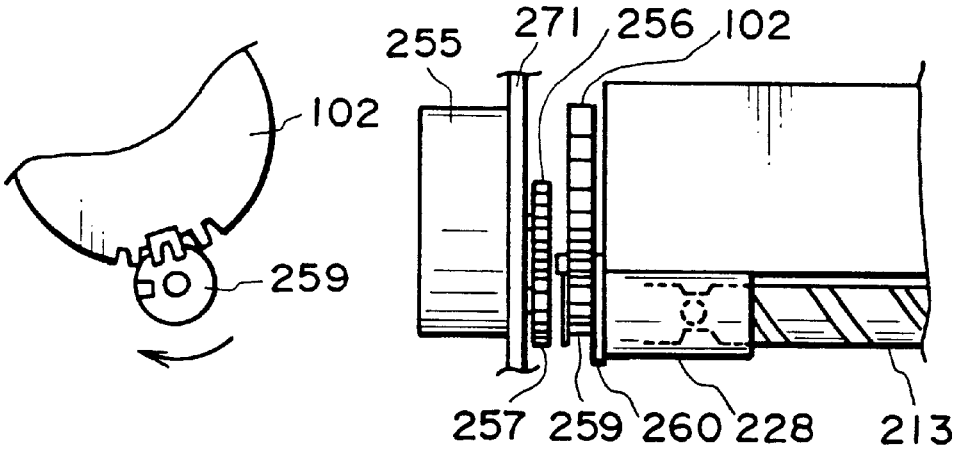

At this time, as shown in FIG. 8B, the end of the carriage bearing A228 pushes the clutch plate 260, which in turn pushes the clutch gear 259 until it is engaged with the control gear 102. At this time, the gear teeth of the control gear 102 corresponding to the teeth of the clutch gear 209 are cut-away, and therefore, the control gear 102 does not rotate.

Figure 9:
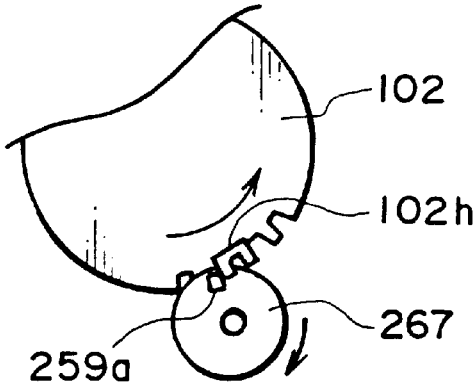
FIG. 9 illustrates meshing engagement between a clutch gear and a control gear in the first embodiment apparatus.

With further rotation of the carriage motor 255 in the backward direction, the trigger tooth 259*a* of the clutch gear 259 in engaged with the side gear 102*h* of the control gear 102, as shown in FIG. 9, thus rotating the control gear 102 to permit the teeth of the control gear 102 to be engaged with the clutch gear 259.

The clutch gear 259 has the flange 267, and at the time when the clutch gear 259 is engaged with the control gear 102, the flange 267 of the clutch gear 259 is engaged with the side surface of the control gear 102 to continue the engagement with the control gear 102. With further backward rotation of the carriage motor 255, the recovery operation starts.

After the completion of the recovery operation, the carriage motor 255 is rotated in the forward direction. At the time when the engagement start position between the control gear 102 and the clutch gear 259 is reached, the engagement between the control gear 102 and the flange 267 of the clutch gear 259 is released. Then, the clutch gear 259 tends to restore the original position by the spring 261. The clutch plate 260 engaged with the clutch gear 259 is similarly pushed, and the carriage bearing A228 of the carriage 203 contacted to the clutch plate 260 is similarly pushed.

With further forward rotation, the lead pin 209 guiding the carriage 203 is pushed out from the idle groove 264 of the initial locking member 258 to the guiding groove 268 of the lead screw 213 by way of the connecting groove 265.

Thus, the carriage 203 is brought into the state in which it is capable of scanning movement by the carriage motor 255 rotation.

Figure 10:
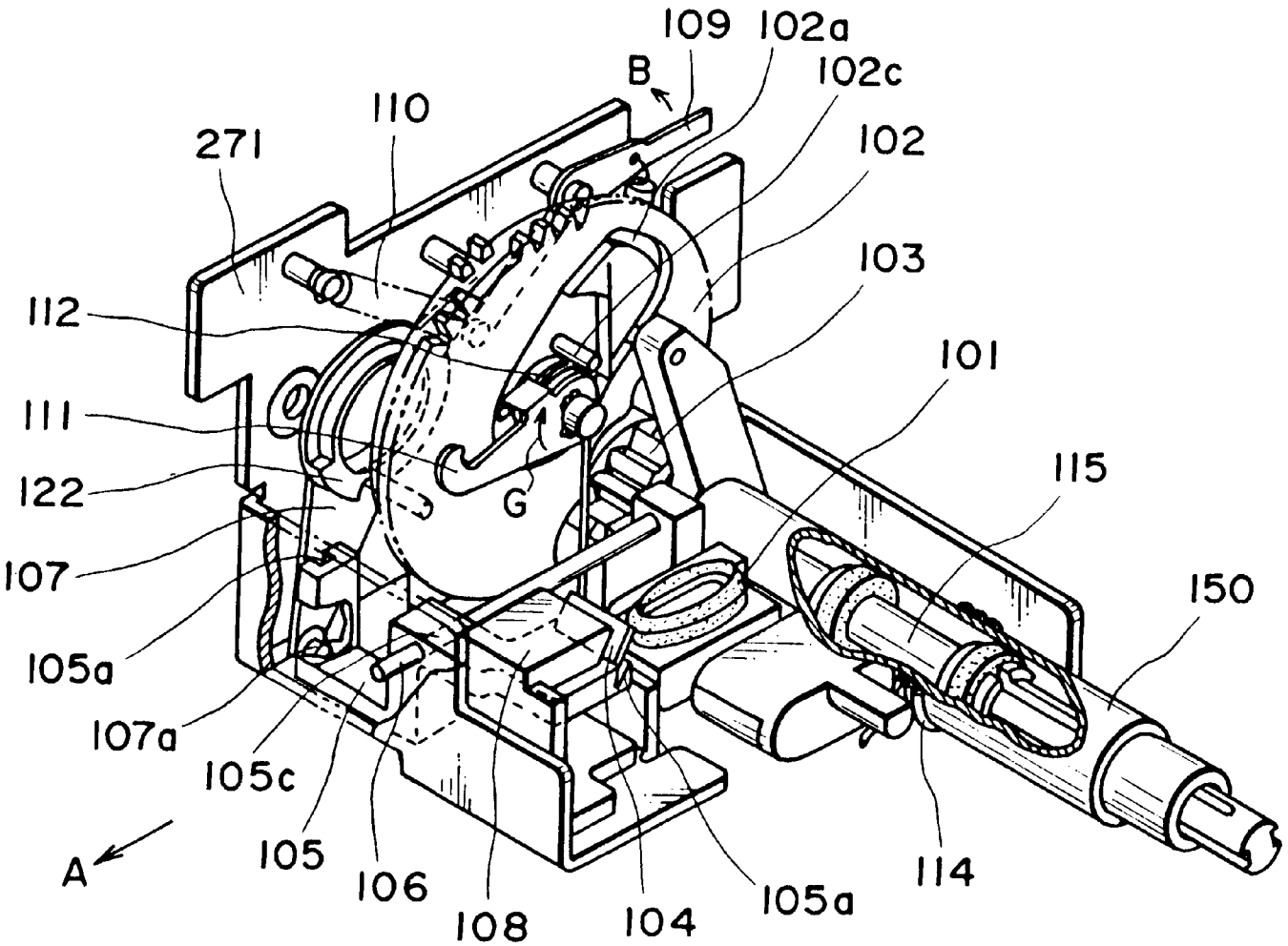
FIG. 10 illustrates a recovery device in the first embodiment apparatus.

FIG. 10 is a perspective view of a recovery mechanism of a recording apparatus of this embodiment.

In this Figure, it comprises a cap 101 for capping the ejection side surface of the recording head 200, a pump unit 150 for sucking the ink from the ejection side surface through the cap 101 and discharging the ink to a discharge ink absorbing material, and a control gear 102 for a drive transmission including cam and gear mechanism to move the cap 101 toward and away from the ejection side surface, to transmit the driving force to the pump unit 150 and to operate a wiping mechanism for wiping the ejection side surface to remove the ink thereon. The control gear 102 is supplied with a rotational driving force from the carriage motor 255 through the clutch gear 259.

A description will be made below as to how to drive the recovery means by the rotation of the control gear 102.

Figure 11:
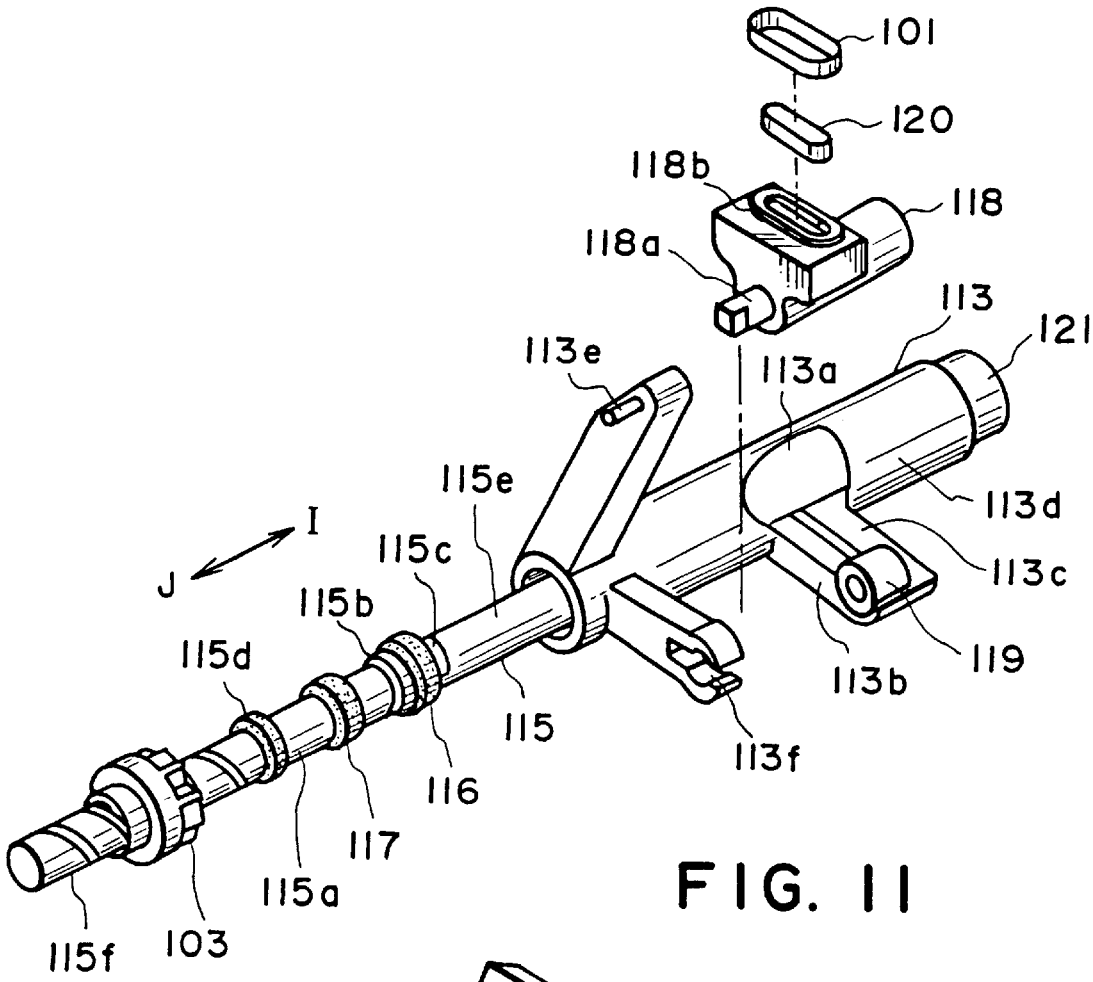
FIG. 11 illustrates a pump unit in the first embodiment apparatus.

The control gear 102 is provided with a gap moving cam 102A and a wiping operation cam (not shown). As shown in FIGS. 10 and 11, control gear 102 is in meshing engagement with a stroke gear 103 for reciprocating the plunger 115 which will be described hereinafter. The rotation of the control gear 102 rotates the stroke gear 103 to reciprocate the plunger 115.

Figure 12:
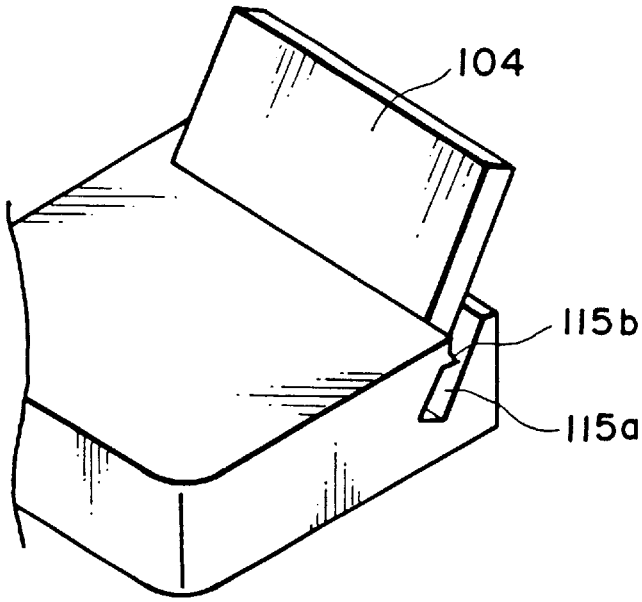
FIG. 12 is a perspective view of a blade mounted in the first embodiment apparatus.

In FIG. 10, the blade 104 functions to wipe the ejection side surface of the recording head 200 to clean the ink ejection side surface. The blade 104 is made of HNBR or urethane rubber or the like. It is mounted by sliding insertion of an end into a blade mounting groove 105*a* of the blade slider 105. As shown in FIG. 12, the blade mounting groove 105*a* is provided with a projection 105*b* having an acute angle edge to prevent release of the blade. Therefore, even if force is applied tending to pull out the blade 104 during the wiping operation, it is not pulled out because of the projection 105*b*.

The blade slider 105 is provided with a through hole 105*c* to be movable along a sliding shaft 106 parallel to the ejection side surface of the recording head. Because of the reciprocal motion along the slide shaft 106, the entering distance of the blade 104 to the recording head 200 is always constant irrespective of the position on the ejection side surface, and the ejection side surface is uniformly wiped.

The reciprocal motion of the blade slider 105 is carried out by a blade link 107. The blade slider 105 is reciprocated by a projection 107*a* of the blade link 107 pushing a wall 105*a* of the blade slider 105. The blade link 107 is controlled in its motion by a wiping cam (not shown) formed in the control gear 102.

When the ejection side surface of the recording head 200 is wiped by the motion of the blade slider 105, the ink deposited on the blade 104 is transferred to a blade cleaner 108 so that the blade 104 is maintained in clean state. After the blade 104 moving in the direction A in FIG. 10 for wiping operation has covered all the ejection side surface, it is contacted to the blade cleaner 108, upon which the ink on the blade is absorbed by the blade cleaner 108.

If the blade 104 is always in contact with the blade cleaner 108, the creep of the rubber results in deformation of the blade 104 even to such an extent that the function thereof can not be performed. In consideration of this, after the blade 104 is contacted to the blade cleaner 108, it is moved in the direction opposite from the direction A wiping cam of the control gear 102, so that the blade 104 is moved away from the blade cleaner so as to prevent the blade 104 from being subjected to the external force.

Since the blade link 107 is controlled irrespective of the rotation direction of the carriage motor 255, following the wiping cam of the control gear 102, the motion of the blade link 107 is definitely determined in accordance with the rotational angle of the control gear 102. In other words, the position of the blade 104 is controlled only by the angle of the control gear 102. In this case, if the wiping operation is carried out when the carriage enters the recovery means region by the reverse rotation of the carriage motor 255, then, the wiping operation is also carried out when the carriage is going out of the recovery means range by the forward rotation of the carriage motor 255. Therefore, the ejection side surface is wiped by both surfaces of the blade 104. However, the blade 104 inherently has front and back sides when the edge thereof is cut, and therefore, the proper wiping operation can be carried out only by one surface. If the wiping operation is carried out with a wrong surface of the blade, the improper printing operation occurs.

In this embodiment, this problem is solved in the following manner.

As shown in FIG. 1, an inclination is provided in a part of a blocking plate 230. When the carriage 203 enters the recovery means region, the blocking plate 203 rotates the blade stopper 109 in the direction B in FIG. 10.

Referring to FIG. 13, the subsequent operations will be described. When the lead pin 209 of the carriage 203 is completely received by the idle groove 264, the blade stopper 109 rotates to the position shown in FIG. 13A, and stops there.

Figure 13A:
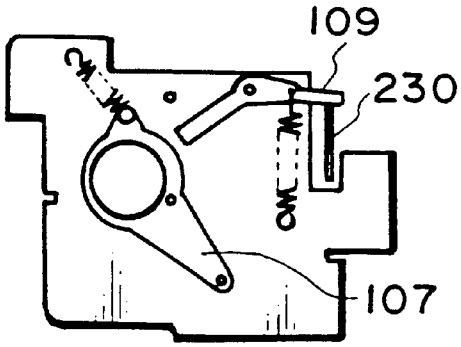
FIGS. 13A, 13B, 13C, 13D, 13E and 13F illustrate operation of a blade stopper in the first embodiment apparatus.
Figure 13D:
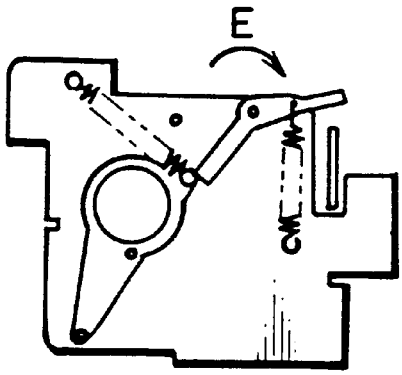
Figure 13B:
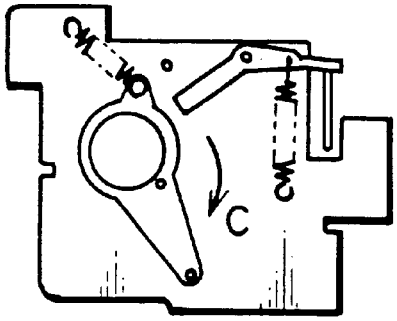

Next, the control gear 102 starts to rotate, and with the rotation, the blade link 107 starts to rotate in the direction C, as shown in FIG. 13B.

Figure 13E:
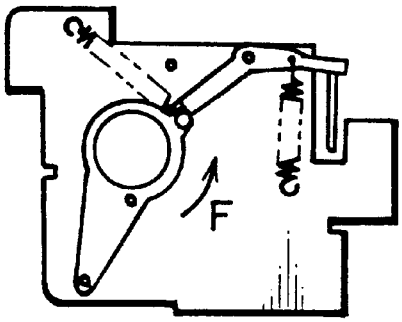
Figure 13C:
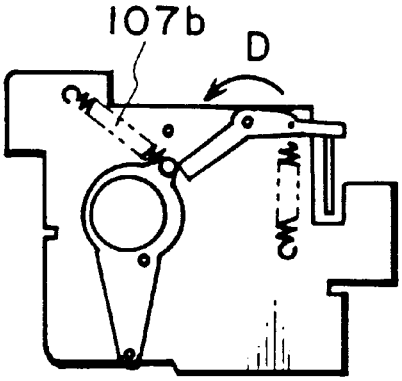

The blade link 105 rotates to the position of FIG. 13C. As the rotation continues, the spring hook 107*b* of the blade link 107 starts to rotate the blade stopper 109 in the direction D. When the blade link 107 rotates to the position shown in FIG. 13D, the blade stopper 109 is engaged from the spring hook 107*b* of the blade link 107, and rotates in the direction E. However, the rotation thereof is stopped by the blocking plate 230, and therefore, rotates to the position of FIG. 13E, and the blade stopper 109 stops.

After, the carriage motor 255 rotates in the forward direction, and the blade link 107 is disengaged from the wiping cam of the control gear 102. Then, it tends to rotate in the direction F by the tension force of the blade spring 110, but as shown in FIG. 13E, the rotation is stopped by the blade stopper 109.

Figure 13F:
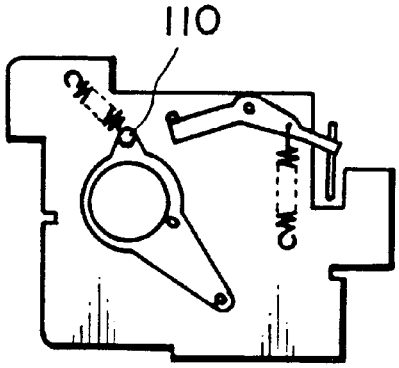

Finally, when the carriage 203 has completely left the recovery means range, the control of the blade stopper 109 ends as shown in FIG. 13F, so that the blade link 107 rotates, so that the blade 104 reaches the topmost point in the opposite direction from the direction A in FIG. 1, and stops there.

In this manner, the wiping movement paths of the blade 104 are made different between when the carriage 203 enters the recovery means range and when it leaves the range, by which the wiping action of the blade 104 by the opposite surface is prevented.

Reference numeral 111 designates a carriage stopper which is effective to prevent the carriage 203 from entering the recording range by vibration or impact thereto. The carriage stopper 110 is normally urged in a direction of an arrow G in FIG. 10 by a carriage hook spring 112. During the recording operation, it is retracted from the carriage hook 231 by a projection 102*c* of the control gear 102.

The operation will be described. When the lead pin 209 of the carrier 203 enters the idle groove 264, and the control gear 102 starts to rotate, the projection 102*c* of the control gear 102 becomes away from the carrier stopper 111. The carrier stopper 111 then rotates in the direction G in FIG. 10 to be engaged with the carrier hook 231. Therefore, in the rest state not performing the recording operation, the carriage stopper 111 is engaged with the carriage hook 231 to prevent the carriage 203 from moving to the recording position.

In addition, the carriage stopper 111 also functions to prevent disengagement of the control gear 102 from the shaft using an E ring.

The pump unit 150 has a plunger pump structure, as shown in FIG. 11.

In FIG. 11, reference numeral 113 designates a cylinder which comprises a cylindrical portion 113*a*, a guide (not shown) for guiding a plunger 115 which will be described. It is partly cut-away in the axial direction to provide an ink path. A cap lever receptor 113*b* is formed to receive and engage with the cap lever seal which will be described hereinafter. An ink input port 113*c* opens at a predetermined position. An ink discharge pipe 113*d* is integrally formed, and the end thereof is inserted into the discharge ink absorbing material. Designated by a reference numeral 113*e* is a parallel pin for opening and closing the cap. When the parallel pin 113*e* is pushed by the cap moving cam 102*a* of the control gear 102, the cylinder 113 rotates to move the cap 101 to and away from the ejection side surface of the recording head 200.

Figure 14:
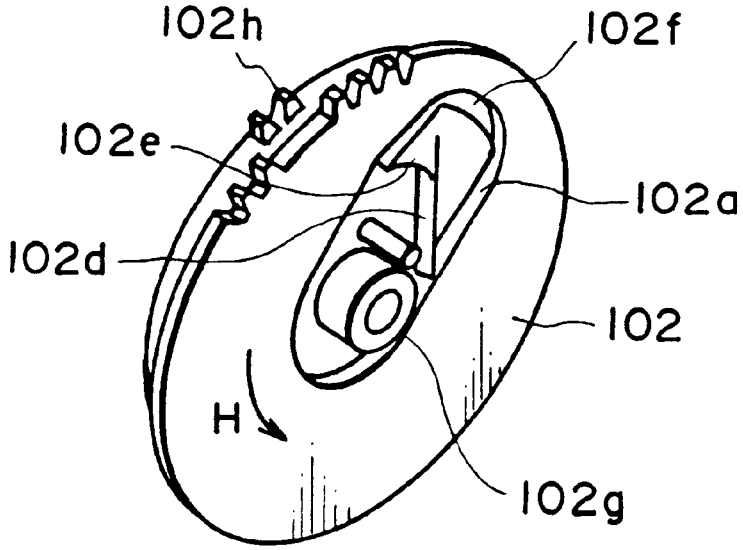
FIG. 14 illustrates a cam for opening and closing a gap in the first embodiment apparatus.

Referring to FIG. 14, the description will be made as to a relation between the cap moving cam 102*s* of the control gear 102 and the cap movement.

The cap moving cam 102*a* is provided with a switching sheet 102*d*, by which the cap moving operation can be switched by switching the rotational direction of the carriage motor 255.

In this embodiment, as will be described hereinafter, the ink is preliminarily ejected into the cap 101, and therefore, the ink accommodated in the cap 101 during the recording operation is required to be drawn into the cylinder 113, before the capping action after the carriage 203 comes into the recovery means range.

When the control gear 102 starts to rotate by the backward rotation of the carriage motor 255, the parallel pin 113*e* inserted into the cylinder 113 first passes by the cam 102*e* surface. In the Figure, the cap 101 is more open if the cam surface is closer to the center of the control gear 102. Therefore, in this case, the ink-drawing operation is possible while the cap 101 is opened (preliminary ejection drawing). Then, the control gear 102 stops, and the ink-drawing operation is completed. When it starts to rotate in the forward direction, parallel pin 113*e* passes by the cam surface 102*f*, and the cap 101 is closed first after the start of the control gear 102 rotation. Normally, the system is at rest with the cap in the closed position.

When the recording operation is to be started, carriage motor 255 is rotated in the forward direction, and the control gear 102 rotates in a direction H as indicated by an arrow H in the Figure.

However, when the ink-drawing operation is to be started, the carriage motor 255 rotates in the backward direction, and therefore, the control gear 102 rotates in the opposite direction from the direction H. In this case, the parallel pin 113*e* is contacted to the cam surface 102*f*, and therefore, the ink-drawing operation is carried out with the cap 101 being closed.

By the provision of the switching sheet 102*d*, two ink-drawing operations, namely the normal ink-drawing operation and the preliminary ejection ink-drawing operation are accomplished by a single control gear.

During the recording operation, the parallel pin 113*e* is in a cut-away portion 102*g* formed in the cam, so that the control gear 102 is prevented from rotating by the friction force provided by the cap spring 114. If the control gear 102 rotates during the recording operation, the recovery operation begins at the wrong time, thus disturbing the normal recording operation.

The plunger 115 is provided with an operating shaft 115*a*, a piston receptor 115*b*, a piston confining member 115*c* and a pump seal confining member 115*d*. A groove 115*e* functioning as an ink passage is formed continuing from the operating shaft 115*a*. A part of the groove is partly in a guiding portion (not shown) of the cylinder 113 to stop rotation of the plunger 115. The operating shaft 115*a* has a lead groove 115*f* for controlling reciprocal motion of the plunger 115. An unshown projection formed in the inside of the stroke gear 103 is engaged with the lead groove 115*b*. Therefore, when the stroke gear 103 is rotated in one direction by a reverse drive of the carriage motor 255, the plunger 115 moves in a direction indicated by an arrow I in FIG. 11. When the stroke gear 103 is rotated in the other direction by the forward drive of the carriage motor 255, the plunger 115 is moved in the direction indicated by an arrow J in FIG. 11.

To the plunger 115, a piston 116 made of rubber material such as NBR or the like is mounted. The outer diameter of the piston 116 is larger than the inside diameter of the cylinder 113 by a predetermined amount. When the piston 116 is inserted into the cylinder 113, it is properly compressed. When the plunger 115 is moved in the direction I in FIG. 11, a vacuum is produced to draw the ink from the recording head 200. When it is moved in a direction J, the drawn-out ink is discharged to the discharge ink absorbing material through the discharge ink pipe 113*d*.

To the plunger 115, a pump seal 117 is mounted. The pump seal 117 is made of rubber material such as silicone rubber or LBR rubber or the like.

The inside diameter thereof is slightly smaller than the outer diameter of the plunger 115 so that a predetermined pressure can be provided therebetween. It is reciprocable in the cylinder 113 by being pushed by a pump seal confining member 115*d* and the piston receptor 115*b* of the plunger 115. The sliding force between the cylinder 113 and the plunger 115 may be reduced by application of lubricant painted on the surface. In order to prevent use of grease in the cylinder, a self lubricating rubber may be used.

In FIG. 11, reference numeral 118 designates a cap lever. An ink guide (not shown) is urged to a cap lever seal 119, and the other rotational shaft 118*a* is mounted by snap fitting into a hole 113*f* of the cylinder 113. The cap lever 118 is rotatable. To the cap lever seal 119, the ink guide of the cap lever 118 is press-fitted, and is further press-fitting into a cap lever receptor 113*b* of the cylinder 113.

Figure 15:
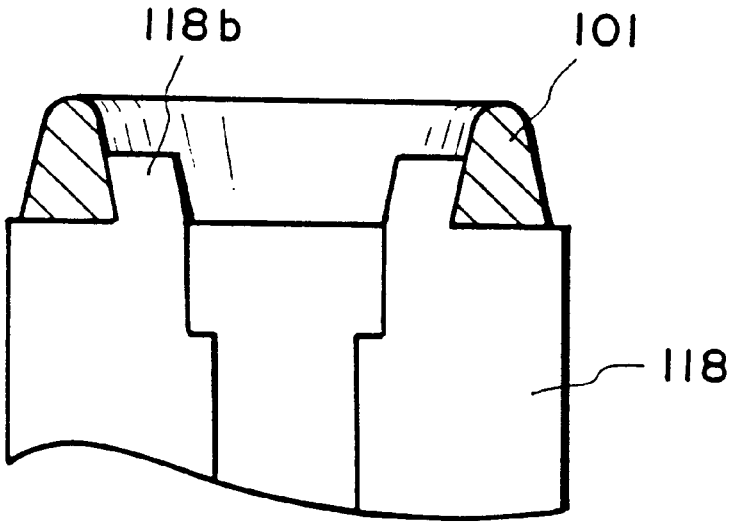
FIG. 15 is an enlarged sectional view of a cap in the first embodiment apparatus.

A cap 101 is in the form of a ring having a generally triangular cross-section and is an elastic member made of chlorinated butyl rubber. It is mounted to the cap mounting portion 118*b* of the cap lever 118. The mounting method is, as shown in FIG. 15, such that the elasticity of the rubber is advantageously used. The cap 101 is expanded and mounted to the cap lever mounting portion 118*b* having an inclined surface corresponding to the generally triangular cross-section. Once the cap 101 is mounted, it is not disengaged in the normal operation.

A preliminary ejection pad 120 is made of high polymer absorbing material as in the blade cleaner 108. It is mounted on the above-described cap lever 118. The preliminary ejection pad is effective to absorb the ink discharged by the preliminary ejection which is the ink ejection effected during the recording operation to prevent the ink from drying at the ejection side surface, in addition to the normal recording operation.

A pump absorbing material 121 is effective to assuredly transfer the discharged ink in the cylinder to the discharged ink absorbing material, and is made of high polymer absorbing material.

Figure 16:
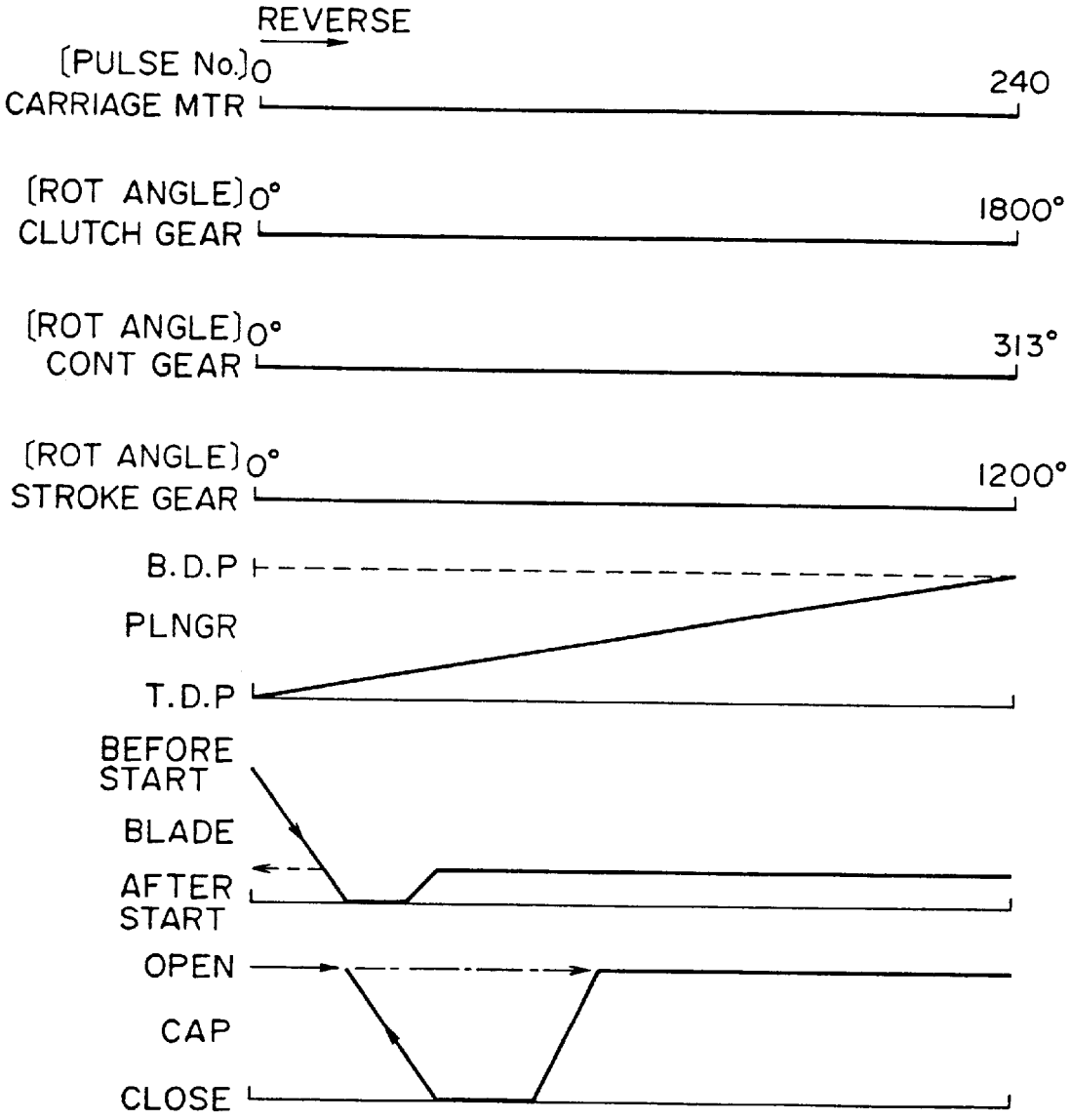
FIG. 16 is a timing chart of the operation of the recovery means in the first embodiment apparatus.

FIG. 16 is a timing chart of the operation of the recovery means by the driving force of the carriage motor 225. As shown in this Figure, the point of time, at which the control gear 102 starts to rotate after the trigger tooth 259*a* of the clutch gear 259 is engaged with the control gear after the carriage 203 enters the recovery means range, is used as 0 pulse point of the carriage motor 255.

In this embodiment, all the recovery operations are carried out through 240 steps (five turns) in the forward and backward directions of the carriage motor 255. Simultaneously with the rotation of the carriage motor 255, the clutch gear 259, the control gear 102 and the stroke gear 103 start to rotate. Reciprocal motion of the plunger 115 is limited by the stroke gear 103, the plunger 115 rotates simultaneously with the rotation of the carriage motor 255, so that the reciprocal motion corresponds one-to-one to the rotation of the carriage motor 255.

As described hereinbefore, the movement path of the blade 104 is different depending on the rotational direction of the carriage motor 255.

In order that the preliminary ejection ink-drawing is possible by the use of the switching sheet 102*d*, as described hereinbefore, if the recovery operation is started by the reverse rotation of the carriage motor 255, the plunger 115 is moved while the cap 101 is open.

Figure 17:
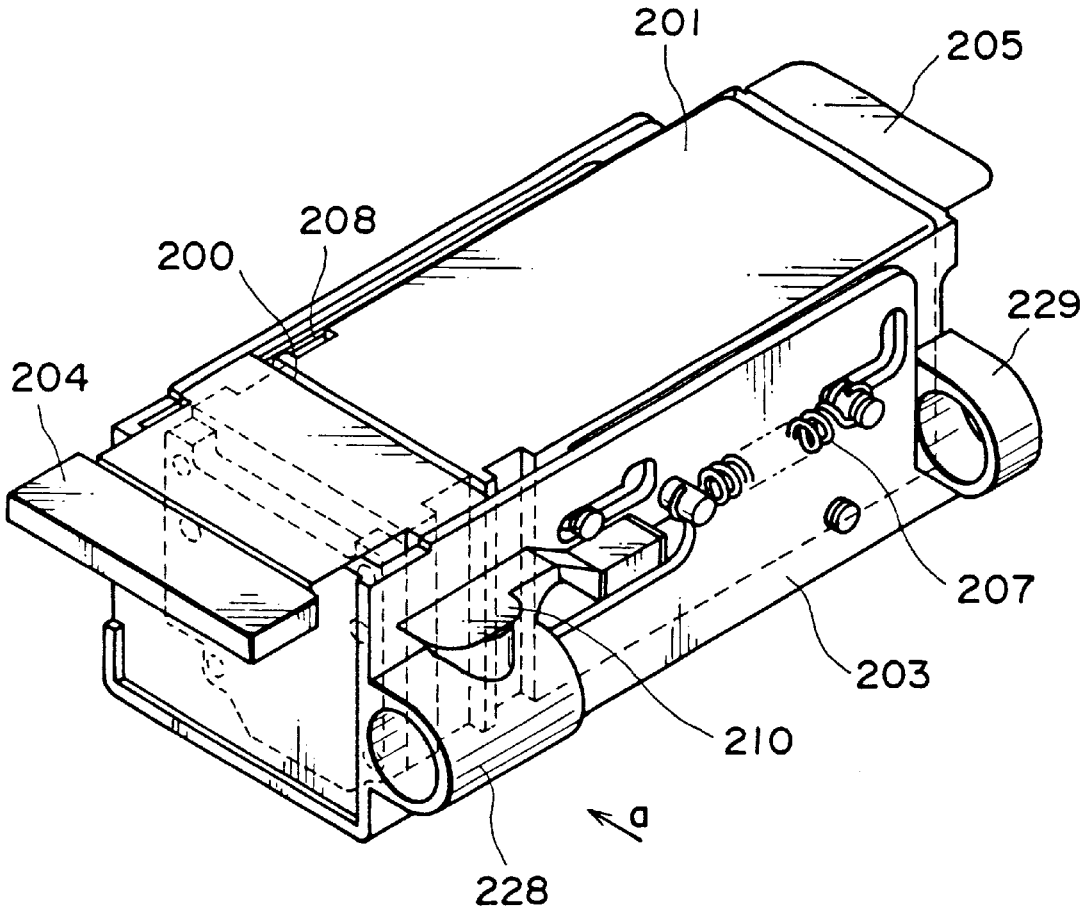
FIG. 17 is a perspective view of a carriage in the first embodiment apparatus.

FIG. 17 is a perspective view of the head cartridge and the carriage of the recording apparatus according to this embodiment of the present invention. In this Figure, reference numeral 200 designates a recording head for ejecting the ink in accordance with electric signals; 201, an ink container for containing the ink to be supplied to the recording head; 203, a carriage in the main assembly of the apparatus effective to carry the recording head 200 and the ink container 201; 204, a head lever for supporting and releasing the recording head; 205, an ink container lever for detachably mounting the ink container 201; 207, a head holder spring for fixing the recording head 200 to the carriage 203; and 208, a container case for supporting the ink container 201. By these elements, the head cartridge and the carriage are constituted.

Figure 18:
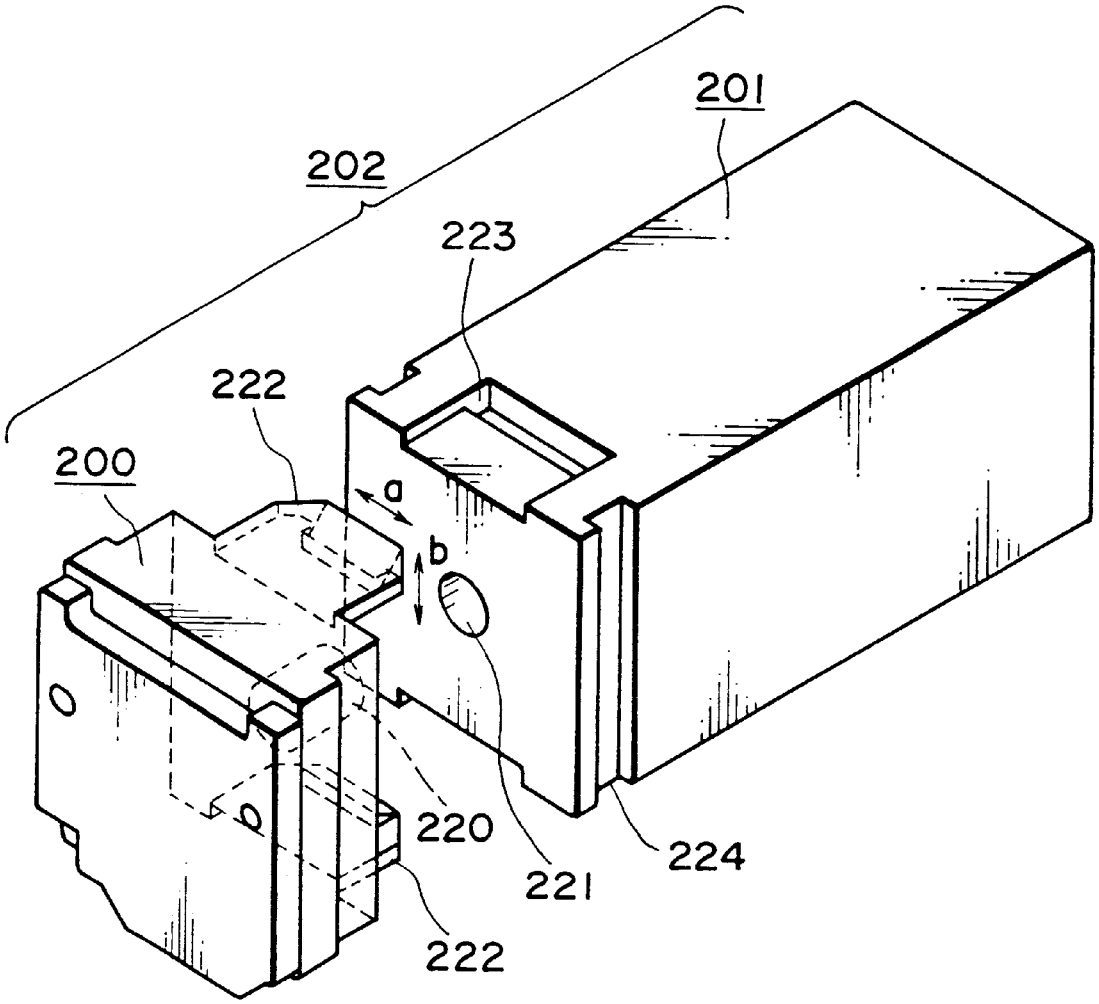
FIG. 18 is a perspective view of a head cartridge in the first embodiment apparatus.

FIG. 18 is a perspective view of the recording head and the ink container 201 of the recording apparatus according to this embodiment. In this Figure, reference numeral 220 designates an ink supply port functioning as a passage for supplying the ink from the ink container 201 to the recording head; 221, an ink supply port for supplying the ink from said ink container 201 to said recording head 200; 222, a connecting pawl for guiding and supporting the recording head 200 and the ink container 201 which are integral with each other. Reference numeral 223 designates a connecting pawl guiding groove engageable with the connecting pawl 222. Reference numeral 224 designates an ink container guiding groove for supporting the ink container 201 when the ink container 201 and the recording head 200 are mounted or dismounted. The head cartridge 202 is constituted by these elements.

The recording head 200 includes a base plate having a plurality of electrothermal transducer elements for producing thermal energy used for ink ejection and a driving circuit for driving them, a top plate for forming ejection outlets and liquid passages corresponding to the respective electrothermal transducer elements and for forming a common liquid chamber communicating with the liquid passages, and electric contacts for supplying electric signals from the main assembly to the driving circuit. The recording head 200 may be provided with sensors for permitting the main assembly of the recording apparatus to detect the states of the recording head. More particularly, the sensors include a temperature sensor for detecting the temperature of the recording head in the neighborhood of the electrothermal transducer elements, an ink sensor for detecting a remaining amount of the ink in common liquid chamber, and a head identification sensor for identification of types of the head cartridge when different types of heads are usable interchangeably. The signals from the sensors are discriminated by the main assembly of the recording apparatus, and the signals applied to the electrothermal transducer elements are controlled, accordingly, thus providing the optimum printing conditions.

The ejection side surface having the ejection outlets of the recording head is faced to the recording material in the recording apparatus.

An ink container 201 functions to contain the ink to be supplied to the recording head 200 in accordance with consumption with the ink for the recording operation. When it is alone, an ink supply port 221 thereof is sealed by an unshown sealing means to prevent leakage of the ink. The sealing means is automatically or manually removed when the ink container 201 is mounted to the recording means. By doing so, the ink passage is connected. The sealing means may be in the form of a metal ball pressed against an opening of rubber.

The ink container may be provided with a mechanism for introducing external air in accordance with reduction of the ink volume resulting from consumption of the ink. In addition, a structure for maintaining slight vacuum in the ink may be provided in the ink container, thus improving the print quality and preventing the ink leakage.

In this embodiment, the ink container 201 contains a flexible bladder in which the ink is accommodated. The bladder is in communication with the ink supply port 221. The remaining space in the ink container 201 is filled with air. The air pressure is adjusted by an unshown pressure control valve in the recording operation. Further particularly, a vacuum in a predetermined range is produced and maintained.

The recording head 200 and the ink container 201 are used while they are integral during the recording operation. The description will be made as to the arrangement making them integral.

Figure 21:
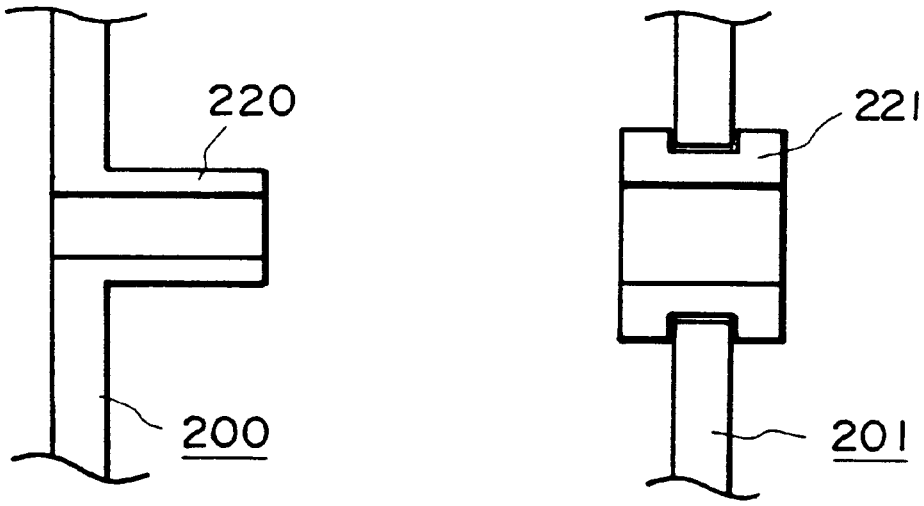
FIG. 21 is a sectional view illustrating a head cartridge joint portion in the first embodiment apparatus.

Fundamentally, the recording head 200 and the ink container 201 are made integral by communicating the ink receiving port 220 and the ink supply port 221. Therefore, the connecting portion is of such a structure to prevent the ink leakage or the introduction of air into the ink passage. In this embodiment, as shown in FIG. 21, a rigid pipe and elastic plug are used. The ink receiving port 220 is a molded cylinder, and the ink supply port 221 corresponding thereto is a hollow cylinder molded from rubber. The outside diameter of the ink receiving port 220 is slightly larger than the inside diameter of the ink supply port 221. When the ink receiving port 220 is pressed into the ink supply port 221, the ink supply port 221 slightly deforms in the radial direction, and is closely contacted with the ink receiving port 220, so that the unification is established.

The connecting system is not limited to the combination of the rigid material and the elastic material. It will suffice if the suitable sealing performance is provided. For example, a combination of a molded pipe and a molded member having a hole is usable in which the sealing is provided using elasticity due to slight deformation of the mold. As another example, the connection may be established using a rubber sealing member without hole and an injection needle.

The unification of the recording head 200 and the ink container 201 may be established only by the connection between the ink receiving port 220 and the ink supply port 221. However, in order to prevent them from disconnecting from each other upon unexpected impact applied thereto during handling of the head cartridge 202, or the like, and/or in order to allow easy unification, there are provided a locking pawl 222 and a locking pawl guiding groove 223. The locking pawl 222 is integrally molded with the ink receiving port 220 and is capable of elastic deformation. It has a projection at its end. It is engaged with the guiding groove 223 while being elastically deformed by the height of the projection. The locking engagement is established at the time when the projection of the locking pawl 222 reaches the portion of the guiding groove 223 which is deeper. The locking pawl 222 also has a function as a guide so that the ink receiving port 220 and the ink supply port 221 are easily aligned upon connection between the recording head 200 and the ink container 201. More particularly, the locking pawl 222 is longer than the ink supply port 220. Before the ink receiving port 220 is contacted to the ink supply port 221, the locking pawl 222 is contacted to the ink container 201. The leading edge of the locking pawl 222 is cut with inclination. The inclined portion functions as a guide in the direction a in FIG. 18 to permit easy engagement. The projection at the end of the locking pawl 222 is cut also with inclination to function as a guide in the direction b in FIG. 18 to facilitate the engagement action.

In this embodiment, the locking pawl is provided on the recording head, but this arrangement is not limiting. It may be provided on the ink container 201 or on both of the recording head 200 and the ink container 201.

A description will be made as to the mechanical and electrical connection between the recording head 200 and a carriage 203.

Figure 19:
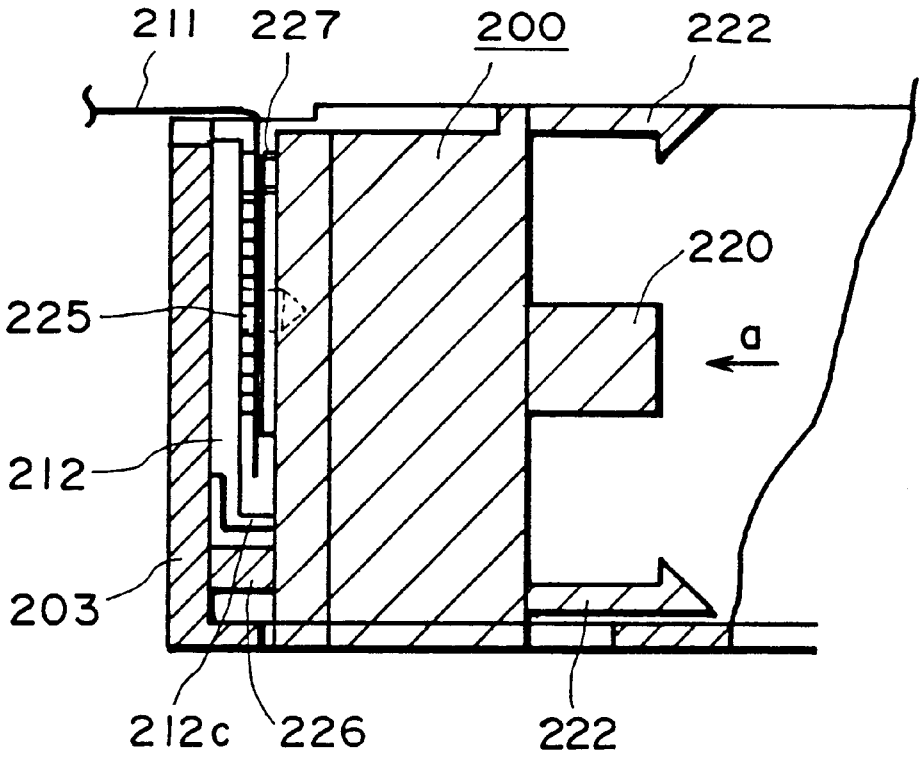
FIG. 19 is an enlarged partial sectional view of the carriage in the first embodiment apparatus.
Figure 20:
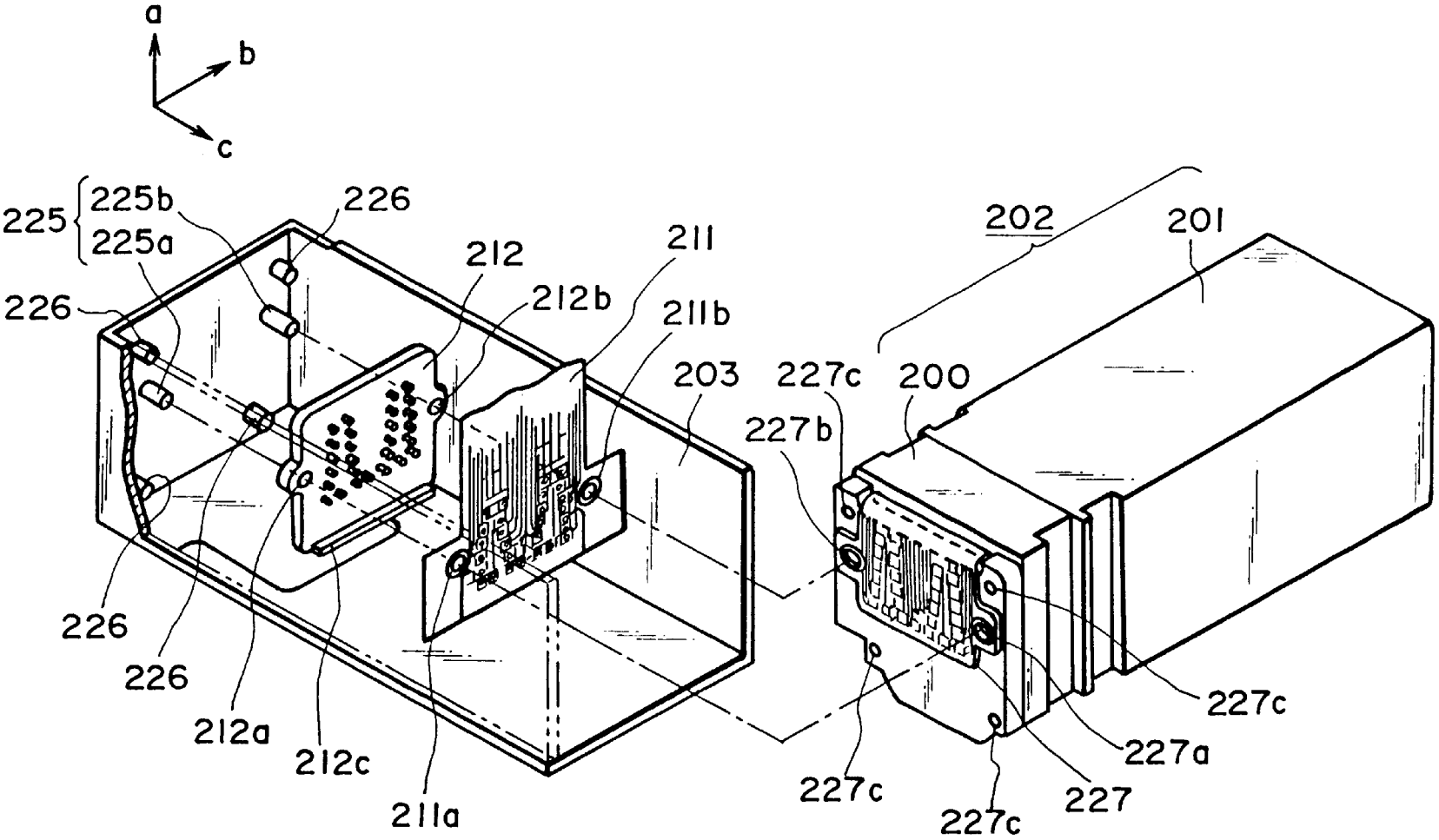
FIG. 20 is a perspective view illustrating connection between the carriage and the head cartridge in the first embodiment apparatus.

FIG. 19 is a sectional view taken along a line a in FIG. 17 illustrating connection between the carriage 203 and the recording head 200. FIG. 20 is a perspective view illustrating the process. In the Figures, reference numeral 225 designates positioning pins engageable with corresponding holes of a recording head on the carriage 203 to accurately position the recording head 200 in a direction a and a direction b in FIG. 20; 226 designates a stopper fixed on the carriage 203 to stop the recording head 200 urged in a direction a in FIG. 19; 211 is a flexible cable for electrically connecting the recording head 200 and the main assembly of the recording apparatus; 211*a*, a positioning hole in a flexible cable 211; 211*b*, a positioning hole in the flexible cable 211; and 212, a flexible cable pad elastically supporting the flexible cable 211 and sandwiched between the flexible cable 211 and the carriage 203. In addition, reference numeral 212*a* designates a positioning hole in the flexible cable pad 212; 212*b*, a positioning hole in the flexible cable pad 212; 212*c*, an ink barrier for preventing ink entrance to the contact position; 222, a head contact portion electrically connected with the heater in the recording head of the recording head 200; 227*a*, a positioning hole in the head contact 227; 227*b*, a positioning hole in the head contact portion 227; and 227*b*, a stopper abutment for abutment with the end surface of the stopper 226.

The recording head 220 is urged in a direction a through an unshown lever from the head holder spring 207. The position thereof is definitely determined by the engagement between the hole of the recording head 200 and the positioning pin 225 and by the interference with the stopper 226. In this manner, the recording head 200 and the carriage 203 are mechanically connected. On the end surfaces of the head contact portion 227 of the recording head 200 and the flexible cable 211, there are provided corresponding plural electric contacts. They are pressed to each other with a predetermined pressure, so that the main assembly of the recording apparatus and the recording head 200 are electrically connected. It is necessary that the respective contacts are pressed at once. For the purpose of uniform pressing, there is provided a flexible cable pad 212 of elastic material. The material of the flexible cable pad 212 is of silicone rubber. It comprises plural projections at positions corresponding to the electric contacts to concentrate the pressure on the contact points. The electric contacts of the flexible cable 211 may be in the form of projections in order to further assure the pressure concentrated on the contact points.

Since the reaction force produced upon pressing is designed to be far smaller than the force of the head holder spring 207 for urging the recording head 200, the recording head 200 is prevented from deviation by the reaction force from the flexible cable pad 212.

The carriage 203, the flexible cable pad 212, the flexible cable 211, the head contact portion 227 and the head cartridge 203 are required to be correctly positioned relative to each other in order to assure the electric connection and the high print quality. In order to accomplish this, the following structure is used. One of the positioning pins 225*a* commonly engages with the positioning hole 212*a*, the positioning hole 211*a* with positioning hole 227*a*, the other positioning pin 225*b* commonly engages with the positioning hole 212*b*, and the positioning hole 211*b* with the positioning hole 227*b*, by which positioning in the directions a and b in FIG. 20 is accomplished. In addition, by urging in the direction a in FIG. 19 until the end surface of the stopper 226 abuts the stopper abutment portion 227*c* of the head contact 227, the position, in the direction c of the recording head 200 can be correctly determined.

Figure 47:
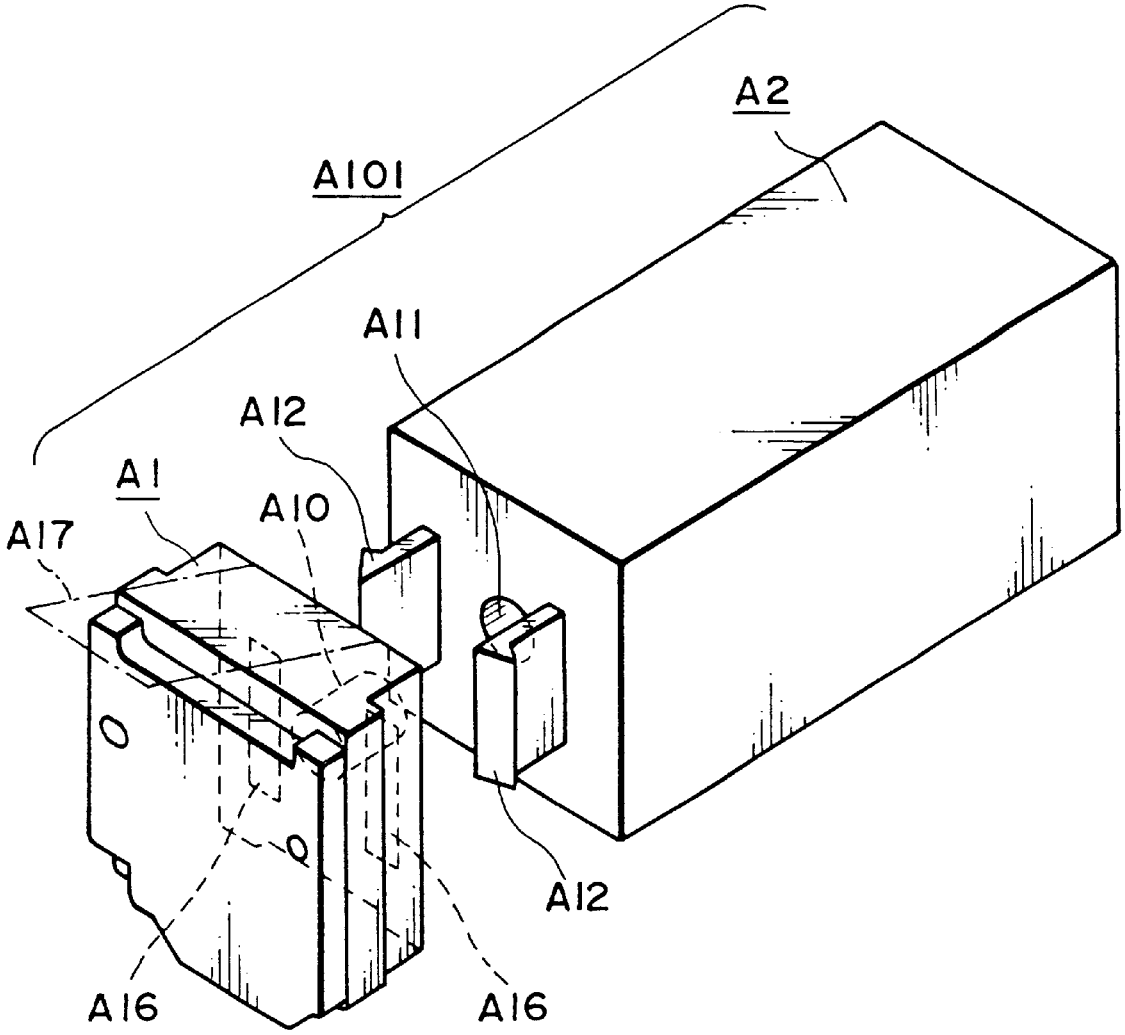
FIG. 47 is a perspective view of a recording head and an ink container, according to a further embodiment of the present invention.

FIG. 47 is a perspective view of a recording head and an ink container according to a further embodiment of the present invention. In this Figure, reference A1 designates a recording head; A2, an ink container. The locking pawl A12 is provided in the ink container A2 side, and there is provided a locking pawl guiding groove A16 in the recording head A1 at a position corresponding to the locking pawl A12. A head tab A17 is provided to facilitate handling when the recording head A1 is removed from the carriage. The ink container A2 is not provided with the ink container guiding groove.

Figure 48:
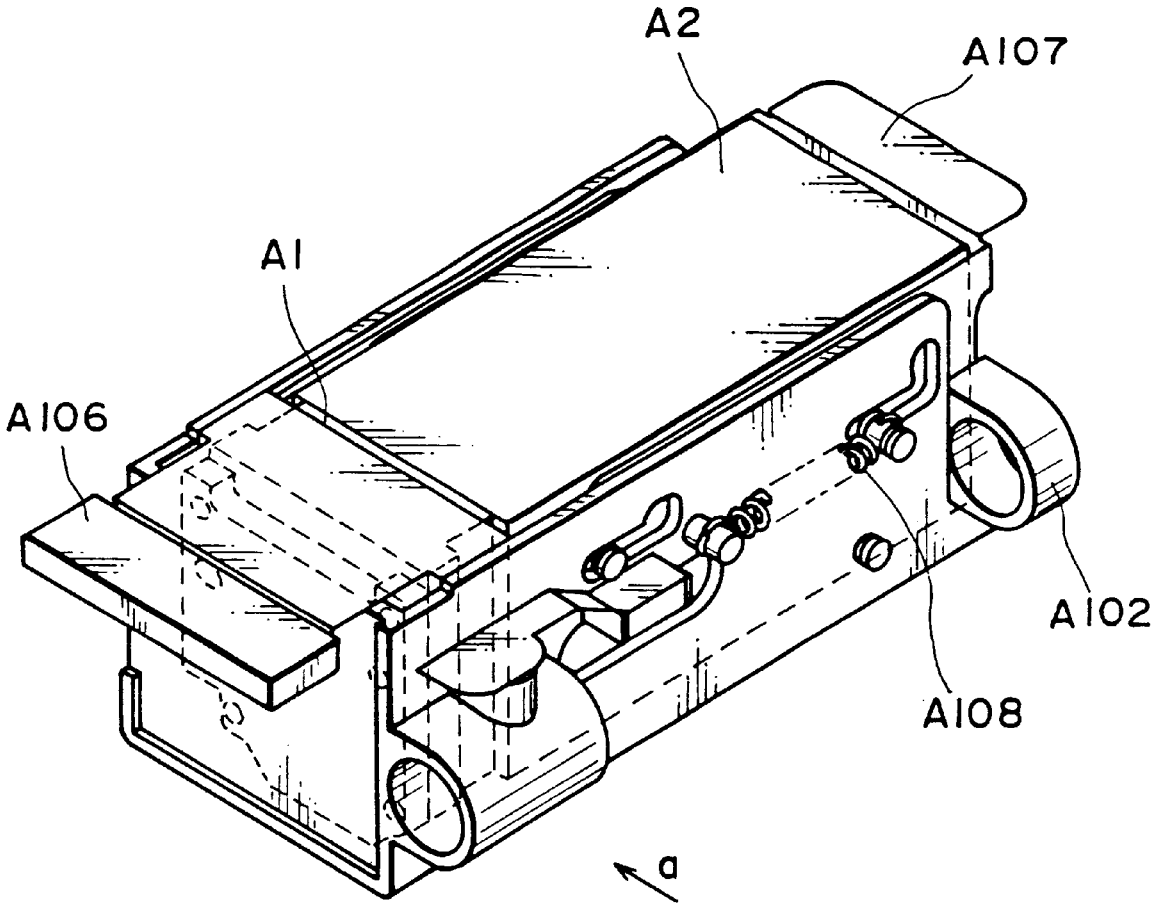
FIG. 48 is a perspective view of a head cartridge and a carriage of a recording apparatus using the recording head and the ink container of FIG. 47.
Figure 49:
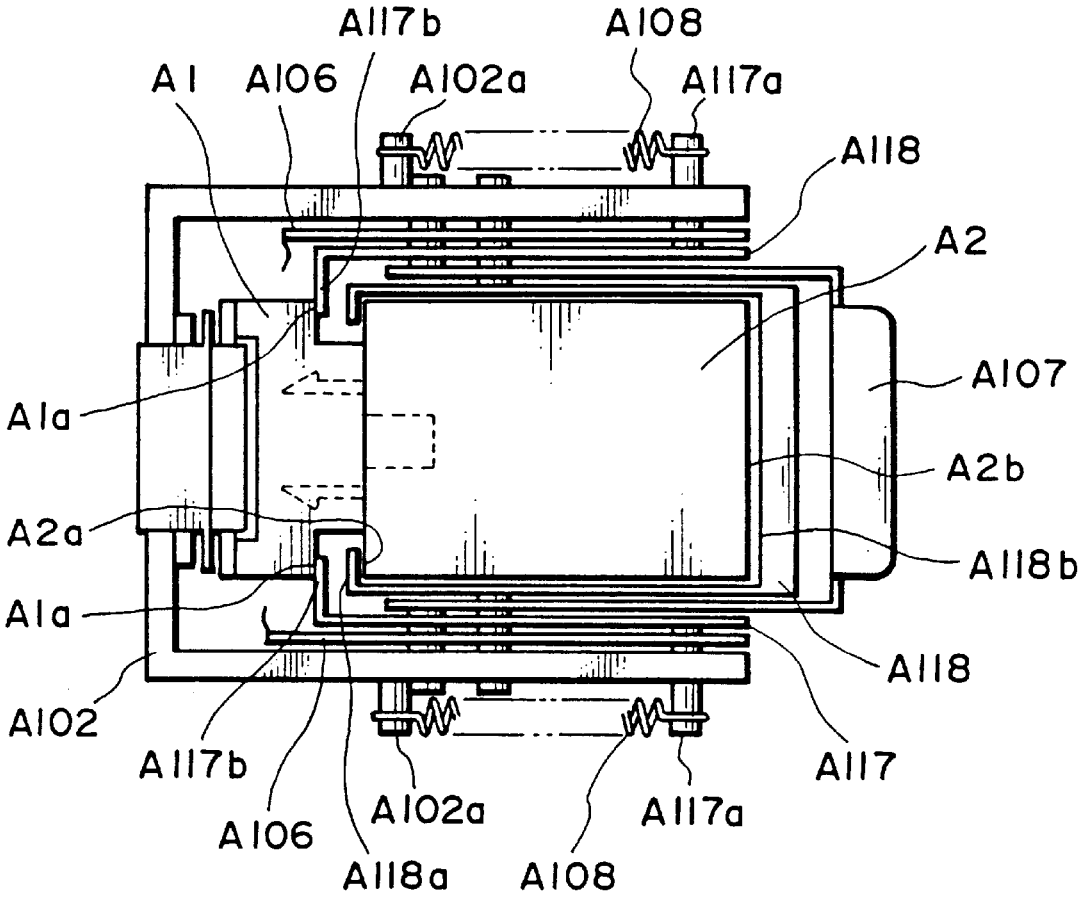
FIG. 49 is a top plan view of a head cartridge and a carriage of the recording apparatus according to an embodiment of the present invention using the recording head and the ink container of FIG. 47.

FIGS. 48 and 49 are perspective views of the recording head cartridge and the carriage in this embodiment. As shown in the Figures, there is provided a carriage A102 for supporting and scanningly moving the recording head A1 and the ink container A2. The recording head A1 is locked or released by a head lever A106. The ink container A2 is mounted or dismounted by an ink container lever A107. Designated by a reference A117 is a head holder for urging the recording head A1. Between a shaft A117*a* and the shaft A102*a* of the carriage, a head urging spring A108 is stretched. The urging force of the head urging spring A108 is transmitted to a pressure receiving portion A1*a* of the recording head through a pressing portion A117*b* of the head holder A117. An ink container holder A118 acts on the ink container by operation of the ink container lever A107 to move the ink container, and is provided with a front acting portion A118*a* actable on an end of the ink container close to the recording head and a rear acting portion A118*b* actable on the side of the ink container remote from the recording head.

Figure 50:
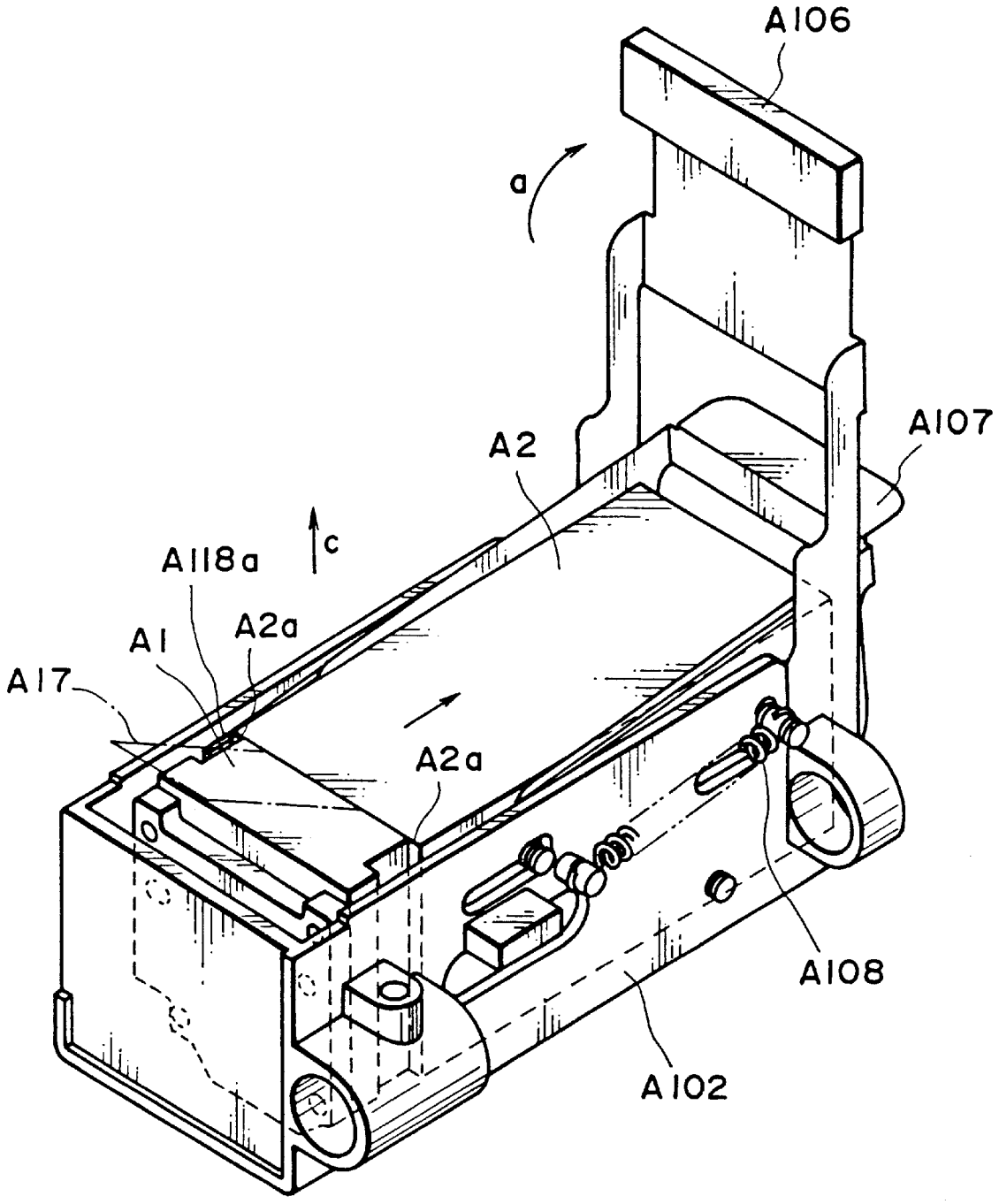
FIG. 50 is a perspective view in which the recording head and the ink container of FIG. 47 are taken out of the carriage as a unit.

FIG. 50 is a perspective view in which the recording head and the ink container shown in FIG. 47 are taken out as a unit from the carriage A102. In this case, the head lever A105 is rotated to the upright position in the direction a in FIG. 49, so that a cam of the head lever A106 moves the head holder 117 in a direction b of FIG. 49, by which the pressure, to the recording head A1, of the head pressing spring A108 which has been pressed to the recording head through the head holder A117, is released. The head lever A106 is effective to move the ink container holder A118 in a direction b of FIG. 49. At this time, the front acting portion A118*a* of the ink container holder A118 is engaged to the recording head side end A2*a* of the ink container A2 and is moved. Therefore, the recording head A1 and the ink container A2 are moved in the direction b of FIG. 49 as a unit. With this state, the recording head A1 and the ink container A2 are movable in a direction c in FIG. 49. By gripping and raising the head tab A17 of the recording head A1, they can be taken out of the carriage to establish the off-carriage state. By the reversing operation, the recording head A1 and the ink container A2 can be connected and retained on the carriage A102.

Figure 51:
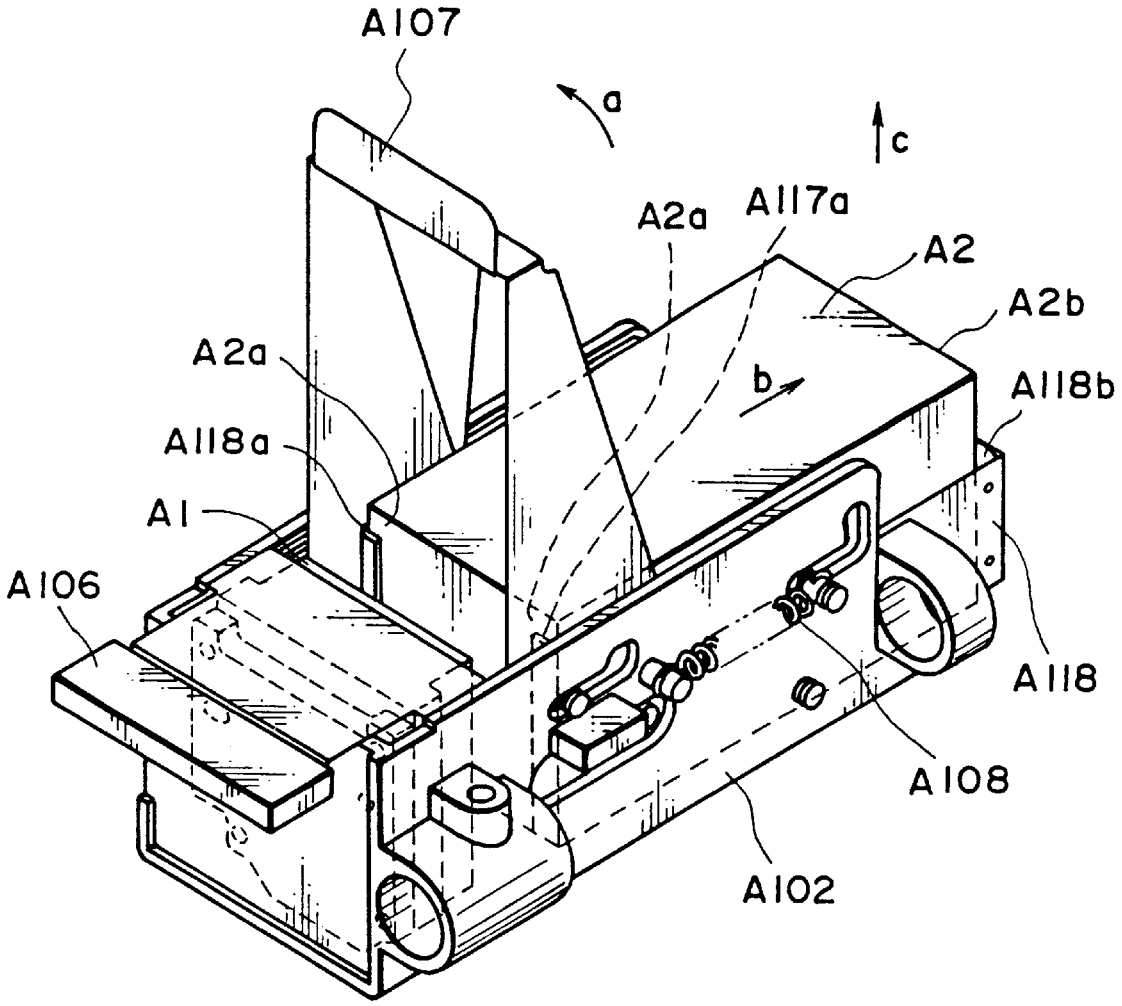
FIG. 51 is a perspective view in which the recording head and the ink container of FIG. 47 are separated from each other on the carriage.

FIG. 51 is a perspective view, when the recording head and the ink container are separated from each other on the carriage A102. At this time, the container lever A107 is rotated in the direction a in FIG. 50 to the upright position shown, so that a cam of the container lever A107 moves the ink container holder A118 in a direction b in FIG. 50. In this case, the head holder A117 does not move, so that the head pressing spring A108 presses the recording head Al. Since the front acting portion A118*a* of the ink container holder A118 is engaged with a recording head side end A2*a* of the ink container A2, and moves, the ink container A2 is released from engagement with the recording head A1 and moves in a direction b in FIG. 50. With this state, the ink container A2 can be moved in a direction c in FIG. 50. By raising the ink container, it can be taken out of the carriage to establish the off-carriage state. By the reverse operation, that is, by mounting the ink container A2 in the ink container holder A118 and rotating the container lever A107 in a direction opposite from the direction a of FIG. 50, the cam of the container lever A107 moves the ink container holder A118 in the direction opposite from the direction b in FIG. 50. At this time, the rear acting portion A118*b* of the ink container holder A118 is engaged with an end A2*b* of the ink container remote from the recording head, and moves, so that the ink container A2 moves in the direction opposite from the direction b in FIG. 50, so that it is engaged with the recording head A1. In the manner described above, the ink container A2 can be connected and supported.

In addition, if the ink enters, for one reason or another, between the flexible cable 212 and the head contact portion 227 (electric contact surfaces), the electric short circuit may occur. Therefore, it is desired to prevent this. In this embodiment, a part of a flexible cable pads 212 is projected so as to function as an ink barrier 212*c*, and it is urged to the end surface of the recording head 200, thus preventing the ink from the recording head 200 from entering it.

In this embodiment, the electric and mechanical connections are provided in the recording head, but this structure is not limiting. They may be provided in ink container 201 or recording head 200 and the ink container 201. The electric connection and the mechanical connection may be provided on one part and on the other part, respectively.

A description will be made as to a method of exchanging the recording head 200 and the ink container 201, for example, when the ink container 201 is exchanged with a fresh ink container after it is used up, or when the recording head 200 is exchanged upon necessity arising when it becomes inoperable for one reason or another.

In one mode, the locking between the recording head 200 and the carriage 203 is released, and the recording head 200 and the ink container 201 are taken out integrally or as a unit from the carriage 203. After they are taken out as a unit from the carriage 203 (off-carriage state), the recording head 200 and the ink container 203 are separated or unified relative to each other.

Figure 22:
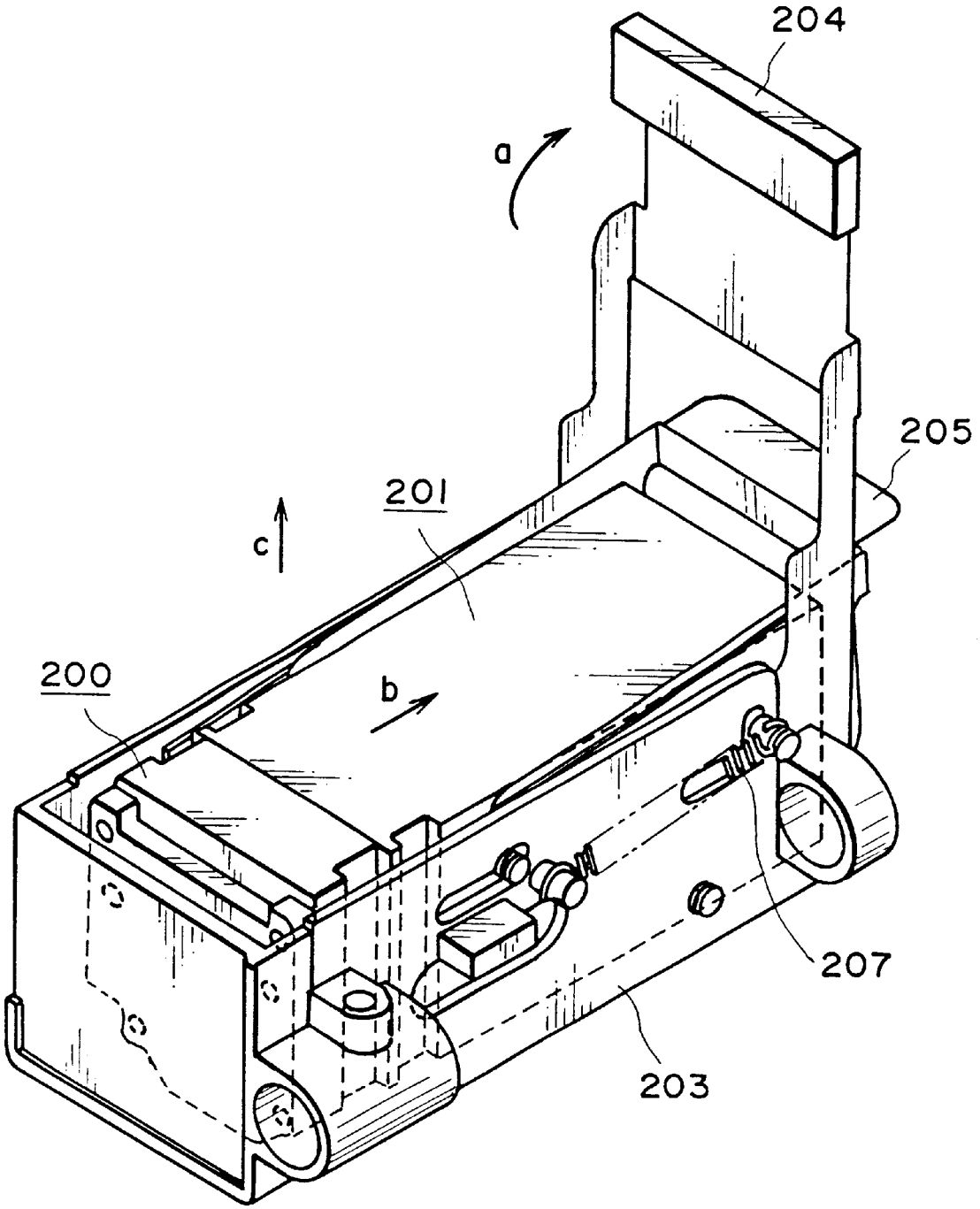
FIG. 22 is a perspective view illustrating an exchanging method in a first type in the first embodiment apparatus.

FIG. 22 is a perspective view of the manipulation in this mode, that is, the recording head 200 and the ink container 201 are taken out as a unit. In this case, the head lever 204 is rotated in the direction a in FIG. 22 from the state of FIG. 18 to an upright position, so that a cam of the head lever 204 moves the shaft on the lever having pushed the recording head 200, by which the pressure to the recording head by the head holder spring 207 is released.

At this time, the container case 208 in the carriage 203 moves while the projection thereof is in engagement with the ink container guiding groove 224, and therefore, the recording head 200 and the ink container 201 move as a unit in a direction b in FIG. 22. Then, the engagement between the positioning pin 225 and the whole of the recording head 200 is released, so that the recording head 200 and the ink container 201 as a unit can be moved in a direction c in FIG. 22. Therefore, they can be released from the carriage (off-carriage). In the off-carriage state, by application of force in the direction opposite from the connecting direction between the recording head 200 and the ink container 201, they can be separated from each other. Then, the element which is to be replaced is set in the manner described hereinbefore. Then, the unit is set on the carriage 203 in the reverse process, thus completing the exchanging operation.

In this embodiment, the urging force of the recording head 200 is released by the head lever 204. This is not limiting, but it is possible to directly move a lever for urging the recording head 200. In this embodiment, a head holder spring 207 is used to fix the recording head, but this is not limiting, and it is a possible alternative that it is fixed by a spring latch hook or the like.

The first mode is advantageous in that when only one of the recording head and the ink container must be exchanged, only one of them is exchangeable, and therefore, the first mode is economical.

In the second mode, the ink container 201 is separated from the recording head 200 on the carriage while the recording head 200 is fixed on the carriage (on-carriage state). In this manner, only the ink container 201 is taken out.

Figure 23:
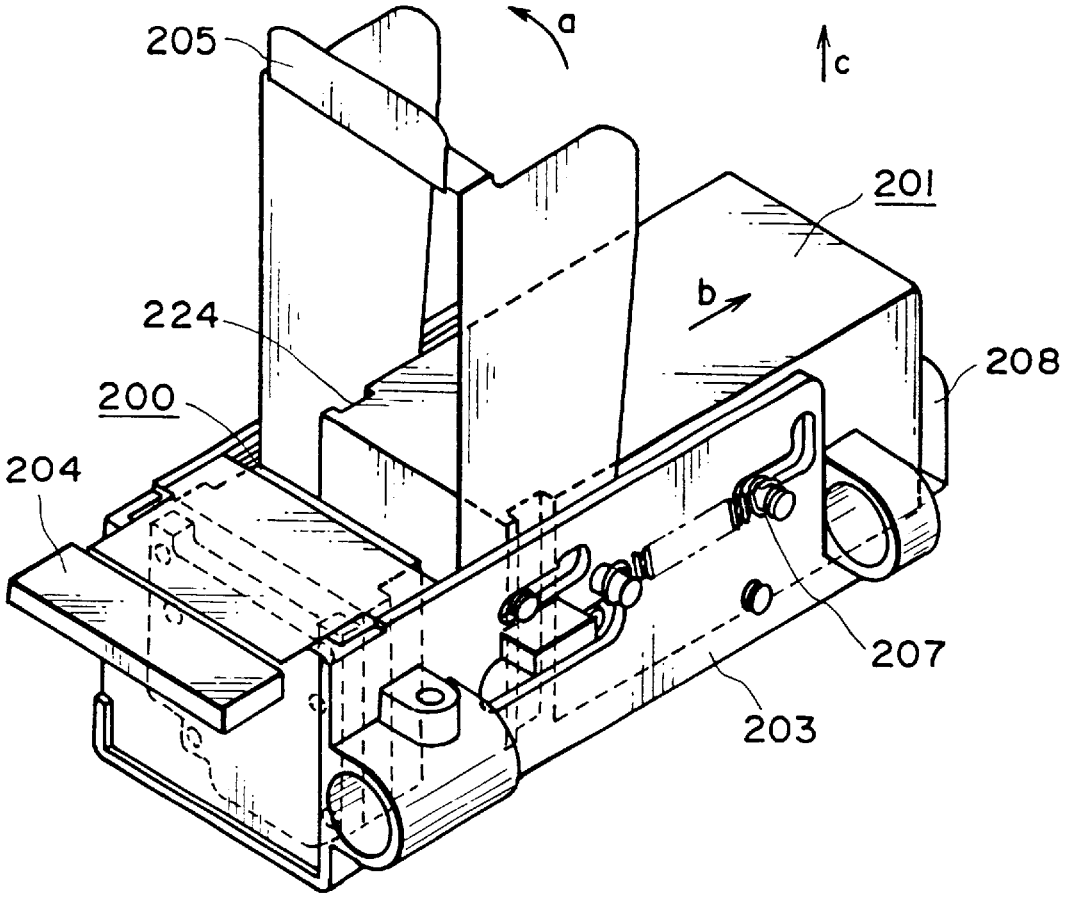
FIG. 23 is a perspective view illustrating an exchanging system in a second type in the first embodiment apparatus.

FIG. 23 is a perspective view in which the ink container 201 is separated from the recording head 200 on the carriage 203. In this case, the container lever 205 is rotated in a direction a in FIG. 23 from the state of FIG. 17 to the position shown in this Figure. An unshown cam of the tank lever 205 moves the container case 208 in a direction b in FIG. 23. A projection of a container case 208 is engaged with the ink container guiding groove 224 in a side surface of the ink container 201, thus moving the ink container 201 in the direction b of FIG. 23. The fixing of the recording head 200 is the same as shown in FIG. 17, and therefore, it does not move together with the ink container 201. Then, the engagement between the recording head 200 and the ink container 201 is released, thus permitting separation therebetween. Further, the ink container 201 is moved in a direction c in FIG. 23, thus permitting it to be separated from the carriage 203.

Figure 24:
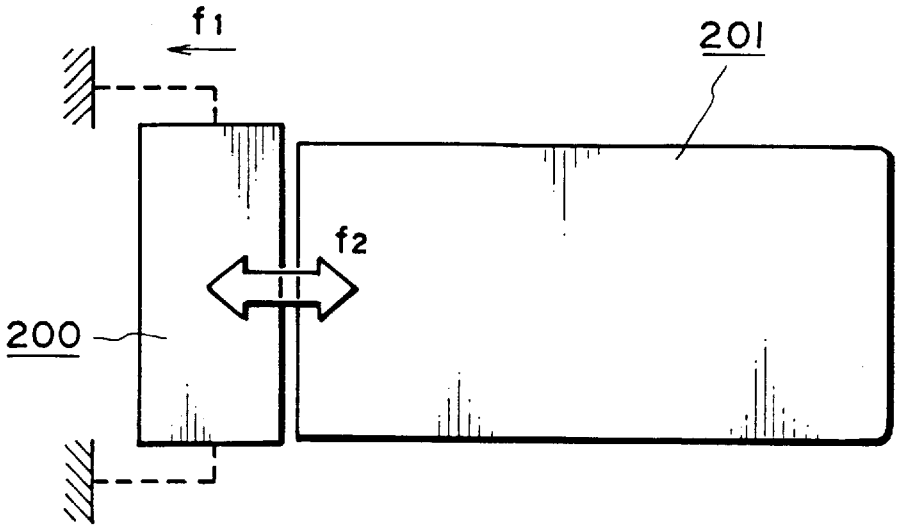
FIG. 24 is a top plan view illustrating the force applied in the first embodiment apparatus.

When the recording head 200 is elastically urged by the head holder spring 207 in this embodiment, there is a possibility that the head may be disengaged from the carriage depending on deviation of the force upon the separating action. In order to avoid this, the following structure is preferred. FIG. 24 is a top plan view illustrating application of force. In this Figure, the recording head 200 is urged to the carriage 203 with force f1 by the head holder spring 207. It is assumed that the separation between the recording head 200 and the ink container 201 requires force f2 for disengagement between the locking pawl 222 and the locking pawl guiding groove 223 and also for disengagement between the ink receiving hole 220 and the ink supply hole 221. By selecting the forces to satisfy f1>f2, the unintentional disengagement of the recording head 200 can be prevented during the separation manipulation.

In this embodiment, the force f2 is provided by the container lever 205. This is not limiting, and it is a possible alternative to separate the recording head 200 and the ink container 201 from each other by directly gripping the ink container 201 and pulling it in the direction b of FIG. 23.

The second mode has, in addition to the advantages of the first mode, the following advantages. By properly designing the configuration of the cam of the container lever 205, the pulling speed upon the separation can be controlled, so that the ink scattering from the ink receiving port 220 and the ink supply port 221, can be prevented. Since it is not necessary to hold the recording head 200 directly by the operator's fingers, the possibility is eliminated that the ink ejection side surface of the recording head 200 is touched by the operator's finger, and therefore, the influence thereby to the printing quality can be prevented. Because the portion of the ink container 201 which receives the force is limited, therefore, only the portion is required to have sufficient mechanical strength, and the thickness of the other portions can be reduced. This permits use of a lighter container and a larger capacity container.

Figure 25:
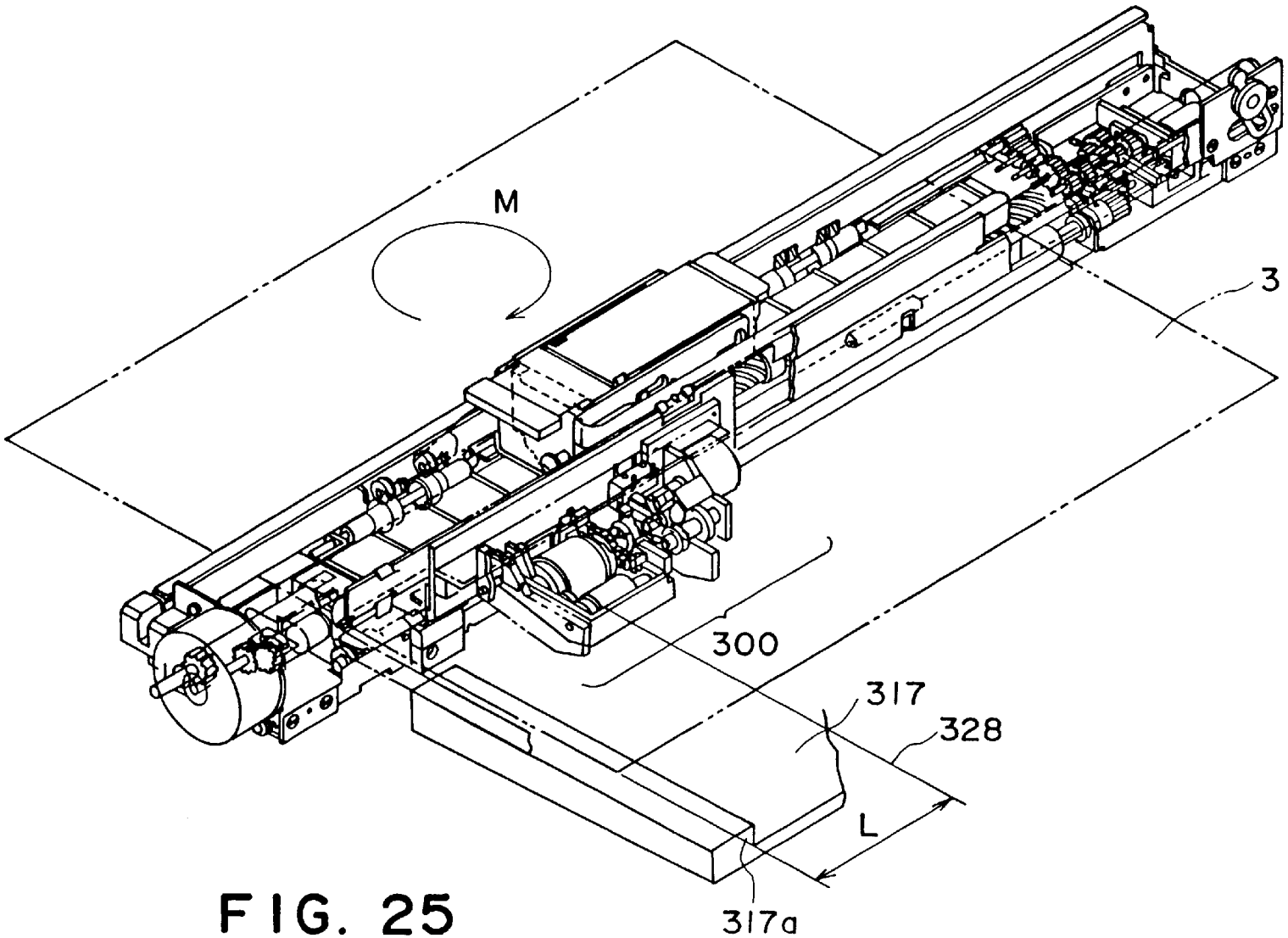
FIG. 25 is a perspective view illustrating automatic sheet feeding portion in the first embodiment apparatus.

FIG. 25 shows positional relation between the ink jet recording apparatus and an automatic sheet feeder.

Designated by a reference numeral 300 is an automatic sheet feeder, and is fixed with the positional relation relative to the ink jet recording apparatus as shown in FIG. 25.

Figure 26:
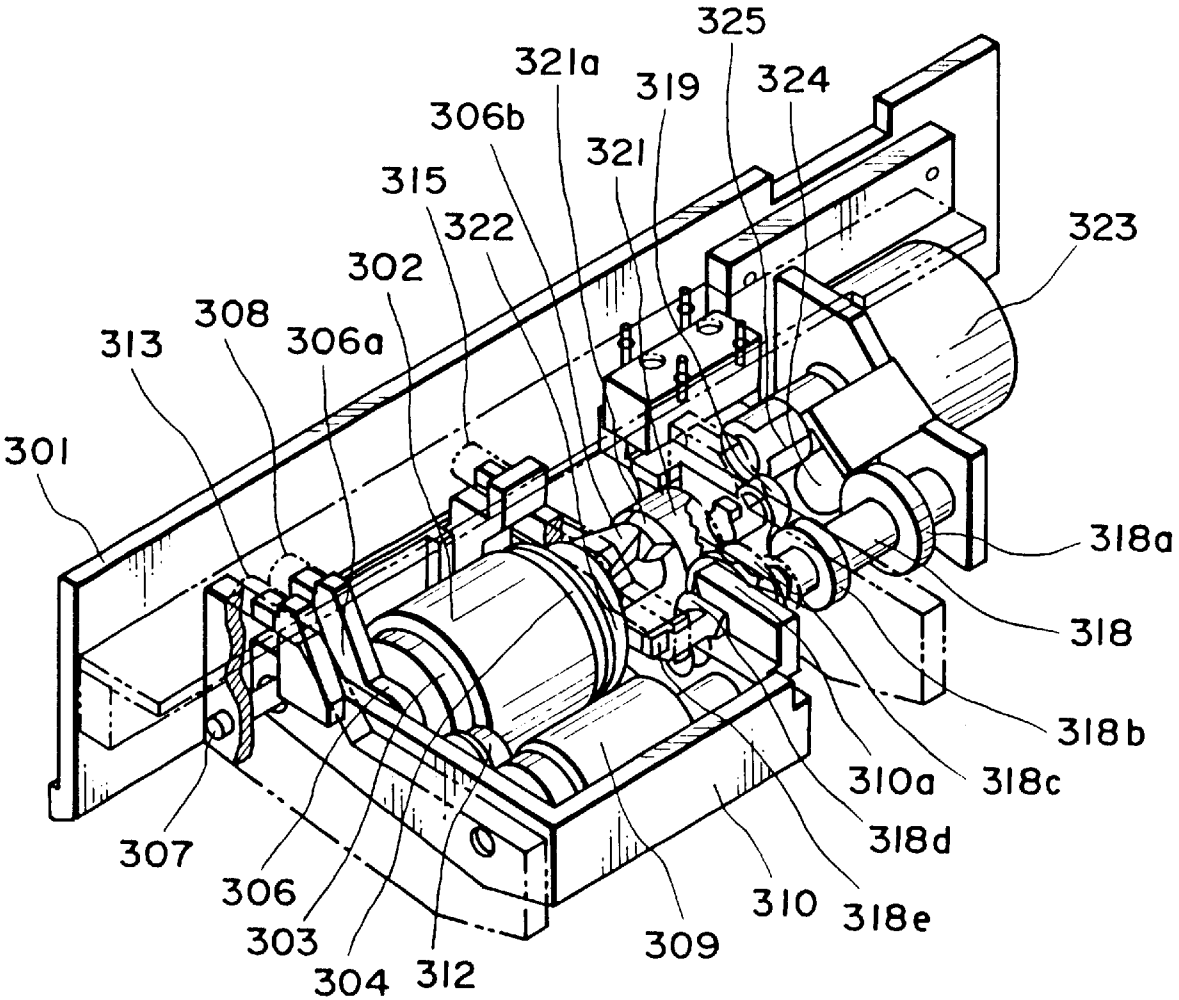
FIG. 26 is an enlarged perspective view of an automatic sheet feeding portion in the first embodiment apparatus.
Figure 27:
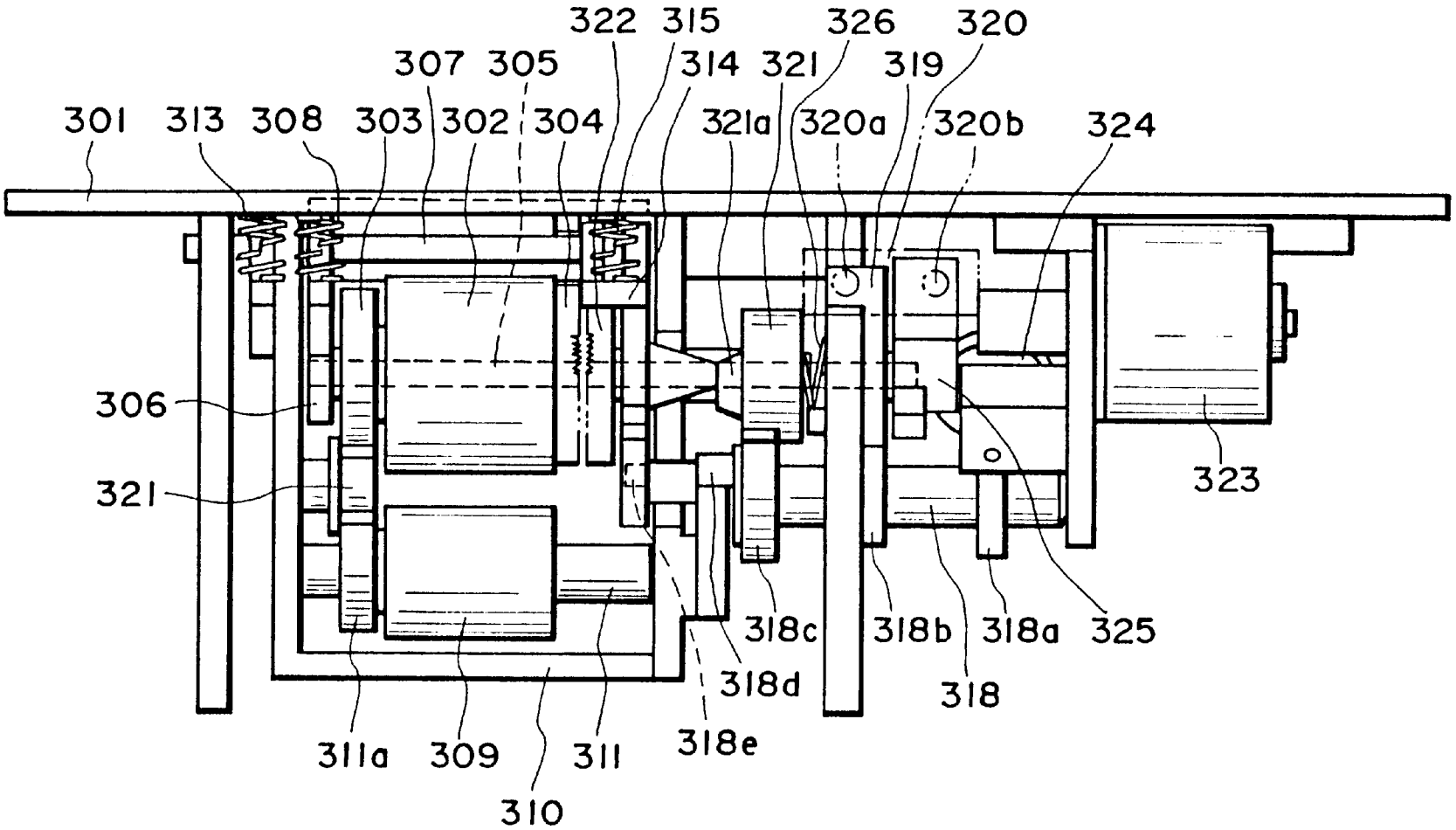
FIG. 27 is a top plan view of an automatic sheet feeding portion in the first embodiment apparatus.
Figure 28:
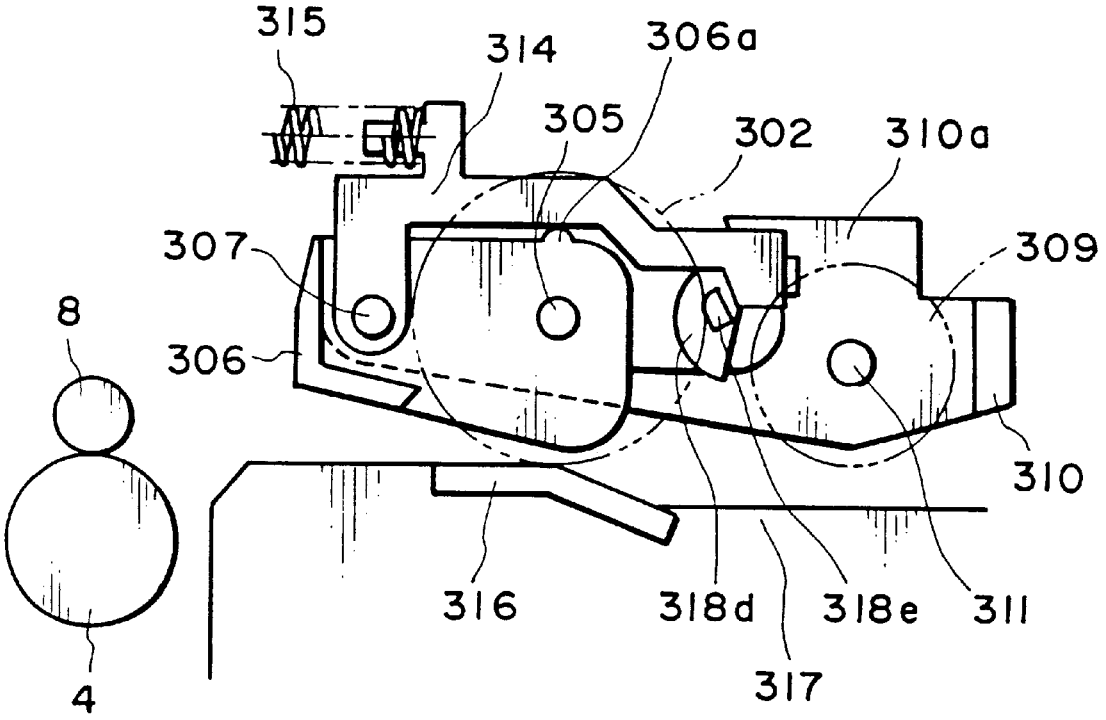
FIG. 28 is a sectional view of an automatic sheet feeder in the first embodiment apparatus.

FIGS. 26, 27 and 28 show an example of the automatic sheet feeding mechanism. FIG. 26 is a perspective view of an outer appearance, FIG. 27 is a top plan view and FIG. 28 is a sectional view.

A main holder 301 supports all of the parts of the automatic sheet feeder, and is also effective to fix the automatic sheet feeder to the ink jet recording apparatus.

A separation roller 302 functions to separate the recording material and to feed it to the sheet feeding portion of the ink jet recording apparatus. It is rotatably supported on a separation shaft 305 and is provided with fixed separation gear 303 and a fixed separation ratchet 304. The separation shaft 305 is fixed on a separation holder 306. The separation holder 306 is rotatably supported on the main holder 301 by a main holder shaft 307. A separation spring 308 is located between a projection 306*a* of a separation holder 306 and a main holder 301, and is effective to rotate the separation holder 306 in the clockwise direction in FIG. 28 to urge the separation roller 302 to a separation pad 316. The urging force of the separation spring 306 is 10–50 gf in this embodiment. In the following example, it is assumed as being 10 gf.

An auxiliary roller 309 functions to feed the recording material to the separation roller 302, and is fixed to the auxiliary roller shaft 311, and is rotatably supported on an auxiliary roller holder 310 together with an auxiliary roller gear 311*a* fixed to the auxiliary roller shaft 311. The auxiliary roller holder 310 is rotatably supported on the main holder 301 by a main holder shaft 307.

The auxiliary roller 309 is rotated by an idler gear 312 at the same peripheral speed as the separation roller 302.

An auxiliary roller spring 313, similarly to the separation holder 306, rotates the auxiliary holder 310 in a clockwise direction of FIG. 28, and is effective to urge the auxiliary roller 309 to a sheet holder 310. The urging force of the auxiliary roller spring 313 is satisfactory if the auxiliary roller 309 assuredly feeds the recording material 3. Therefore, the upper limit is not very much limited, but in this embodiment, good results are provided if it is not less than 20 gf. In the following description, it is assumed as being 50 gf.

A separation pressure arm 314 rotates the separation holder 306 in the clockwise direction in FIG. 28 by way of a projection 306*a* of the separation holder 306 by a separation pressure arm spring 315 about the main holder shaft 307, thus urging the separation roller 302 to the separation pad 316. The urging force of the separation roller 302 provided by the separation pressure arm spring 315 is influential to the separation performance, and therefore, it should be carefully considered. However, in this embodiment, good results are provided if it is not less than 20 gf. In the following description, it is assumed as being 100 gf.

In FIG. 28, reference numeral 316 designates a separation pad for separating and supporting the stacked recording material; and 317 is a sheet holder for holding the stacked recording materials.

A cam shaft 318 is driven through a reduction device 324 and a gear 318*a* from an automatic sheet feeding motor 323. To the cam shaft 318 are fixed a switching cam 318*b* for actuating and deactuating a sheet feed initial sensor 320*a* through a switching arm 319 and the gear 318*a*, a gear 318*c* for transmitting the rotation of the cam shaft 318 to a separation roller 302, an auxiliary roller holder cam 318*d* for vertically moving the auxiliary roller holder 310 in relation to a pawl 310*a* on the auxiliary roller holder 310, and a separation pressure cam 318*e* for vertically moving the separation pressure arm 314. They are integrally provided.

The driving gear 321 and the clutch disk 322 are integrally formed and are supported for rotation and slidable movement relative to the separation shaft 305. They are urged toward a separation ratchet 304 by a clutch spring 326. The driving gear 321 and the separation holder 306 have an integrally formed trapezoidal cam 321*a* and trapezoidal cam 306*b*, respectively. By the rotation of the driving gear 321, the driving gear 321 and the clutch disk 322 are moved in the direction of the axis of the separation shaft 305, so as to control the engagement between the clutch disk 322 and the separation ratchet 304, thus controlling the drive transmission from the automatic sheet feeding motor 323 to the separation roller 302. The gear ratio of the gear 318*c* mounted to the cam shaft 318 and the driving gear 321 is 1:1, so that the rotational phases of the cam shaft 318 and the driving gear 321 are the same.

A release lever 325 is rotatably supported on the main holder 301, and has one end in the form of a cam engageable with an end of the separation shaft 305 to vertically move the separation holder 306 to actuate and deactuate the sheet feed switching sensor 320*b*.

Referring back to FIG. 25, designated by a reference numeral 328 is a center line perpendicular to the separation shaft 305 for the separation roller and the auxiliary roller 309, and extends in the direction of advancement of the recording material 3. The left guide 317*a* is mounted on a sheet holder 317, and guides a left end surface of the recording material 3 at a predetermined position relative to the recording position. A distance L between the center line 328 and the left guide 317*a* is set to be not more than one half the minimum width of the recording material 3 used with the ink jet recording apparatus of this embodiment. In this embodiment, the minimum width is the length of the longer side of a post card size, and therefore, it is 45 mm for the recording material width of 100 mm.

The automatic sheet feeding operation of the sheet feeding mechanism described above will be described.

Figures 29A, 29B, 29C, 29D:
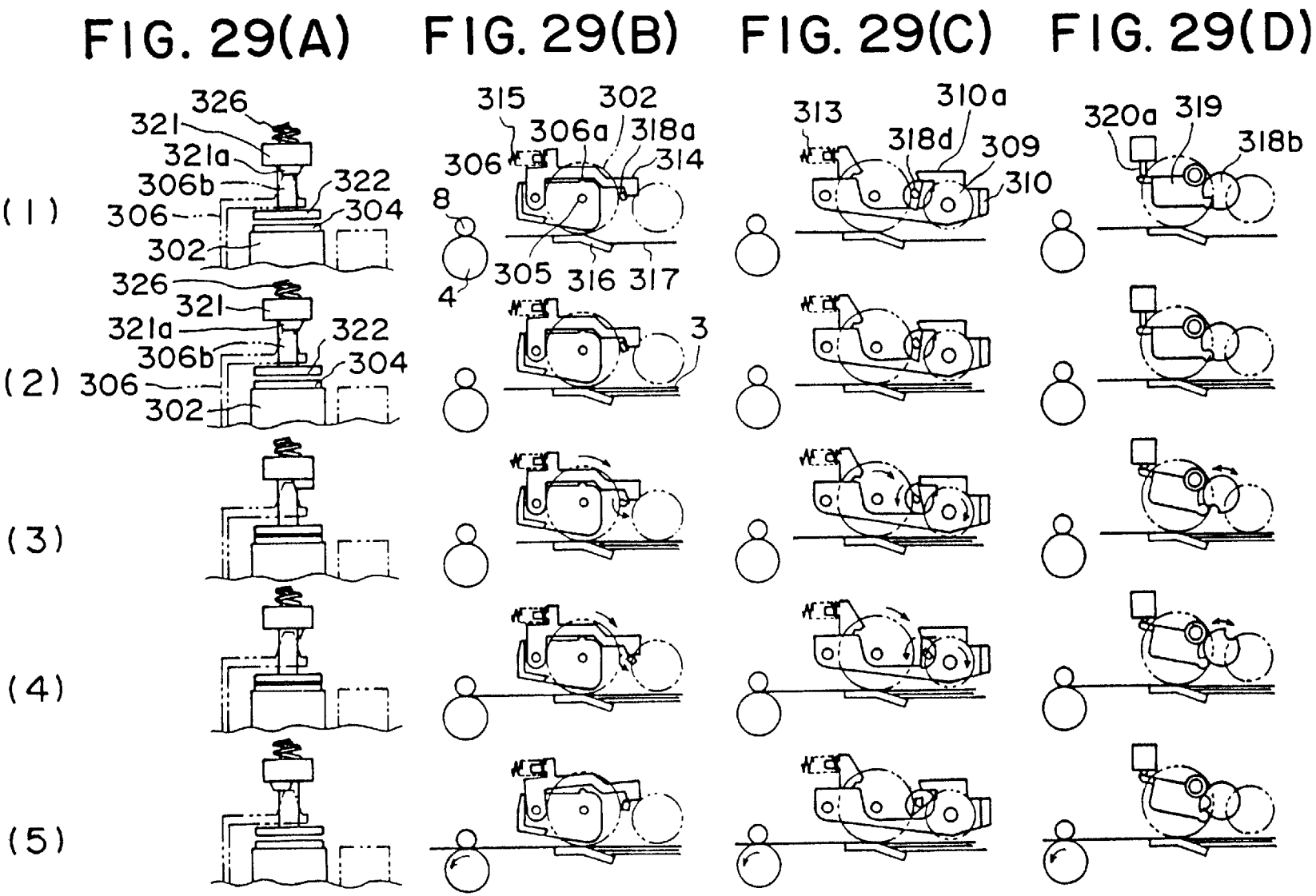
FIGS. 29(A)–29(D), each having five states, illustrate the automatic sheet feeding mechanism in the first embodiment apparatus.
Figure 30:
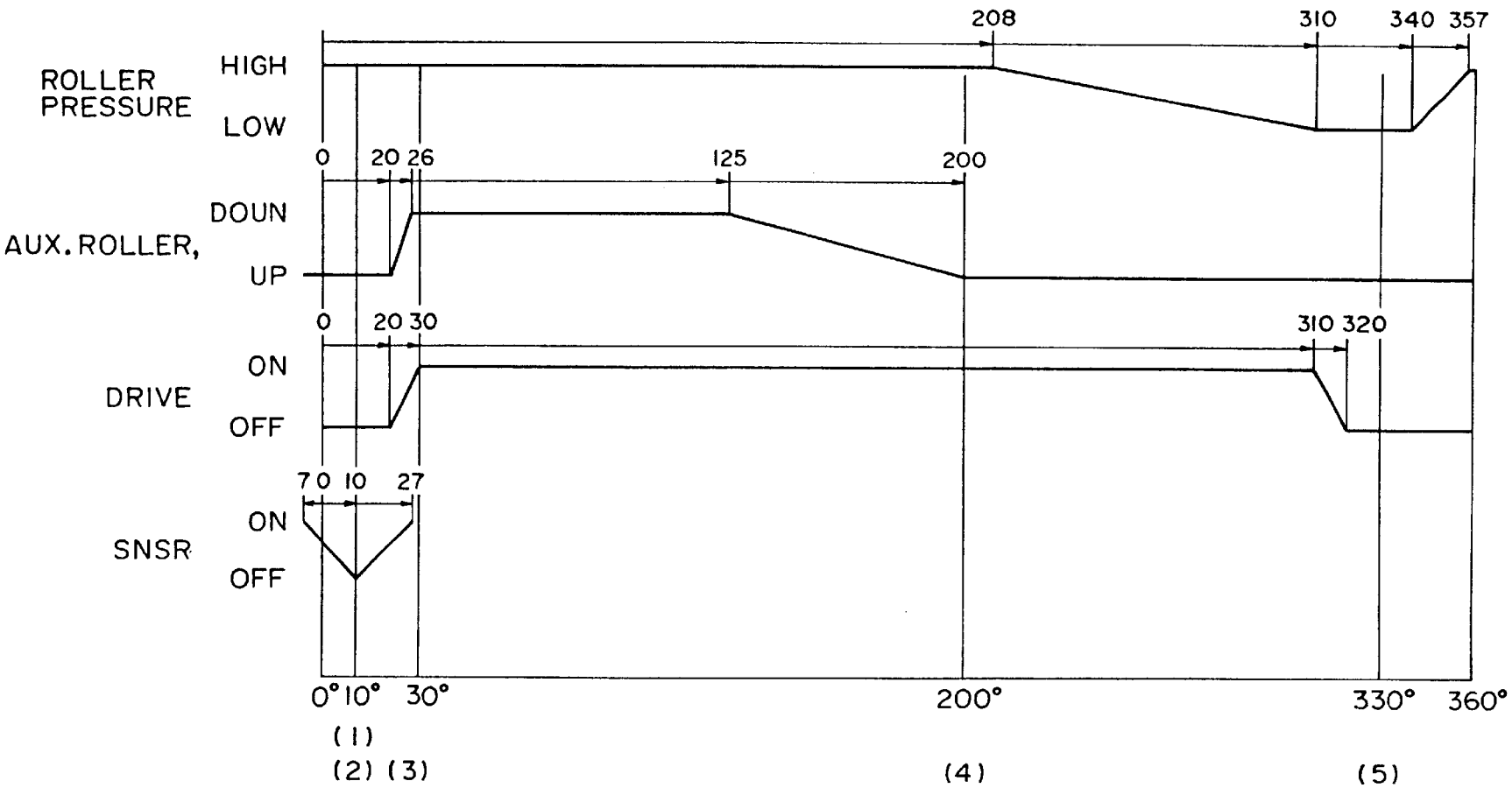
FIG. 30 shows an example of sequential operations of the automatic sheet feeder in the first embodiment apparatus.
Figure 31A:
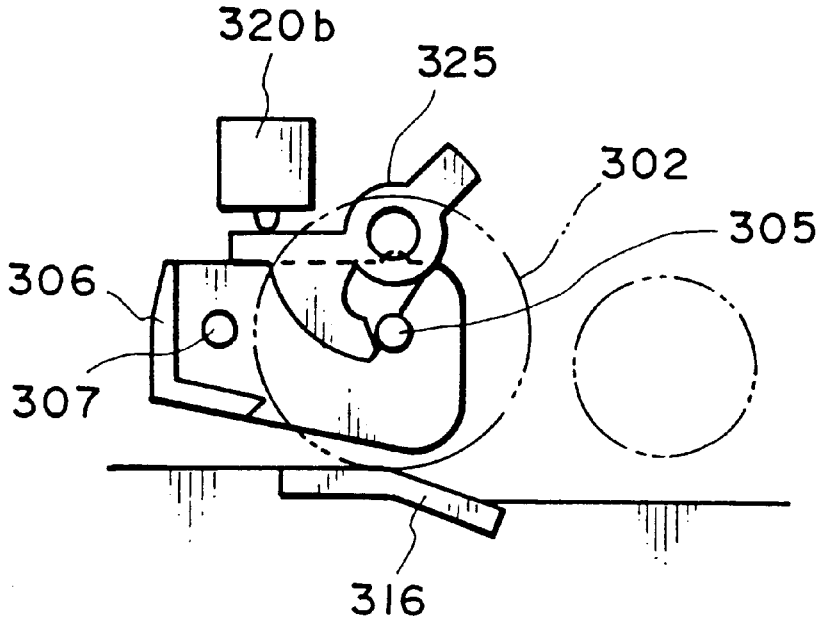
FIGS. 31A and 31B illustrate a releasing mechanism in the automatic sheet feeder in the first embodiment apparatus.
Figure 31B:
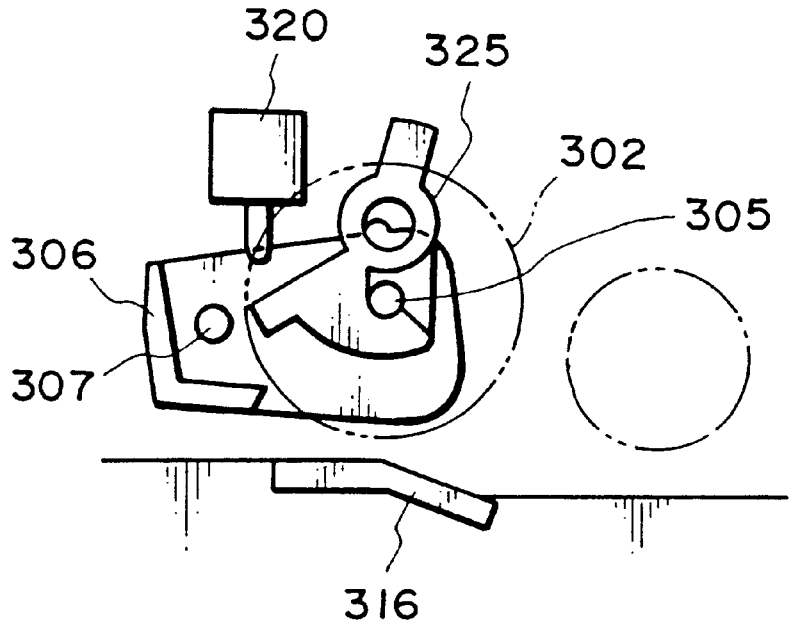

FIGS. 29, 30 and 31 illustrate operation of the automatic document feeding mechanism. FIGS. 29 and 30 show the operations with time, and FIG. 31 illustrates the operation of the releasing mechanism.

In FIG. 29, (1) shows the state before the recording material is loaded.

(A) Since the clutch disk 322 and the separation ratchet 304 are disengaged from the trapezoidal cam 321*a* and the trapezoidal cam 306*b*, the separation roller 302 is disconnected from the driving source.

(B) Since the separation pressure arm 314 and the separation pressure cam 318*e* are not contacted, the pressure of the separation pressure arm spring 315 is effective to urge the separation roller 302 to the separation pad 316 by way of the separation pressure arm 314, projection 306*a* and the separation holder 306. Since the separation spring 308 is in a similar state, the separation roller 302 receives a sum of the pressure of the separation pressure arm spring 315 and the pressure of the separation spring 306 (10+100=110 gf).

(C) Since the auxiliary roller holder cam 318*d* and the pawl 310*a* of the auxiliary roller holder 310 are contacted, the auxiliary roller 309 is away from the sheet holder 317 against the spring force of the auxiliary roller spring 313, together with the auxiliary roller holder 310.

(D) Since the switching arm 319 is in the recess of the switching cam 318b, the sheet feed initial sensor 320*a* is in the off-state.

In FIG. 29, (2) shows the state in which the recording material 3 is loaded. The automatic sheet feeder is not in operation between (1) and (2).

(B) Although the recording material 3 is loaded at the right portion of the Figure, the separation roller 302 is urged to the separation pad 316 by the separation pressure arm spring 315 and the separation spring 306 (11 gf). Therefore, the recording material 3 stops at the nip formed between the separation roller 302 and the separation pad 316, as shown in the Figure.

In FIG. 29, (3) shows the state in which the automatic sheet feeding motor 323 starts to rotate to rotate the cam shaft 318 in the counterclockwise direction by 20 degrees.

(A) The trapezoidal cam 321*a* and the trapezoidal cam 306*b* are disengaged by the rotation, and the clutch disk 322 is urged to the separation ratchet 304 by the clutch spring 326. Therefore, the separation roller 302 starts to rotate by the rotation of the automatic sheet feeding motor 323.

(B) Since the separation pressure cam 318*e* and the separation pressure arm 314, are not contacted, the separation roller 302 starts to rotate the ink in the clockwise direction while being urged to the separation pad 316 (110 gf) by the separation pressure arm spring 315 and the separation spring 308. Therefore, only the topmost one of the recording materials 3 is separated and fed to the left by the separation pad 316 and the separation roller 302.

(C) Since the auxiliary roller holder cam 318*d* and the pawl 310*a* of the auxiliary roller holder 310, are disengaged, the auxiliary roller 309 is urged to the recording material 3 (50 gf) by the auxiliary roller spring 313 through the auxiliary roller holder 310. Furthermore, it is rotated in the clockwise direction by the separation gear 303, the idler gear 312 and the auxiliary roller gear 311*a*, thus feeding the recording material 3 to the left so that the recording material 3 assuredly reaches the nip between the separation roller 302 and the separation pad 316.

(D) The sheet feed initial sensor 320*a* is actuated by the switching arm 319 and the switching cam 318*b*.

In FIG. 29, (4) shows the state in which the cam shaft 318 rotates further in the counterclockwise direction. What is different here is that at (C), the auxiliary roller holder cam 318*d* and the pawl 310*a* are contacted, and the recording material 3 is fed while the auxiliary roller 309 is away from the recording material 3. At this point of time, the recording material 3 reaches the nip between the feeding roller 4 and the pinch roller 8, so that the feeding operation is prevented. However, since the feeding force of the auxiliary roller 309 is reduced, the recording material 3 is not folded or bent, and the separation roller 302 slides on the recording material 3 because of the rigidity of the recording material 3.

In FIG. 29, (5) shows the state in which the cam shaft 318 is further rotated in the counterclockwise direction. In this state, the automatic sheet feeding operation temporarily stops to permit the recording operation of the ink jet recording apparatus.

(A) Since the clutch disk 322 and the separation ratchet 304 are disengaged, the separation roller 302 is completely disconnected from the driving source, and it is supported rotatable on the separation shaft 305.

(B) Since the separation pressure cam 318*e* and 314 are contacted, the separation pressure arm 314 and the projection 306*a* are not contacted. Therefore, the pressure of the separation pressure arm spring 315 is not applied to the separation roller 302. Therefore, the separation roller 302 is urged to the separation pad 316 (10 gf) only by the separation spring 308.

(C) The auxiliary roller 309 is away from the recording material 3.

In this state, the pressure of the separation roller 302 is small (10 gf), and the auxiliary roller 309 is away from the recording material. Therefore, the recording material 3 can be fed into the ink jet recording apparatus with small force.

When the recording operation proceeds, is completed, and the recording material 3 is released from the automatic sheet feeder, the automatic sheet feed motor 323 is actuated to proceed to state (2). This is a completion of one cycle, and the sheet feeder is prepared for the next sheet feeding operation.

FIG. 30 shows timing of sequential operations in this embodiment, and (1)–(5) at the bottom of this Figure correspond to (1)–(5) of FIG. 29.

Referring back to FIG. 25, since the center line 328 is disposed so as to be always at the left side of the center of the width of the recording material 3, the recording material 3 always receives the clockwise direction moment M when the recording material 3 is fed by the separation roller 302 and the auxiliary roller 309. Therefore, the trailing edge of the recording material 3 is always urged to the left guide 317*a*, while it is being fed, so that the recording material 3 is introduced into the recording station along the left guide 317*a* without being inclined.

FIG. 31 illustrates the operation of the releasing mechanism of the automatic sheet feeder. (A) shows the state in which the automatic sheet feeder is used. An end of the release lever 325 actuates a sheet feed switch sensor 320*b*, and is not contacted to the separation shaft 305, and therefore, the separation roller 302 is urged to the separation pad 316. In other words, when the sheet feed switching sensor 320*b* is actuated, it means that the automatic sheet feeder is in the operable state.

In FIG. 31, (B) shows the state in which a recording material which is not suitable for the automatic sheet feeding mechanism is used (envelope or the like). When the operator rotates the release lever 325 in the counterclockwise direction, the automatic sheet feeding is disabled. With this state, the separation shaft 305 is raised to the cam portion of the release lever 325, and the separation roller 302 is fixed away from the separation pad 316. For this reason, the recording material inserted to the right of FIG. 31, directly reaches to the nip between the feeding roller 4 and the pinch roller 8. Since with this state the sheet feed switch sensor

320*b* is deactuated, the disable state of the automatic sheet feeder can be detected.

The foregoing is the description of the operation of the mechanism according to this embodiment.

The description will be made as to the control operation in this embodiment.

Figure 32:
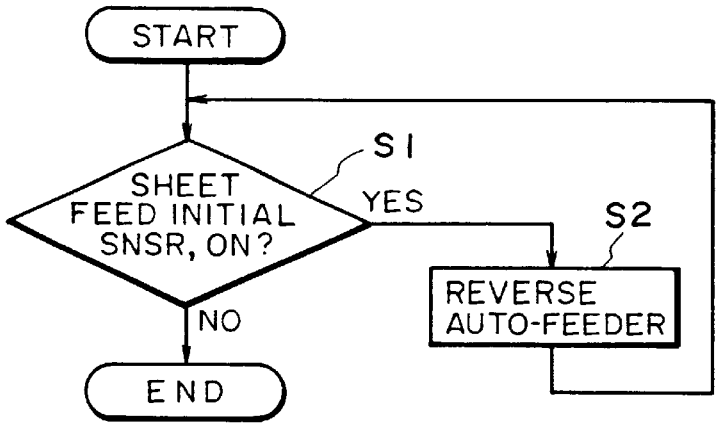
FIG. 32 is a flow chart of control steps of the automatic sheet feeder in the first embodiment apparatus.

FIG. 32 is a flow chart of an example of initial sequential control operations of the automatic sheet feeder.

In this Figure, the main switch is actuated at "START". At step Si, the discrimination is made as to whether or not the sheet feed initial sensor 320A is on- or off-state. If it is off-state, it means that it is in the initial state ((1) of FIG. 29), and therefore, the sequential operation ends to prepare for the sheet feed instructions. If the sheet feed initial sensor 320*a* is in the on-state at step S1, the operation proceeds to step S2, where the automatic sheet feed motor 323 is rotated in the backward direction. At the time when the sheet feed initial sensor 320*a* is in the off-state at step 1, the initial state is established, and therefore, the sequential operation ends.

Figure 33:
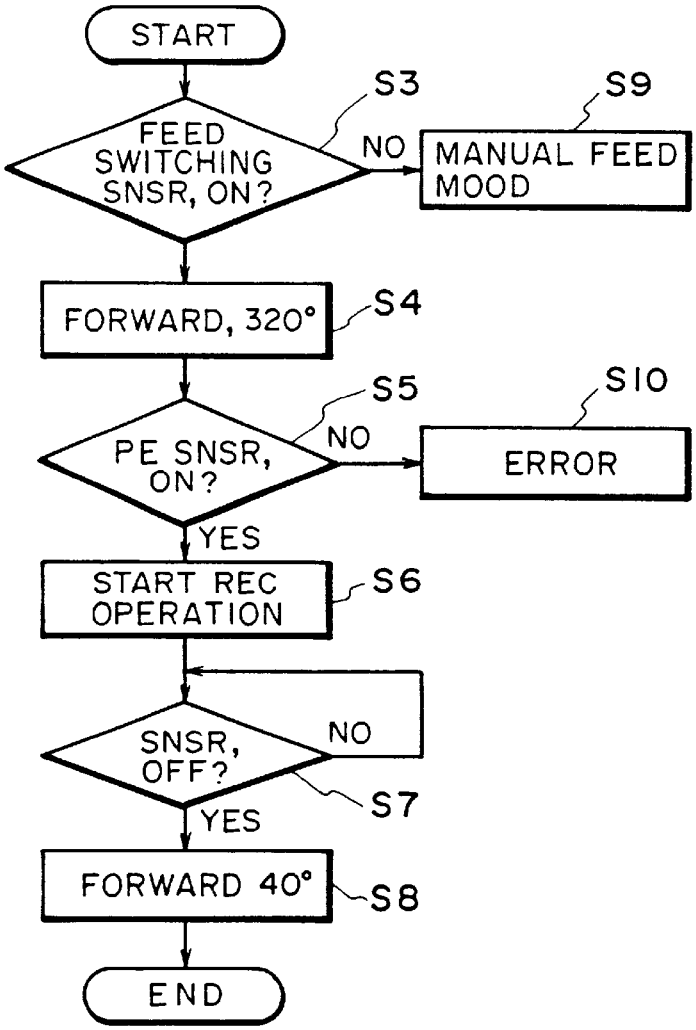
FIG. 33 is a flow chart of control steps for the automatic sheet feeder in the first embodiment apparatus.

FIG. 33 is a flow chart illustrating an example of sequential control operations for carrying out the automatic sheet feed.

The sheet feed instructions are generated at "START". At step S3, if the sheet feed switch sensor 320*b* is in the off-state, the operation proceeds to step S9 where the controller discriminates the non-usable state of the automatic sheet feeder, so that the manual feed mode is enabled.

If the sheet feed switch sensor 320*b* is actuated at step S3, the operation proceeds to step S4, where the automatic sheet feed motor 323 is rotated in the forward direction. If the cam shaft 318 rotates through 320 degrees, the automatic sheet feed motor 323 stops. That is, the state of (5) of FIG. 29 is established.

The operation proceeds to step S5, where the output of the PE sensor 14 in the ink jet recording apparatus is checked. If it is off, it means an improper sheet feeding operation has occurred, and therefore, the operation proceeds to step S10 where the controller discriminates the occurrence of error (improper sheet feeding or sheet empty). If it is in the on-state, the operation proceeds to step S6 where the recording operation is started.

Subsequently, the operation proceeds to step S7 to await off-state of the PE sensor 14. If it becomes off, the operation proceeds to step S8 where the automatic sheet feed motor 323 is rotated in the forward direction. When the cam shaft 318 rotates through 40 degrees, it stops. Thus, the state (2) of FIG. 29 is established. The operation stops here and waits for the sheet feed instructions.

A structure and electric circuit will be described in conjunction with information processing apparatus using the recording apparatus of this embodiment.

Figure 34:
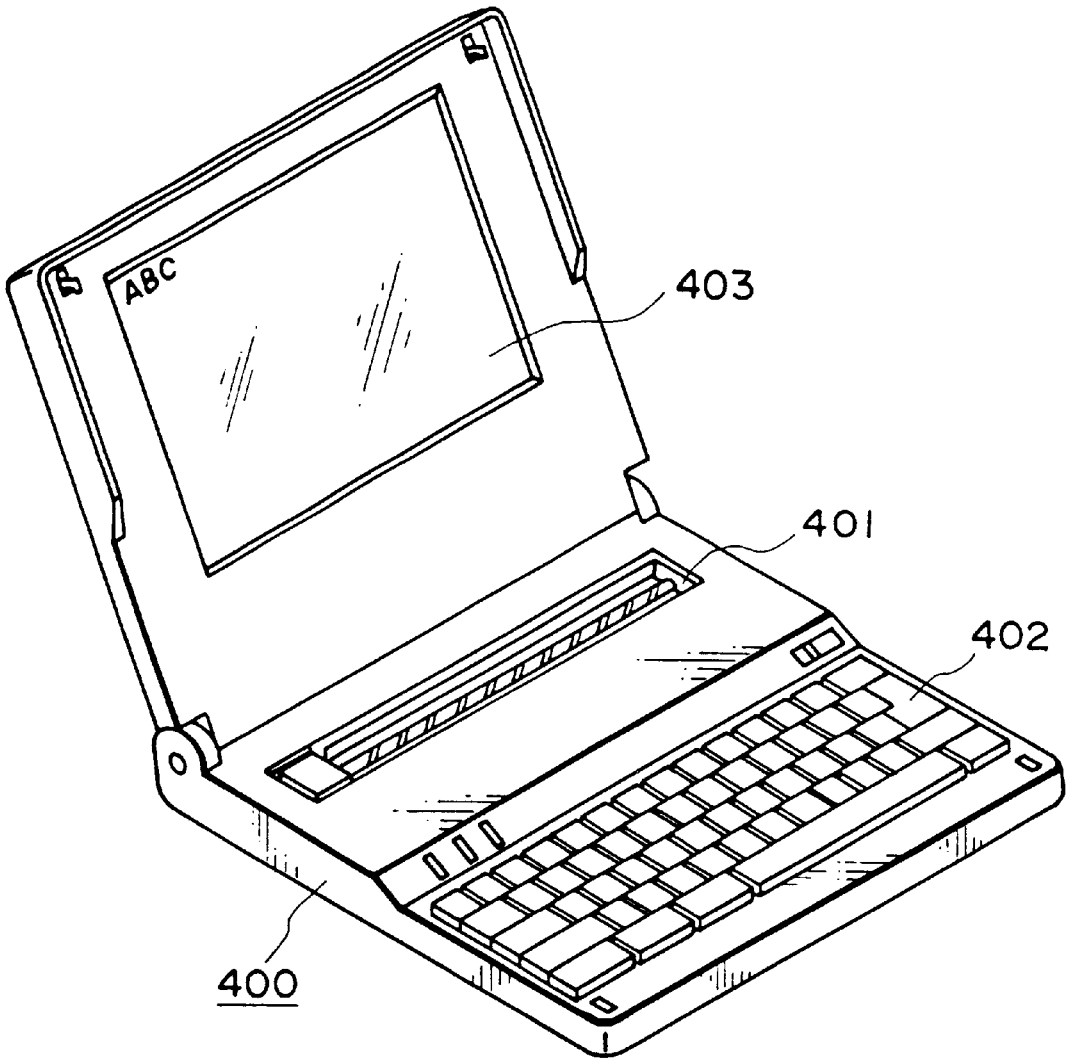
FIG. 34 is a perspective view of an information processing apparatus having the recording apparatus of the first embodiment therein.

FIG. 34 is a perspective view of an outer appearance of the information processing apparatus 400 incorporating the recording apparatus of this embodiment. In this Figure, a reference numeral 401 designates the above-described printer; 402, a keyboard having character and numerical keys and other keys for commands; and 403, a display.

Figure 52:
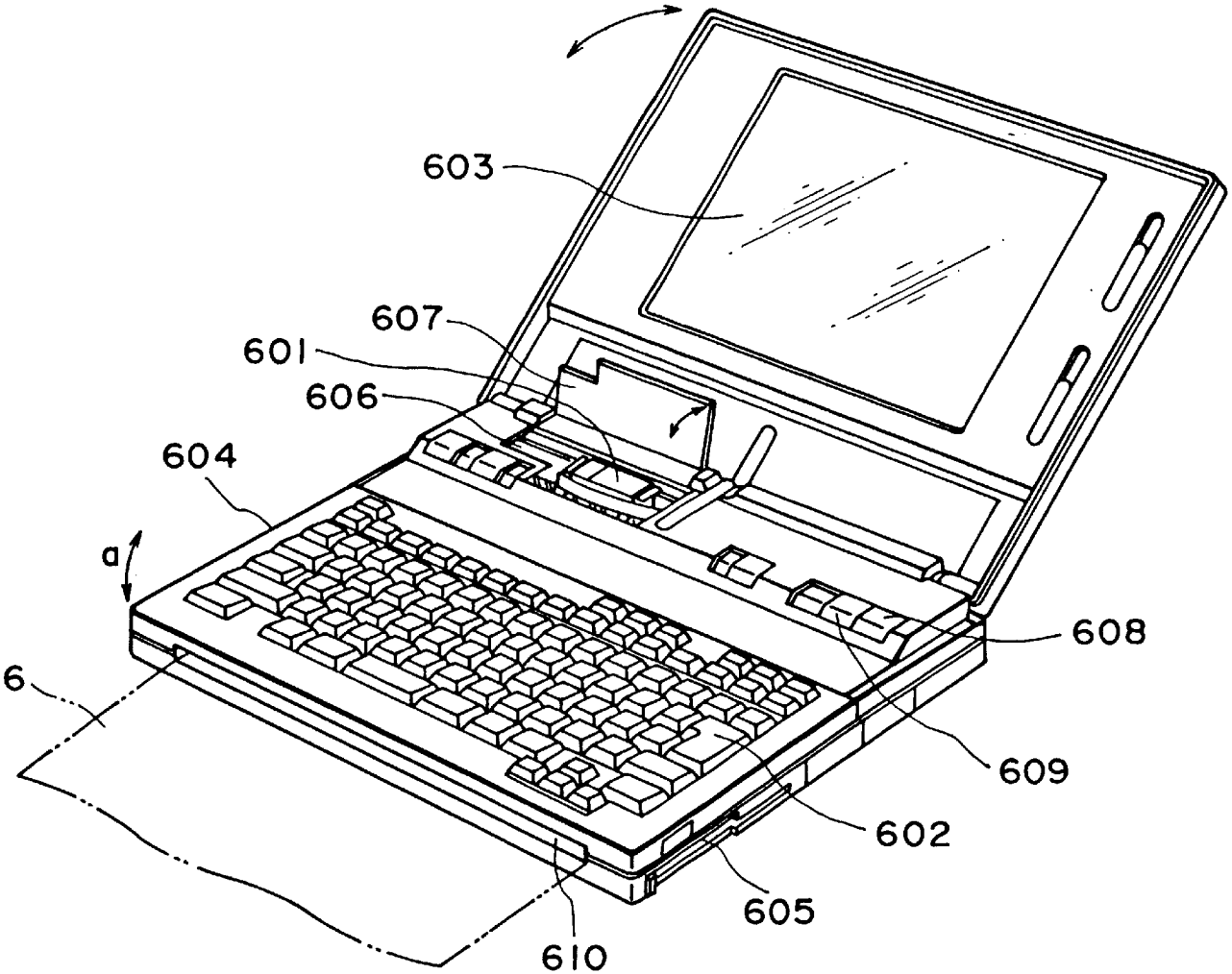
FIG. 52 is a perspective view of an information processing apparatus of the first embodiment in which the recording apparatus is incorporated.

FIG. 52 is a perspective view of an outer appearance of an information processing apparatus 604 incorporating the recording apparatus of this embodiment. In the Figure, reference numeral 601 designates a printer described above; 602, a keyboard provided with numerical character keys, other character keys and command keys; 603, a display portion with a display; 606, a window for permitting exchange of the recording head 1 and/or the ink container 2 described hereinbefore; and 607, an openable cover for covering the window 606 other than when they are exchanged. The window 606 has a size enough to permit manipulation of the head lever 106 and the container lever 107 upon the ink container 2 exchange. Reference numeral 608 designates an exchanging switch for exchange of the recording head 1 and/or the ink container 2. When the exchanging switch 608 is actuated, the carriage motor 402*a* is driven, so that the carriage 102 is moved from the home position or the recording region to the window 606 position. At this position, when the exchange of the recording head 1 or the ink container 2 is completed, a release switch 609 is actuated. Then, the carriage 102 is returned to the home position, and thereafter, the recovery unit 301 carries out the recovery operation including drawing-out or ejecting the ink and wiping the recording head. Subsequently, the state before the exchange switch 608 is actuated is established. The recording material is supplied to the printer 601 through a sheet supply port 610. The keyboard 602 is openable in a direction a for setting the recording material 6.

Figure 35:
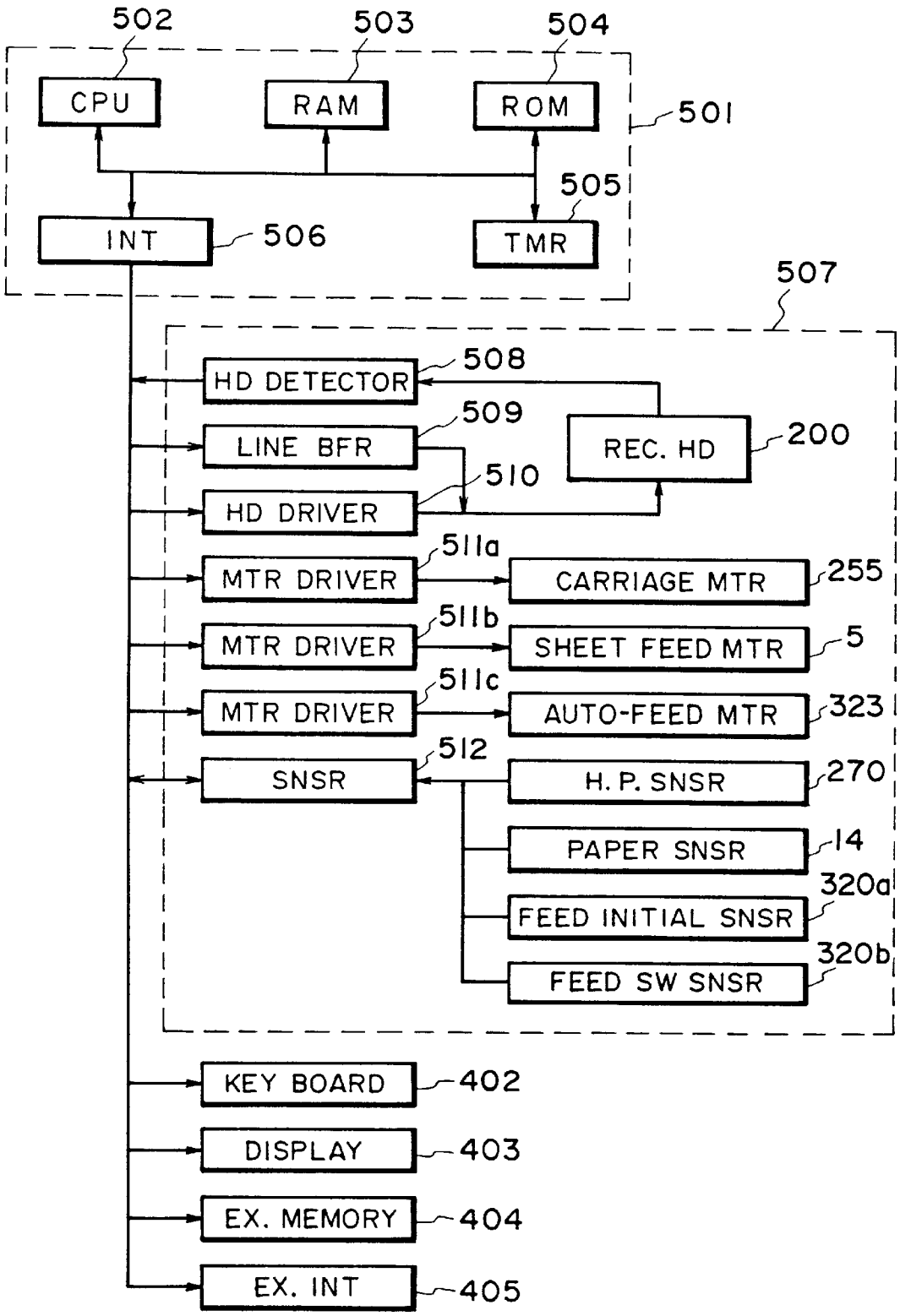
FIG. 35 is a block diagram of an electric circuit structure of the information processing device having the recording apparatus of the first embodiment therein.

FIG. 35 is a block diagram of the electric circuit structure of the information processing apparatus. In this Figure, a reference numeral 501 is a controller for the main control operation; 502, a CPU in the form of a microcomputer, for example, for carrying out various processes; 503, a RAM including an area for developing text data or image data and a work area; 504, a ROM for storing fixed-data such as the program for the sequential operations and font data; 505, a timer for producing executing cycle of the CPU 502 and producing necessary timing for the recording operation of the printer 401; and 506, an interface for supplying the signals from the CPU 502 to the peripheral device.

In addition, a reference numeral 507 designates a controller for the printer 401; 508, a recording head detector for detecting information on the recording head such as outputs of sensors for detecting presence or absence of the recording head 200, the types thereof and the temperature thereof and outputs of the sensor for detecting presence or absence of the ink in the ink container 201; 509, a line buffer for storing record data for the recording head 200; 510, a head driver for supplying the recording signal and the electric power to the recording head 200; 511*a*, 511*b* and 511*c*, motor drivers for supplying necessary signals and electric power for operation of the carriage motor 255, the sheet feeding motor 5 and automatic sheet feed motor 323, respectively; and 512, sensor detectors for detecting outputs of sensors such as the home position sensor 270, the paper sensor 14, the sheet feed initial sensor 320*a*, the sheet feed switch sensor 320*b* or the like. Furthermore, a reference numeral 404 designates an external memory such as FDD, HDD, RAM card or the like; and 405 designates an external interface for communication with another information processing apparatus or for connection directly with an internal bus to control the peripheral devices. Although not shown in the block diagram, there is a power source for supplying electric power to the above electric circuits. The power source may be in the form of a chargeable battery, a disposable dry battery or an AC source converter fixedly used with the main assembly of the information processing apparatus.

Figure 36:
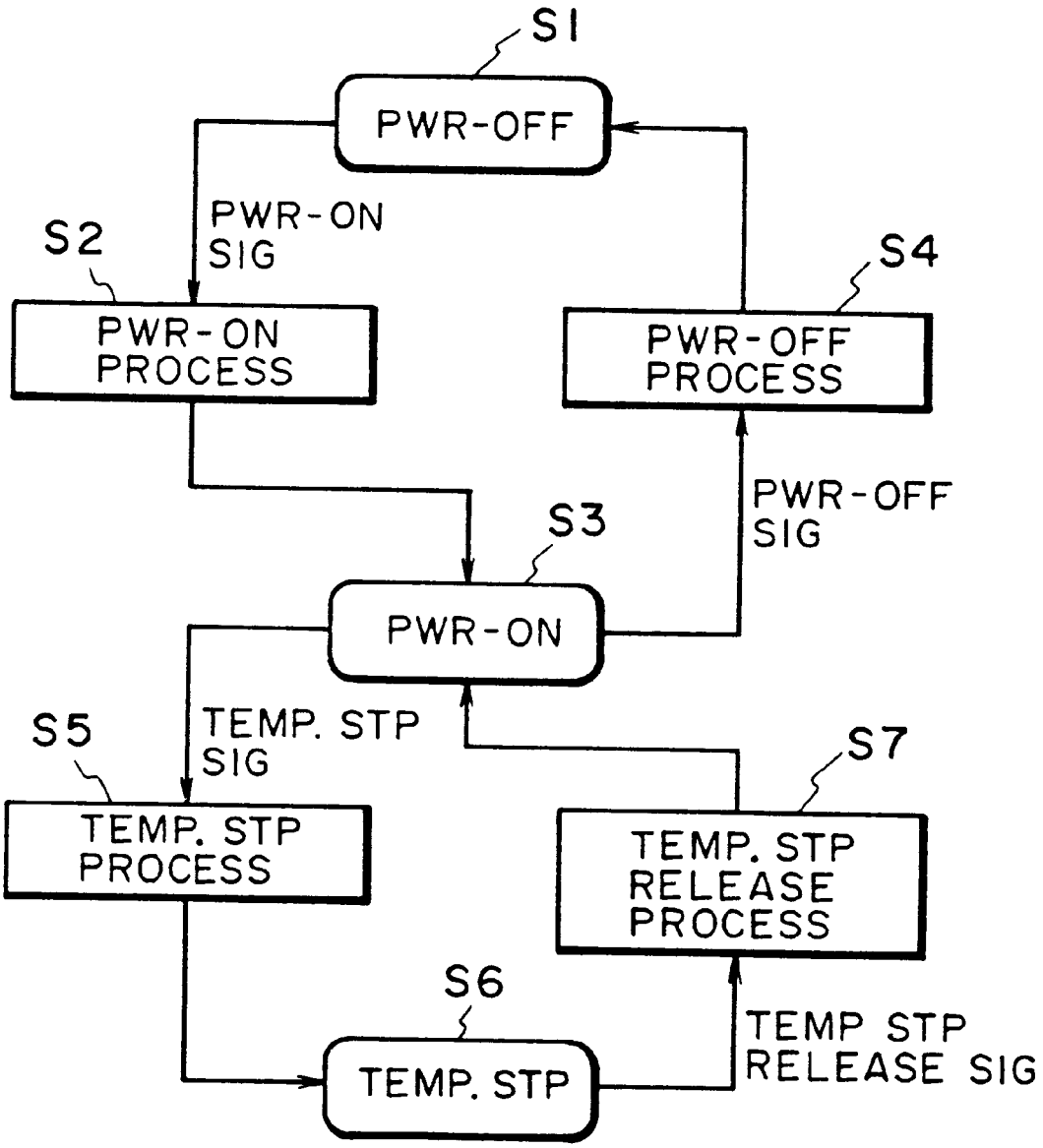
FIG. 36 is a flow chart for the power-on and power-off processing in the information processing apparatus having therein the recording apparatus according to the first embodiment of the present invention.

With the above structure of the electric circuits, the recording operation is carried out on the recording material (paper) 3 by the recording apparatus. Referring to FIG. 36 which is a flow chart, the sequential recording operations will be described.

FIG. 36 illustrates the processing operations when the main switch is actuated or actuated in the recording apparatus or in the information processing apparatus, wherein Si shows the power-off state in which the functions are all stopped except for the timer 505 (FIG. 35). The operation is started by actuation of the main switch, that is, the change from the power-off to the power-on state. In the recording apparatus, the power-on process is executed at step S2. Upon completion of the step S2, the step S3 is executed, so that the power-on state is established.

The recording operation or the like is carried out in the power-on state. If the power-off signal is detected in the power-on state, a step S4 is executed (power-off processing). Upon completion of step S4, the operation proceeds to step S1, by which the power-off state is established. Therefore, when the main switch is actuated or deactuated, the predetermined process operations are executed, and only then, the power-on or power-off state is established. If a temporary stop signal is detected in the step S3, the operation proceeds to step S5, by which the temporary stop process is executed. The temporary stop signal is produced by a means for detecting operator's manipulation, in the operative state, which is supposed to be effected in the inoperative state, for example, when the display portion 403 in FIG. 34 is folded over the keyboard 403 in the power-on state or when the battery is exchanged. An example of such a sensor is a sensor for detecting opening or closing the display portion 403 or mounting or dismounting of the battery. The temporary stopping operation is intended to prevent damage or malfunction even if the apparatus is operated in the manner different from the designed operation. The detail thereof will be described hereinafter. Upon completion of the temporary stop process at S5, the operation proceeds to step S6 where the apparatus is in the temporary stopped state. In this state, the power supply is shut-off, and the functions are not performed, other than those which are necessary. If the temporary stop release signal is detected in the temporary stop state, the operation proceeds to step S7 where the temporary stop releasing operation is carried out. The temporary release signal corresponds to the above-described temporary stop signal. The signal is produced when the display 403 is moved to the open state from the closed state, or when the battery is mounted. Thus, it means that the apparatus returns to the operable state. The temporary stop release process is to restore the apparatus to the state before the temporary step. The details thereof will be described hereinafter. By doing so, even if the operator erroneously closes or opens the display 403 during the apparatus operation, or the battery is removed during the recording operation, the original state can be restored. If the temporary stop release operation is completed in step S7, the operation proceeds to step S3 where the power-on state is re-established. In the temporary stop signal, the selection may be permitted as to whether or not the temporary stop processing operations are to be carried out or not upon the detection of the temporary stop signal. In the case where the display portion 403 is preferably closed due to the sheet handling during the printing operation, the temporary stop process may be prohibited when the display 403 is closed. This may be incorporated in the apparatus.

Figure 37:
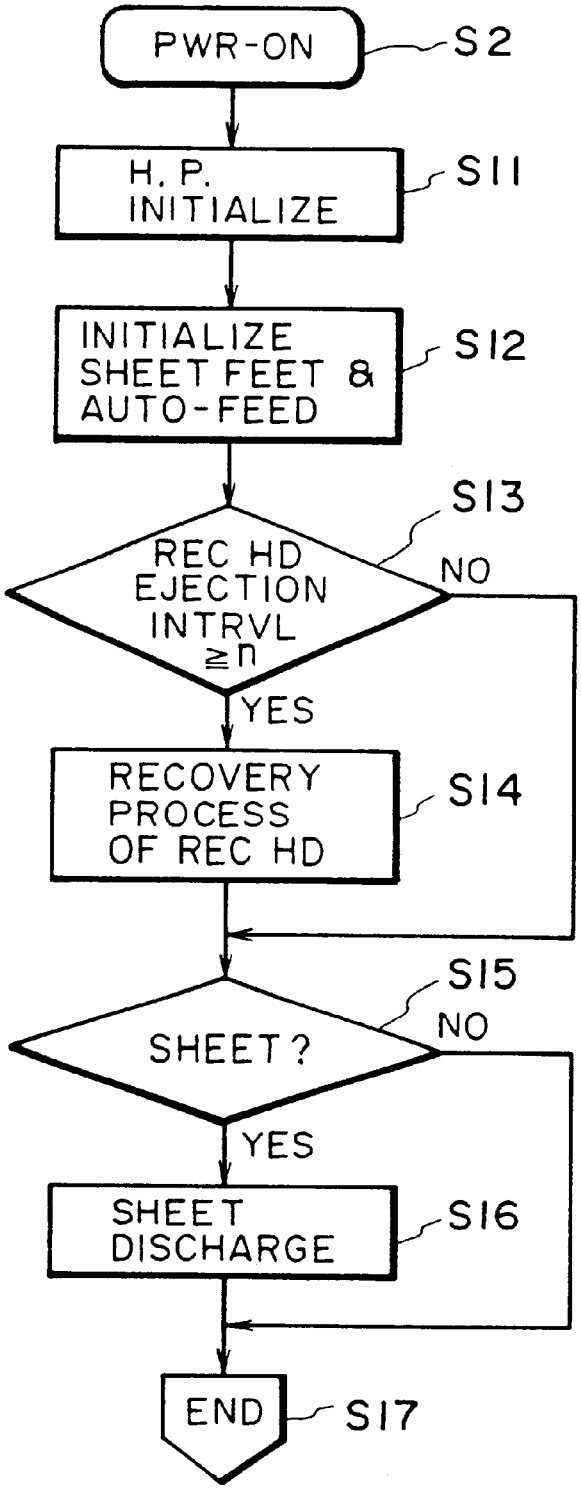
FIG. 37 is a flow chart illustrating power-on processing in the information processing apparatus having therein the recording apparatus of the first embodiment.

FIG. 37 is a flow chart illustrating power-on process (S2). At step S11, the home position initialization is carried out. First, the position of the carriage 203 is determined. More particularly, the carriage motor 255 is driven, and the position where the home position sensor 270 output switches is taken as a reference position of the carriage 203. Thereafter, the carriage motor is driven to establish a capped state in which the ejection outlets of the recording head 200 are covered by the cap 101. Next, the operation proceeds to step S12, where the initialization of the automatic sheet feed is carried out. More particularly, in order to avoid the influence due to the play existing in the sheet feeding driving mechanism, the sheet feed motor 5 is driven through a predetermined distance in the backward direction and forward direction. The automatic sheet feed motor is driven until the sheet feed initial sensor 320*a* detects the initial position. Next, the operation proceeds to S13, the timer 505 detects the time period from the last ejection or drawing-out of the recording head 200 to the current state. If the time period is not less than a predetermined period n, the operation proceeds to step S14 where the recording head recovery operation is carried out. If not, the operation proceeds to step S15. In step S14, the recording head 200 is subjected to the recovery operation. The ink is ejected from the recording head 200 into the cap 101; the blade 104 cleans the ejection side surface of the recording head 200; the ink is drawn out from the recording head 200 by the pump unit 150. By the recovery processing, the improper ink ejection can be prevented. The improper ink ejection possibly can be caused by leaving the recording head 200 in non-use state for a long period of time with the result of the ink adjacent the ejection side surface of the recording head 200 being evaporated so that the viscosity of the ink increases. After operation at step S14, the operation of S15 is carried out so that it is discriminated whether the paper sensor detects the sheet or not. If so, step S16 is carried out, and if not, the operation proceeds to S17. At step S16, the detected sheet is discharged. In other words, after the paper sensor 14 detects non-sheet, the sheet feed motor 5 is driven in the forward direction through a predetermined amount. Then, the operation proceeds to step S17 where the power-on process is completed.

Figure 38:
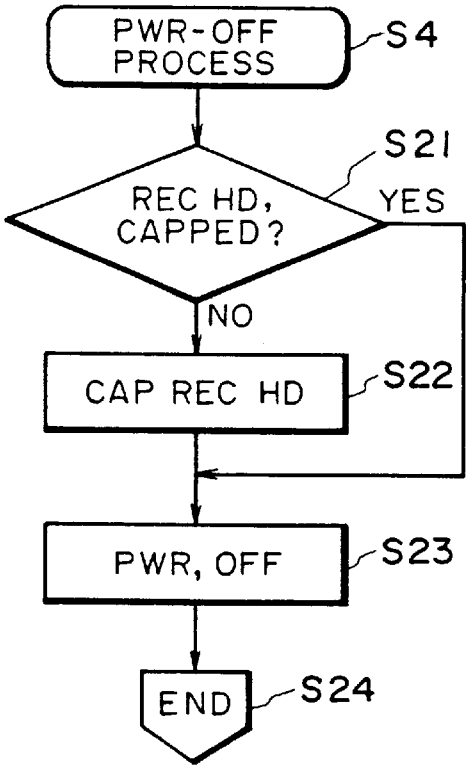
FIG. 38 is a flow chart of a power-off processing in the information processing apparatus having therein the recording apparatus of the first embodiment.

FIG. 38 illustrates power-off process (S4). At step S21, the discrimination is made as to whether or not the recording head 200 is capped. If not, the operation proceeds to step S22. If it is capped, step S23 is executed. In step S22, the carriage motor 255 is driven to cap the recording head 200. At step S23, the power source of the recording apparatus is deactivated to stop the operation. In this process, the power-off state is established assuredly after the recording head 200 is capped even if the main switch is deactuated when the recording head 200 is not capped, that is, during the recording operation or the like. Therefore, improper ink ejection due to ink viscosity increase by evaporation from exposing the ejection outlet of the recording head to air can be efficiently prevented.

Figure 39:
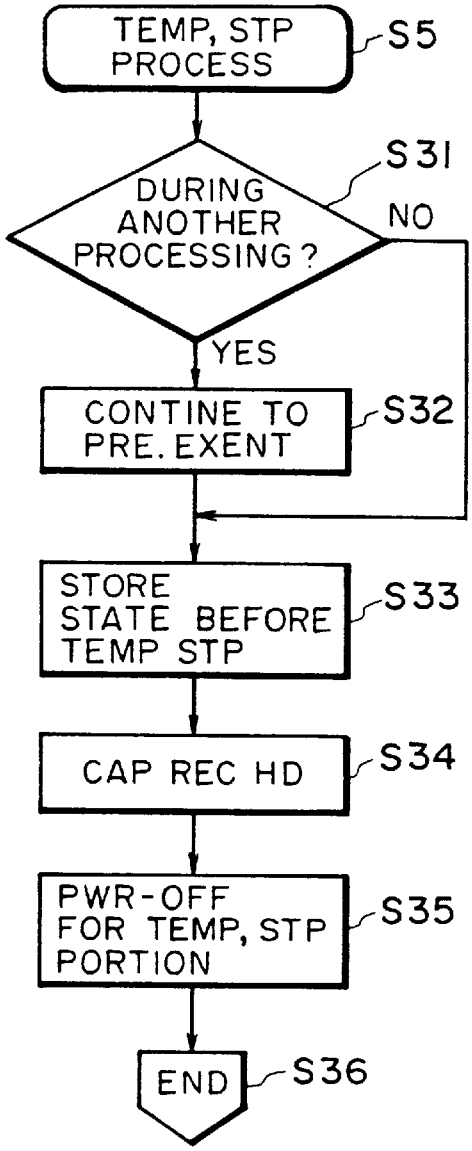
FIG. 39 is a flow chart of temporary stop processing in the information processing apparatus having therein the recording apparatus of the first embodiment.

FIG. 39 is a flow chart illustrating the temporary stop operation at step S5. At step S31, the discrimination is made whether any process is being carried out or not. If so, the operation proceeds to S32. If not, it proceeds to step S33. At step S32, the process which is being currently carried out is continued to a predetermined point. For example, if it is during the recording operation, the recording operation is continued to the completion of that line recording. If it is in the sheet feeding or automatic sheet feeding operation, the operation is continued until the end thereof. If it is during the sheet discharging operation, the operation is immediately stopped.

Then, the operation proceeds to step S33, where the current state is stored. More particularly, if any process is interrupted, the state of the apparatus at the time of interruption (state of the display 403, that of the operation panel (not shown), on-line or off-line state or the state of power saving mode, for the saving of the power of the battery) is stored in the memory. Then, the operation proceeds to step S34 where the recording head 200 is capped. If it is already capped, nothing is done. Subsequently, step S35 is executed where the power supply to the parts not requiring power in the temporary stop state is shut-off. Then, at step S36, the temporary stop process (S5) is completed. In this processing, even if the temporary stop signal is detected during the recording operation, the recording head 200 is assuredly capped, and therefore, the occurrence of improper ejection due to the recording head 200 left uncapped, can be prevented.

Figure 40:
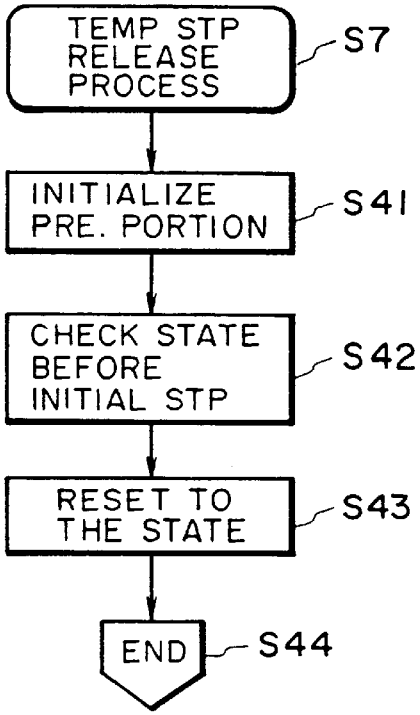
FIG. 40 is a flow chart of temporary stop releasing process in the information processing apparatus having therein the recording apparatus of the first embodiment.

FIG. 40 is a flow chart illustrating temporary stop processing (S7). At step S41, the predetermined parts are initialized. More particularly, determination of carriage 203 position, play removal of the sheet feeding motor 5, the initial position setting of the automatic sheet feeding mechanism or the like, are carried out at steps S11 and S12. Next, the operation proceeds to S42, where the state immediately before the temporary stop, stored in step S33, is checked. Then, step S43 is executed to return the apparatus to the state immediately before the stop. More particularly, if there is any process interrupted, the process is completed. In addition, the display 403 or the operating panel is restored. Next, the operation proceeds to step S44, and the releasing operation for the S7 temporary stop process is completed. Therefore, even if the temporary stop occurs during some process being executed, the interrupted process can be continued after the reset.

Figure 41:
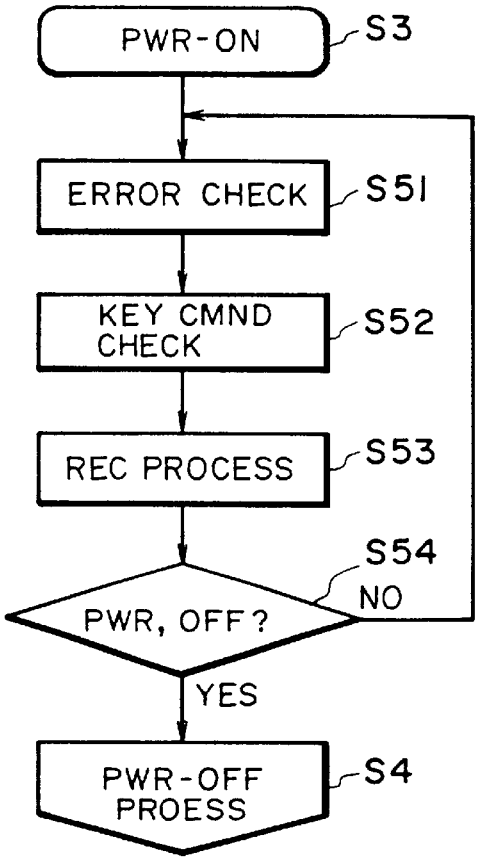
FIG. 41 is a flow chart of a power-on processing in the information processing apparatus having therein the recording apparatus of the first embodiment.

FIG. 41 is a flow chart illustrating operation in S3 power-on. At step S51, various error checking and error clearing operations are carried out. More particularly, the error is displayed on the display portion 403, or it is displayed on the operation panel with or without an audible alarm, when the recording apparatus is out of paper, when the recording head 200 or the ink container 201 is not mounted, when the ink container 201 does not contain the ink, when the sheet jam is detected during the recording process, when the temperature of the recording head 200 abnormally increases, when an error of motors is detected or the like. Next, the operation proceeds to step S52 where the key operation or command reception of the keyboard 402, the operation panel, the external interface 405 or the like, is checked, and the necessary operations are carried out. More particularly, when the sheet feeding key is depressed, the sheet is inserted, discharged or fed through a predetermined distance, corresponding to the situation. When the on-line key is depressed, or when the on-line command is received, the error is checked, and the on-line process is executed. When the command regarding the recording operation is received, the necessary processing is carried out. When a key input for the recording head 200 or ink container 201 exchange or emptiness of the ink container 201 is detected, the carriage motor 255 is driven to move the carriage 203 to a position facilitating handling during exchange. After the completion of the exchange, the carriage motor 255 is driven to displace the recording head 201 to the cap position 101. Then, the pump unit 150 is operated to draw the ink through the ejection outlets of the recording head 200. Even if air is introduced in the ink passage between the recording head 200 and the ink container 201 while exchanging the ink container 201, the air can be drawn out to the outside of the recording apparatus 200 by drawing out the ink. It is possible to prevent beforehand the occurrence of improper ejection attributable to the introduction of the air into the recording head. Then, the operation proceeds to step S53. The operation in this step will be described hereinafter in detail. Then, the operation proceeds to step S54, where the power-off signal is checked. If the signal is detected, the power-off processing (S4) is executed. If not, the operation returns to step S51.

Figure 42:
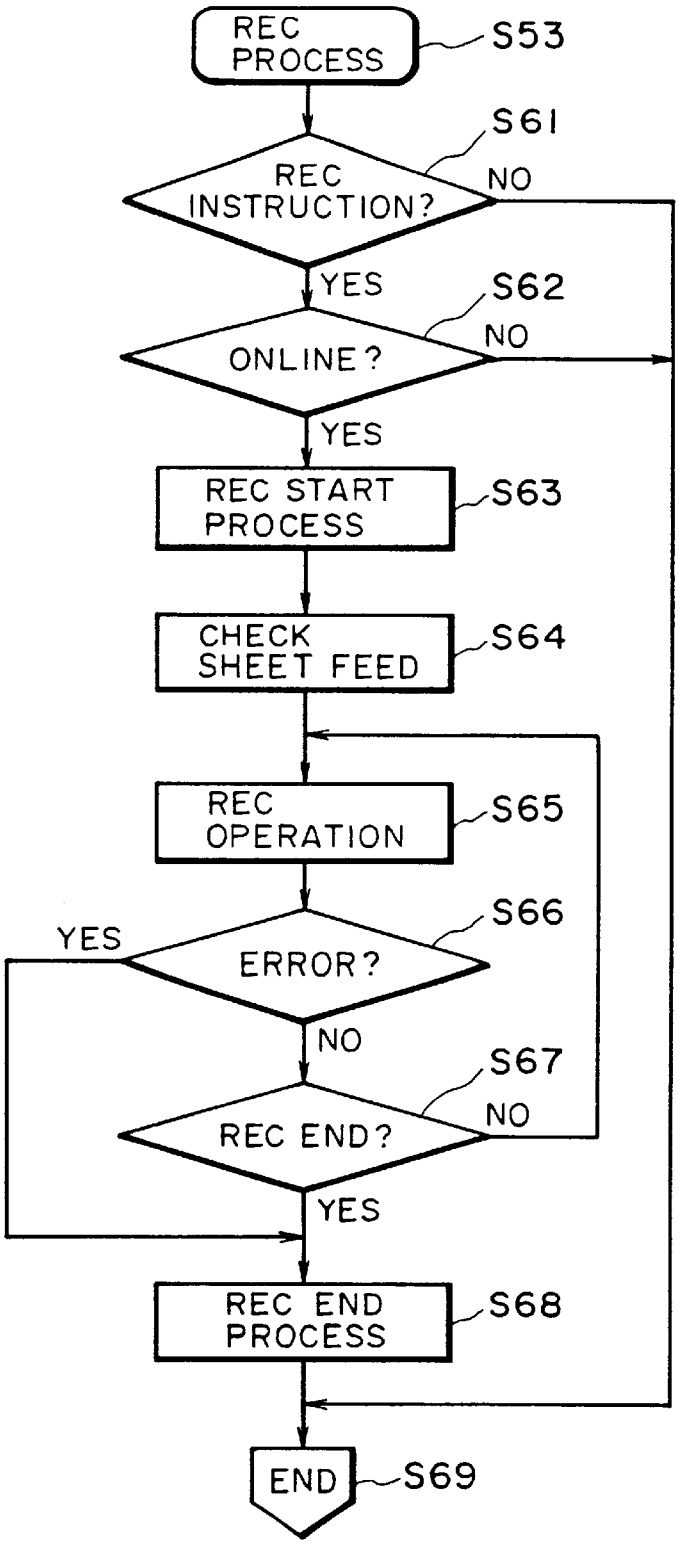
FIG. 42 is a flow chart of recording operation of the information processing apparatus having therein the recording apparatus of the first embodiment.

FIG. 42 is a flow chart illustrating the recording process operations (S53). At step S61, the discrimination is made whether the record executing command such as sheet feed command or the reception of the data to be recorded is received or not. If there are recording instructions, the operation proceeds to step S62. If not, the operation proceeds to S69, and the operation is completed. At step S62, the on-line state is checked. If it is in the on-line state, the operation proceeds to step S63. If it is in the off-line state, the operation proceeds to S69, where this operation ends. At step S63, the operation for the start of the record operation is carried out. More particularly, the temperature of the recording head 200 is controlled by a heater in the recording head 200; the ejection is adjusted on the basis of ejection to outside the recording area from the recording head 200; the deviation between the forward and backward scanning motions of the carriage motor 255 is detected by the home position sensor, and the deviation in the bi-directional motion is corrected. If the sheet is not fed to a recording position in the automatic sheet feeding mode, the automatic sheet feeding motor 323 is driven to feed the sheet. Next, the operation at step S65 is carried out to effect one line recording. More particularly, the carriage motor 255 is driven, and the ink is ejected from the recording head 200. Upon completion of one line recording, the sheet is fed through a predetermined distance, and the operation proceeds to step S66. At step S66, the occurrence of error is checked. If there is any error occurrence, step S68 is carried out. If not, the operation proceeds to S67. The error check is effected, for example, for detection of the bottom end of the sheet, sheet jam detection, ink exhaustion detection, detection of scanning error of motors or the like. The detected error is corrected at step S51. In step S67, the checking is effected for the record end command, sheet discharge command or the signal reception. If it is record end, the operation proceeds to step S68. If not, the operation returns to S65 to continue the recording operation. At step S68, the record end processing is carried out. More particularly, the sheet is discharged, and the recording head 200 is capped, for example. Thereafter, the operation proceeds to step S69, where the S53 recording process is completed.

Referring to FIGS. 43A, 43B, 44A, 44B, 45A and 45B, the description will be made as to the flexible cable used in this embodiment of the present invention.

Figure 43A:
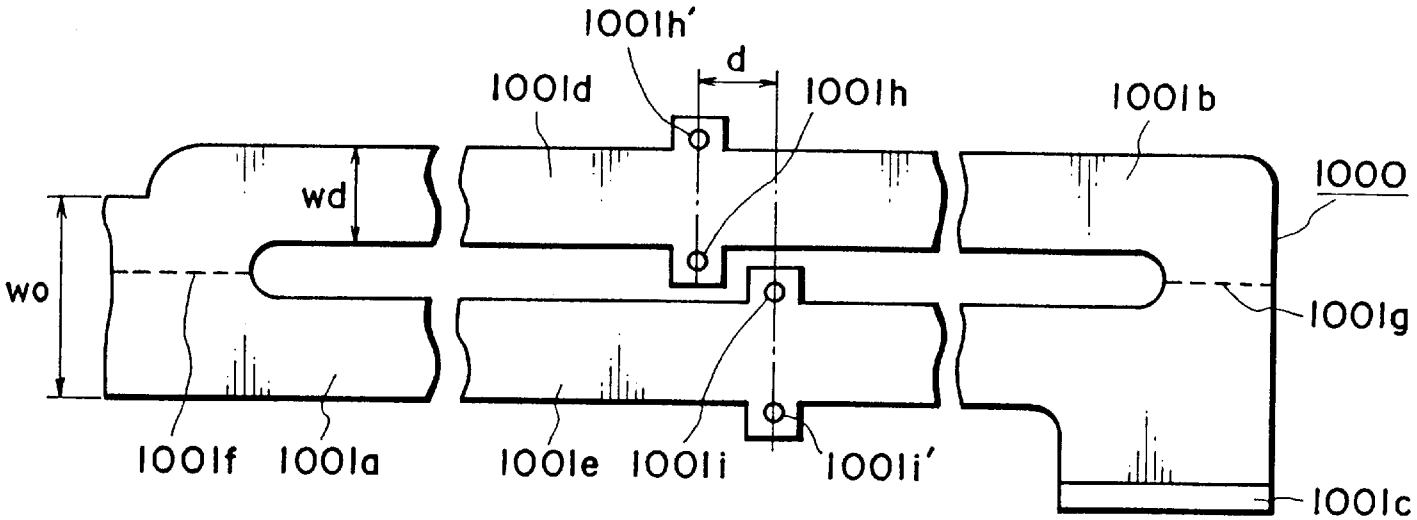
FIGS. 43A and 43B illustrate a flexible cable according to an embodiment of the present invention.

FIG. 43A shows a flexible cable used in this embodiment. The flexible cable is designated by a reference numeral 1000 in this Figure. The flexible cable 1000 includes a printed conductor pattern. The thickness and the width of the conductor pattern is determined on the basis of the current capacity and tolerable voltage drop or the like required for the conductor pattern. From the standpoint of increasing durability of the flexible cable against bending or folding, the thickness of the conductor pattern is preferably smaller, but it requires a wider conductor pattern with the result of a wider flexible cable.

Designated by a reference 1001*a* is a movable end of the flexible cable 1000, and 1001*b* is a fixed end. At the fixed end 1001*b*, there are contacts 1001*c*. Between the movable end 1001*a* and the fixed end 1001*b*, the flexible cable is divided into two parts 1001*d* and 1001*e* having a width Wd. The flexible cable 1000 is folded at a fold 1001*f* adjacent to the movable end 1001*a* of the flexible cable and at a fold 1001*g* adjacent a fixed end 1001*b* of the flexible cable, and one part is overlaid on the other, and therefore, the width of the flexible cable 1000 is Wd in the divided portion, so that the width can be made smaller than the width Wo at the movable end 1001*a* of the flexible cable. In the Figure, the flexible cable is divided into two parts. It may be divided into three or more parts with the result of further reduced width. In the divided portions bold and 1001*e* of the flexible cable, positioning holes 1001*h*, 1001*h*', 1001*i* and 1001*i*' are formed. The positioning holes 1001*h* and 1001*h*' are spaced apart by a predetermined distance d, and the positioning holes 1001*i* and 1001*i*' are spaced apart by the predetermined distance d.

Figure 43B:
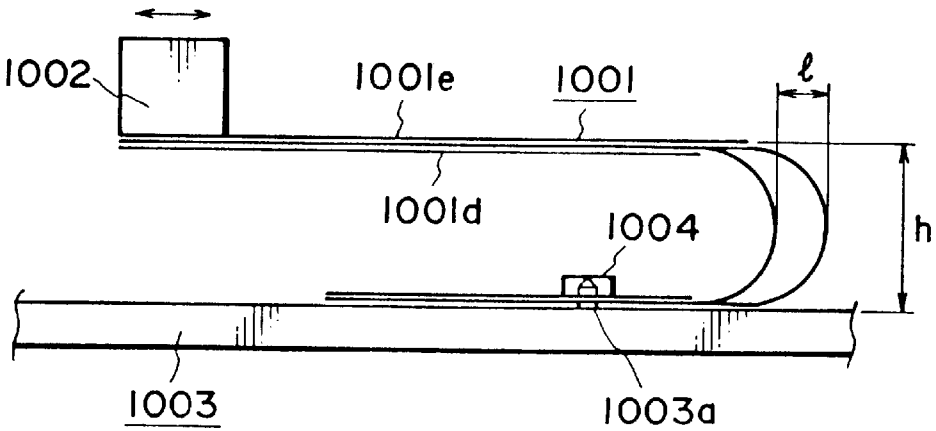

FIG. 43B shows an apparatus using the flexible cable 1000. In the Figure, reference numeral 1002 designates a movable portion and is movable in the direction of an arrow. The movable portion 1002 has a recording head in the case of a printer, and has a sensor or the like in the case of scanner. Designated by a reference numeral 1003 is a fixed part having a positioning pin 1003*a*. In the portion 1001, the flexible cable 1000 is folded and overlaid, and the movable part 1001*a* of the flexible cable (FIG. 43A) is connected to the movable part 2. The positioning holes 1001*h*, 1001*h*', 1001*i* and 1001*i*' are inserted to the positioning pin 1003*a* and are fixed on the fixed portion by a fixing member 4. As described hereinbefore, since the positioning holes 1001*h* and 1001*h*' are spaced by the distance d, and the holes 1001*i* and 1001*i*' are spaced by the distance d, the bent portion of the divided parts 1001*d* and 1001*e* are deviated by a distance 1. When the thickness of the flexible cable 1000 is sufficiently small as compared with the bending height h, the distance 1 is substantially equal to d/2. Thus, the bent positions of the divided part 1001*d* and 1001*e* are different, and therefore, the bent portions are not influenced by the other flexible cable, and therefore, the durability against bending is close to that without folding.

However, if the distance 1 is very large, the size of the apparatus will increase. The distance between the bent portions is preferably less than the bent height or lower, that is, the distance d between positioning holes of the flexible cable is preferably not more than twice the bending height h.

As described above, by dividing the flexible cable into plural parts which are overlaid and which have different bent positions, the width and the bending height of the flexible cable can be reduced without decreasing the durability against the bending and with the current capacity and the voltage drop of the conductor pattern of the flexible cable maintained at proper levels. Therefore, the size of the apparatus can be reduced.

In FIGS. 43A and 43B, the flexible cable is divided into two parts, but it may be divided into three or more parts. The number of positioning holes of the flexible cable is the number of divided parts with the predetermined interval, arranged in the longitudinal direction of the flexible cable.

Figure 44A:
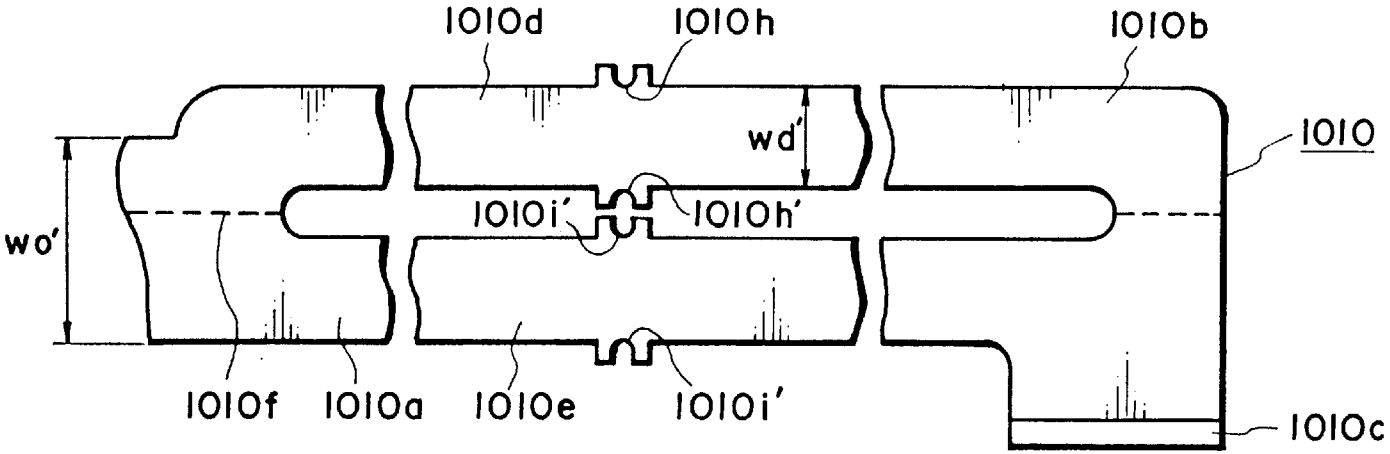
FIGS. 44A and 44B show a modification of the embodiment shown in FIG. 43.

FIG. 44A shows another embodiment, in which the flexible cable is designated by a reference numeral 1010. Designated by a reference 1010*a* is a movable end of the flexible cable 1010, and 1010*b* is a fixed end. At the fixed end 1010*b* of the flexible cable, there are contacts 1010*c*. Between the movable end 1010*b* of the flexible cable, the flexible cable is divided into parts 1010*d* and 1010*e* having a width Wd. The flexible cable 1010 is folded and overlaid at a fold 1010*f* adjacent a movable end 1010*a* of the flexible cable and at a fold 1010*g* adjacent the fixed end 1010*b* thereof. By doing so, the width of the flexible cable 1010 is Wd' in the divided part, which is smaller than a width Wo' at the movable end 1010*a* of the flexible cable. In the Figure, the flexible cable is divided into two parts. However, it may be divided into three or more parts, thus further reducing the width. The divided parts 1010*d*, 1010*e* are provided with positioning recesses 1010*h*, 1010*h*', 1010*i* and 1010*i*'. The positioning recesses 1010*h* and 1010*h*', and the positioning holes 1010*i* and 1010*i*' are at the same position with respect to the longitudinal direction of the flexible cable.

Figure 44B:
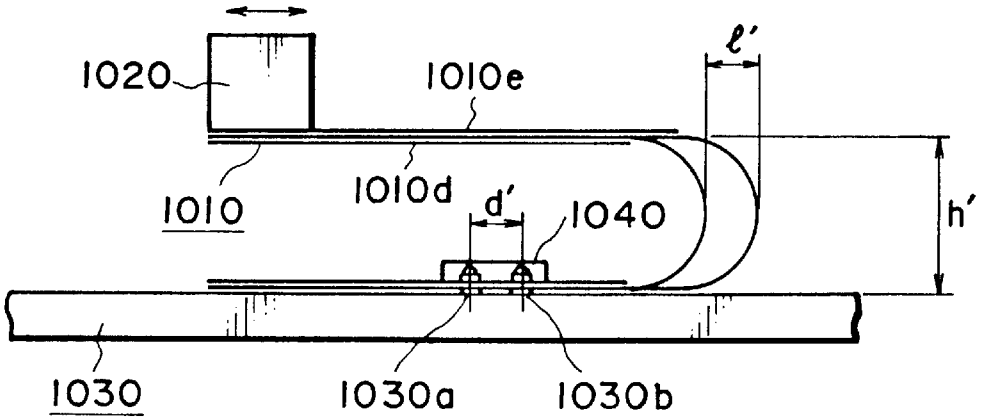
Figure 45A:
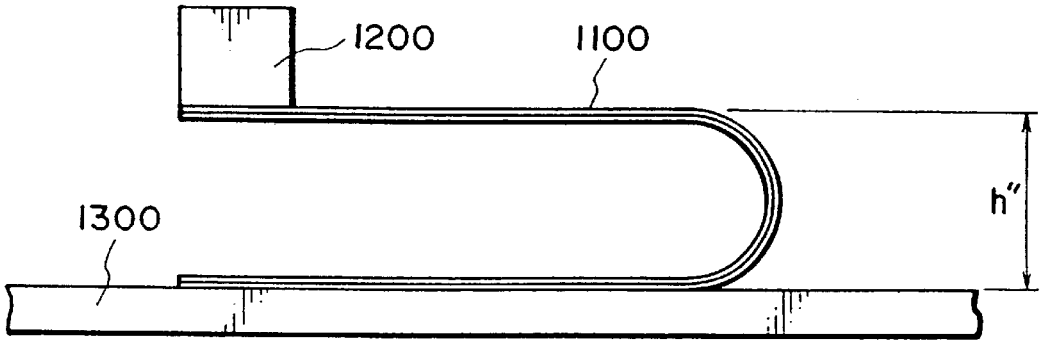
FIG. 45A CONVENTIONAL ART
FIGS. 45A and 45B illustrate a conventional flexible cable.
Figure 45B:
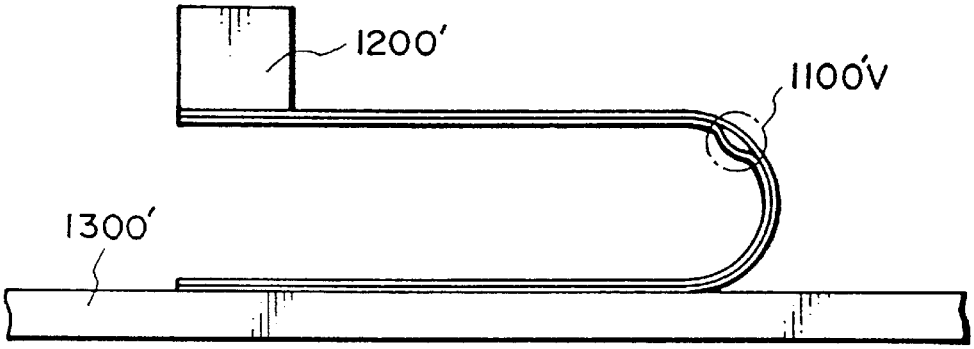
FIG. 45B CONVENTIONAL ART
Figure 46:
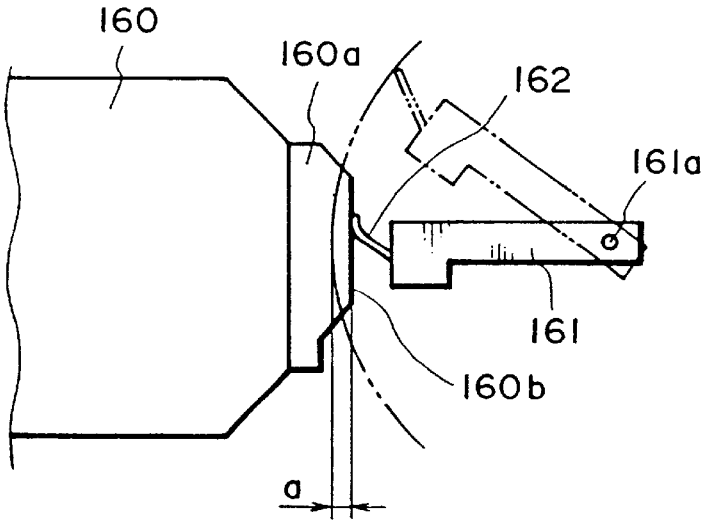
FIG. 46 CONVENTIONAL ART
FIG. 46 illustrates a conventional cleaning mechanism.

FIG. 44B shows an apparatus using the flexible cable 1010. In this Figure, reference numeral 1020 is a movable end and is movable in the direction indicated by an arrow. The movable end 1020 has a recording head carried thereon in the case of a printer, and it has a sensor or the like carried thereon in the case of a scanner. Reference numeral 30 designates a fixed portion, where there are positioning pins 1030*a* and 1030*b* with a distance d' therebetween.

The flexible cable 1010 in this embodiment is a folded and overlaid flexible cable 1010 of FIG. 44A. The movable end 1010*a* (FIG. 44A) of the flexible cable is connected with a movable part 20. The positioning recesses 1100*h* and 1100*h*' of the flexible cable are engaged with a positioning pin 1030*a* and the positioning recesses 1100*i* and 1100*i*' of the flexible cable are engaged with the positioning pin 1030*b* and it is fixed to the fixed part 1030 by fixing member 1040. As described hereinbefore, the positioning pins 1030*a* and 1030*b* are spaced by a distance d', and therefore, the bent positions of the divided parts 1100*d* and 1100*e* are deviated by a distance 1'. When the thickness of the flexible cable 1100 is sufficiently smaller than the bending height h', the distance 1' is substantially equal to d'/2. Thus, the bent positions of the divided parts 1100*d* and 1100*e* of the flexible cable are different, and therefore, the bent portions are not influenced by the other part, and therefore, the durability against the bending is close to that without the folding.

In FIGS. 44A and 44B, the flexible cable is divided into two parts, but it may be divided into three or more parts. The number of positioning pins at the fixed end is the number of divided parts of the flexible cable at predetermined intervals arranged in the longitudinal direction of the flexible cable.

In this embodiment, the flexible cable electrically connected between the movable part and the fixed part are described. The same applies to a flexible cable electrically connecting members which are movable relative to each other.

As described in the foregoing, the flexible cable is divided into plural parts which are overlaid and which are bent at different positions. By doing so, the width and the bending height of the flexible cable can be reduced, thus reducing the size of the apparatus, without deteriorating the durability against the bending and with the proper electric current capacity and voltage drop of the conductor pattern of the flexible cable.

While the invention has been described with reference to the structures disclosed herein, it is not confined to the details set forth herein and this application is intended to cover such modifications or changes as may come within the purposes of the improvements or the scope of the following claims.

What is claimed is:

1. An apparatus having a flexible cable, said apparatus comprising:

a flexible cable portion which is divided, except for opposite end portions, along a line connecting the opposite end portions into a plurality of divided cable portions, wherein one of said divided cable portions is overlapped with another of said divided cable portions by folding said flexible cable portion at the end portions which are not divided, along extensions of the line; and positioning portions mounted on said divided cable portions, respectively, said positioning portions being connected with each other, wherein said positioning portions are disposed at positions which are remote from one of the end portions by different distances as measured along the respective divided cable portions.

2. An apparatus according to claim 1, wherein said flexible cable portion comprises a printed conductor pattern.

3. An apparatus according to claim 1, wherein said flexible cable portion is longitudinally folded more than once.

4. An apparatus according to claim 1, wherein each of said positioning portions is provided with a positioning hole for fixing said positioning portions on said apparatus.

5. An apparatus according to claim 1, wherein one of said end portions is movable within said apparatus, and said movable end portion is connected to a sensor for a scanner.

6. An apparatus according to claim 1, wherein one of said end portions is movable within said apparatus, and said movable end portion is connected to a recording head.

7. An apparatus according to claim 6, wherein the recording head is an ink jet recording head.

8. An apparatus having a flexible cable, said apparatus comprising:

a flexible cable portion which is divided, except for opposite end portions, along a line connecting the opposite end portions into a plurality of divided cable portions, wherein one of said divided cable portions is overlapped with another by folding said flexible cable portion at the end portions which are not divided, along extensions of the line; and positioning portions for positioning said divided cable portions on said apparatus, respectively, at positions of said divided cable portions which are remote from one of the end portions by different distances as measured along the respective divided cable portions.

9. An apparatus according to claim 8, wherein said flexible cable portion comprises a printed conductor pattern.

10. An apparatus according to claim 8, wherein said flexible cable portion is longitudinally folded more than once.

11. An apparatus according to claim 8, wherein each of said positioning portions is provided with a positioning hole for fixing said positioning portions on said apparatus.

12. An apparatus according to claim 8, wherein one of said end portions is movable within said apparatus, and said movable end portion is connected to a sensor for a scanner.

13. An apparatus according to claim 8, wherein one of said end portions is movable within said apparatus, and said movable end portion is connected to a recording head.

14. An apparatus according to claim 13, wherein the recording head is an ink jet recording head.

15. A recording apparatus comprising:

a carriage for carrying a recording head;

a flexible cable electrically connected with the recording head, wherein said flexible cable is divided, except for opposite end portions, along a line connecting the opposite end portions into a plurality of divided cable portions, wherein one of said divided cable portions is overlapped with another of said divided cable portions by folding said flexible cable at the end portions which are not divided, along extensions of the line; and positioning portions mounted on said divided cable portions, respectively, said positioning portions being connected with each other, wherein said positioning portions are disposed at positions which are remote from one of the end portions by different distances as measured along the respective divided cable portions.

16. An apparatus according to claim 15, wherein the recording head is an ink jet recording head.

17. A recording apparatus comprising:

a carriage for carrying a recording head;

a flexible cable electrically connected with the recording head, wherein said flexible cable is divided, except for opposite end portions, along a line connecting the opposite end portions into a plurality of divided cable portions, wherein one of said divided cable portions is overlapped with another of said divided cable portions by folding said flexible cable at the end portions which are not divided, along extensions of the line; and positioning portions for positioning said divided cable portions on said apparatus, respectively, at positions of said divided cable portions which are remote from one of the end portions by different distances as measured along the respective divided cable portions.

18. An apparatus according to claim 17, wherein the recording head is an ink jet recording head.

19. An apparatus having a flexible cable, said apparatus comprising:

a flexible cable portion which is divided, except for opposite end portions, along a line connecting the opposite end portions into a plurality of divided cable portions, wherein one of said divided cable portions is overlapped with another of said divided cable portions by folding said flexible cable at the end portions which are not divided, along extensions of the line; and positioning portions mounted on said divided cable portions, wherein one of said opposite end portions is mounted to a movable portion of the apparatus, and the other of said opposite end portions is mounted to a fixed portion of said apparatus, and wherein said positioning portions are mounted such that when said movable portion is moved in a state that said divided cable portions are folded back in a direction of the movement, folded portions of said divided cable portions are deviated by a predetermined distance.

* * * * *

UNITED STATES PATENT AND TRADEMARK OFFICE

CERTIFICATE OF CORRECTION

PATENT NO. : 6,341,844 B1
DATED : January 29, 2002
INVENTOR(S) : Uchikata et al.

It is certified that error appears in the above-identified patent and that said Letters Patent is hereby corrected as shown below:

Column 26,
Line 26, "fixed-data" should read -- fixed data --.
Line 67, "Si" should read -- S1 --.

Signed and Sealed this

Twenty-first Day of May, 2002

*Attest:*

*Attesting Officer*

JAMES E. ROGAN
*Director of the United States Patent and Trademark Office*